US009687024B2

(12) United States Patent
Kaljura et al.

(10) Patent No.: US 9,687,024 B2
(45) Date of Patent: Jun. 27, 2017

(54) SMOKING ARTICLE AND METHOD OF MANUFACTURING A SMOKING ARTICLE

(75) Inventors: Karl Kaljura, London (GB); Paul Clarke, Milton Keynes (GB); Ian Dunckley, London (GB); Philip Russell Fawcus, London (GB); Kevin Blick, London (GB); David Paton, London (GB); John Richardson, London (GB); Kie Seon Park, London (GB); Stuart Dunlop, London (GB); Patrick Meredith, Milton Keynes (GB); Graham Penrose, Milton Keynes (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/238,623

(22) PCT Filed: Aug. 9, 2012

(86) PCT No.: PCT/GB2012/051933

§ 371 (c)(1),
(2), (4) Date: May 8, 2014

(87) PCT Pub. No.: WO2013/024263

PCT Pub. Date: Feb. 21, 2013

(65) Prior Publication Data

US 2014/0238425 A1 Aug. 28, 2014

(30) Foreign Application Priority Data

Aug. 12, 2011 (GB) ..... 1113936.7

(51) Int. Cl.
*A24D 3/04* (2006.01)
*A24D 3/02* (2006.01)

(52) U.S. Cl.
CPC ..... *A24D 3/041* (2013.01); *A24D 3/025* (2013.01); *A24D 3/043* (2013.01); *A24D 3/048* (2013.01)

(58) Field of Classification Search
CPC ..... A24D 3/041; A24D 3/043
See application file for complete search history.

(56) References Cited

U.S. PATENT DOCUMENTS 3,376,874 A 4/1968 Kim et al.
4,593,707 A 6/1986 Seidel et al.
(Continued)

FOREIGN PATENT DOCUMENTS

EP 0189980 A1 8/1986
EP 0212879 A1 3/1987
(Continued)

OTHER PUBLICATIONS

International Search Report and Written Opinion, mailed Jan. 4, 2013 for PCT/GB2012/051933, filed Aug. 9, 2012.
(Continued)

*Primary Examiner* — Anthony Calandra
(74) *Attorney, Agent, or Firm* — Cantor Colburn LLP

(57) ABSTRACT

Smoking article and method of manufacturing a smoking article A smoking article (10), comprises a first part, and a second part movable relative to the first part. An indexing mechanism comprises a first indexing surface (18) on one of the first part or second part; and a second indexing surface (19) on the other of the first and second parts. The second indexing surface (19) is configured to engage with the first indexing surface (18) to control relative movement between the first part and second part.

22 Claims, 31 Drawing Sheets

(56) References Cited

U.S. PATENT DOCUMENTS

| | | | | |
|---|---|---|---|---|
| 4,638,818 | A | 1/1987 | Nichols et al. | |
| 4,699,158 | A | 10/1987 | Sprinkel, Jr. | |
| 4,700,725 | A | 10/1987 | Geiszler, Jr. | |
| 4,716,912 | A | 1/1988 | Leonard | |
| 4,809,718 | A | 3/1989 | Deal | |
| 4,834,117 | A | 5/1989 | Braem et al. | |
| 4,898,190 | A | 2/1990 | Deal | |
| 2013/0139836 | A1* | 6/2013 | Blick et al. | 131/331 |

FOREIGN PATENT DOCUMENTS

| | | | |
|---|---|---|---|
| EP | 0260789 | A1 | 3/1988 |
| WO | 2006/027437 | A1 | 3/2006 |
| WO | 2011051115 | A1 | 5/2011 |

OTHER PUBLICATIONS

Written Opinion, mailed Oct. 4, 2013, for PCT/GB2012/051933, filed Aug. 9, 2012.
International Preliminary Report on Patentability, mailed Dec. 9, 2013 for PCT/GB2012/051933, filed Aug. 9, 2012.

* cited by examiner

SMOKING ARTICLE AND METHOD OF MANUFACTURING A SMOKING ARTICLE

CLAIM FOR PRIORITY

This application is the National Stage of International Application No. PCT/GB2012/051933, entitled "Smoking Article and Method of Manufacturing a Smoking Article," filed Aug. 9, 2012, which in turn claims priority to GB application number 1113936.7, filed Aug. 12, 2011. The entire contents of the aforementioned applications are herein expressly incorporated by reference.

The present inventions are directed generally to smoking article apparatuses, systems and methods, as well as methods for manufacturing smoking articles. In particular, the inventions relate to apparatuses, systems and methods for a smoking article having a ventilation which can be controllably varied, and methods and apparatuses for manufacturing said smoking articles (hereinafter "invention").

A cigarette may comprise tobacco and cigarette paper. Some cigarettes and other smoking articles may include filter elements. Some cigarettes may have ventilation, such as is described in U.S. Pat. No. 4,699,158.

The present invention provides, in a first aspect, a smoking article, comprising: a first part, a second part movable relative to the first part, further comprising an indexing mechanism comprising a first indexing surface on one of the first part or second part; and a second indexing surface on the other of the first and second parts, wherein the second indexing surface is configured to engage with the first indexing surface to control relative movement between the first part and second part.

The present invention provides, in a second aspect, a method of manufacturing a smoking article, comprising: providing a first part, providing a second part, and attaching the second part to the first part such that the second part is movable relative to the first part, forming in the first and second parts further an indexing mechanism comprising a first indexing surface on one of the first part or second part; and a second indexing surface on the other of the first and second parts, wherein the second indexing surface is formed to engage with the first indexing surface to control relative rotation between the first part and second part.

The present invention provides, in a third aspect, an apparatus for forming a part of a smoking article, wherein the apparatus comprises one or more rollers and/or curling bars comprising a cut-out to provide a passage for the second indexing means without contact with the roller or curling bar.

The present invention provides, in a fourth aspect, an apparatus for forming a part of a smoking article comprising a module configured to form a second indexing means and attach the second indexing means to a sheet of material to be formed into a cylindrical sleeve.

The present invention provides, in a fifth aspect, a filter for a smoking article, comprising: a first indexing surface configured to engage with a second indexing surface to form an indexing mechanism; wherein the first indexing surface is configured to engage with the second indexing surface to control relative movement between the first indexing surface and second indexing surface.

Embodiments of the present invention will now be described, by way of example only, with reference to the accompanying drawings, in which.

Figure 4:
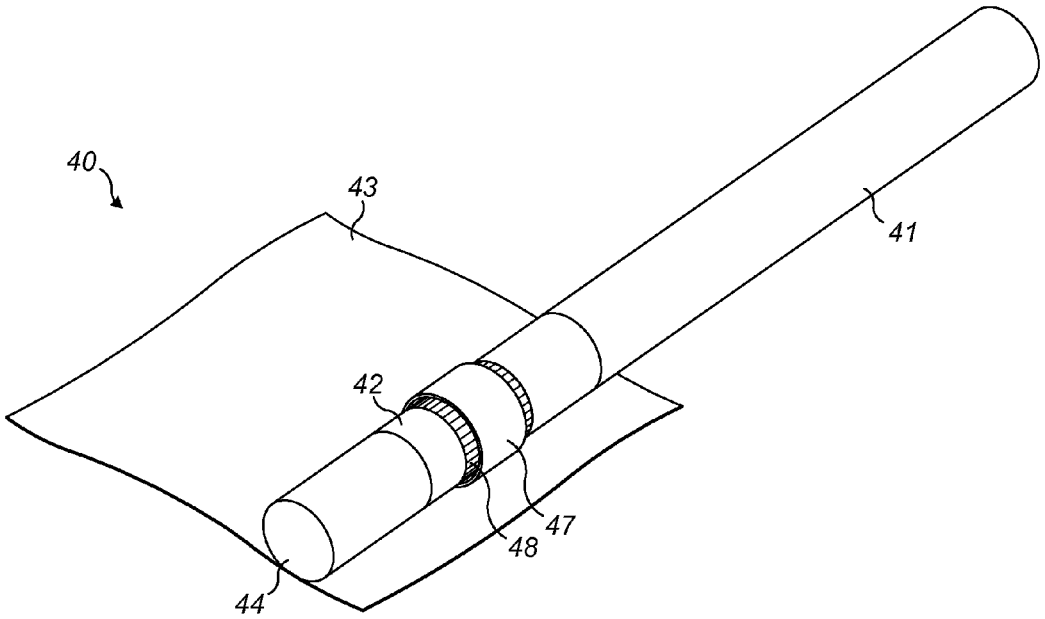
FIG. 4 is a perspective view of a partially formed smoking article with a third embodiment of an indexing mechanism of the first family.
Figure 7A:
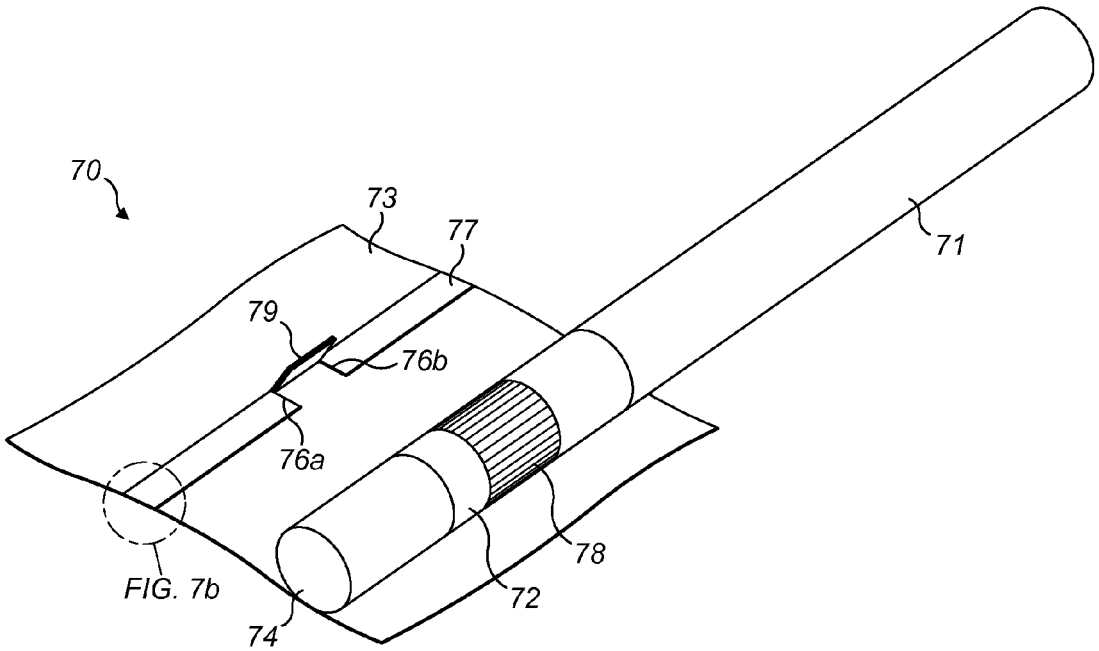
Figure 7B:
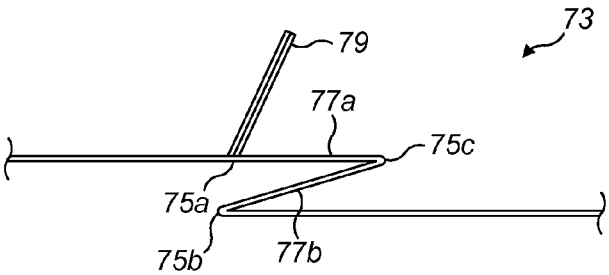
Figure 8A:
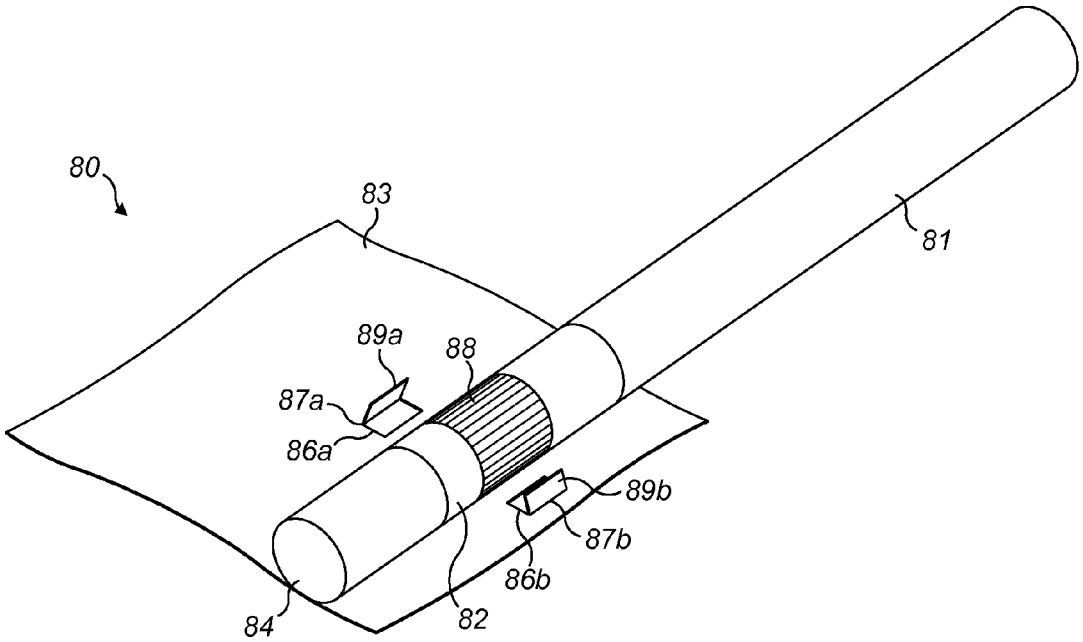
Figure 8B:
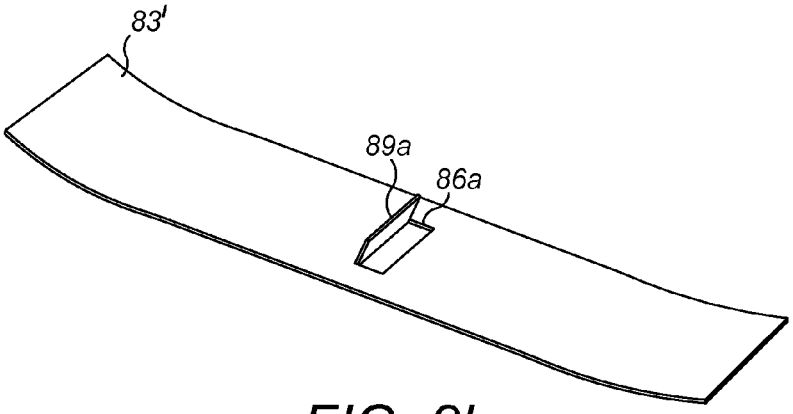
Figure 8C:
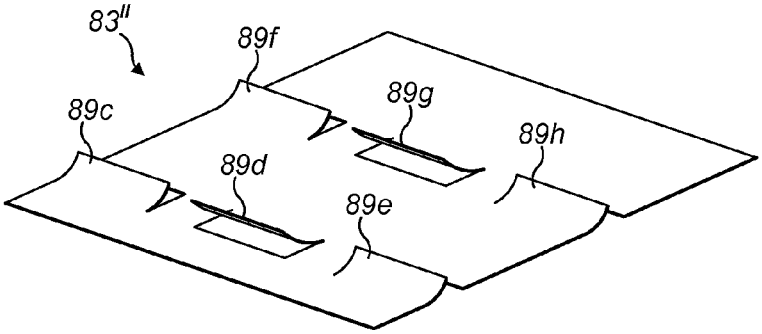
Figure 9:
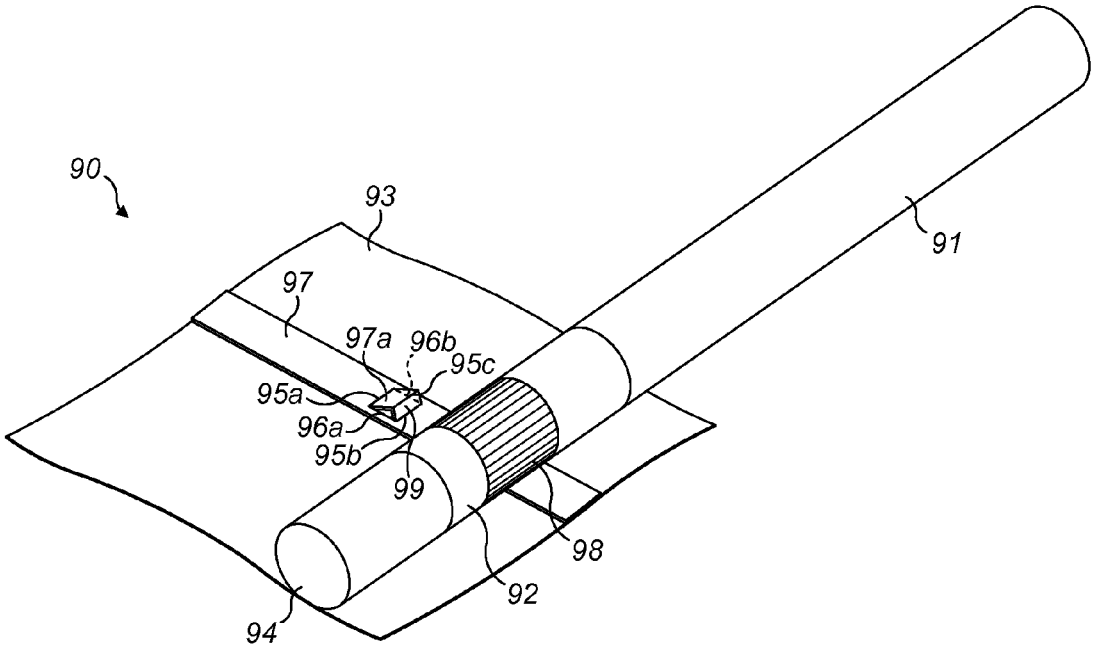
Figure 10:
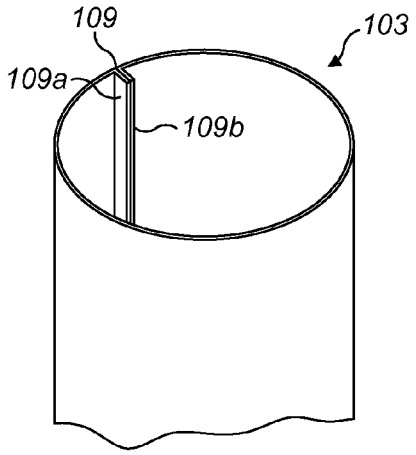
Figure 11:
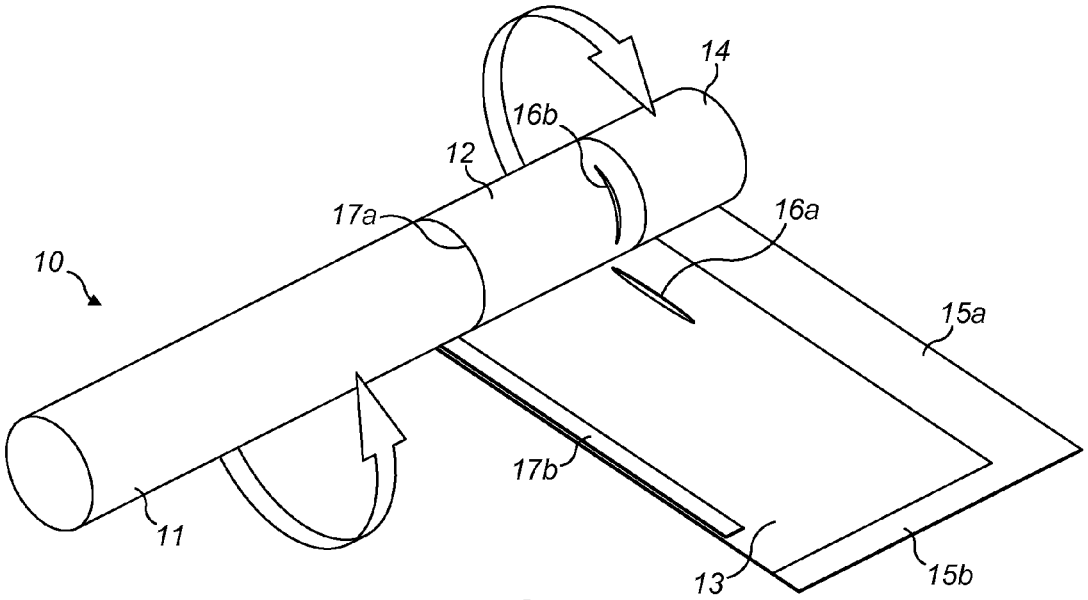
Figure 12:
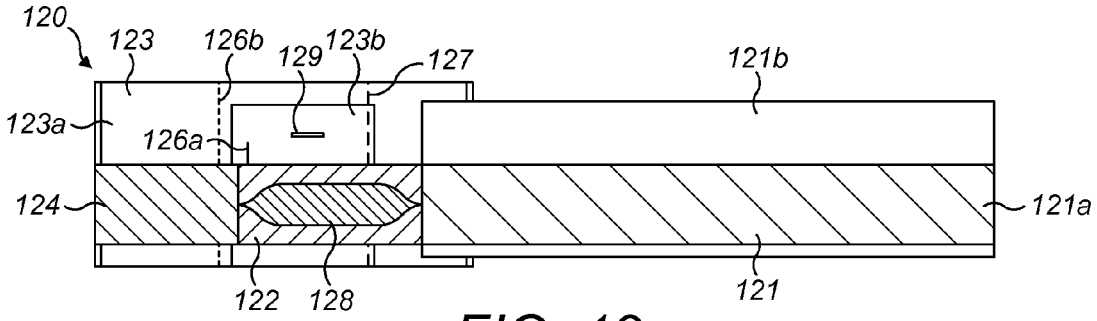
Figure 13:
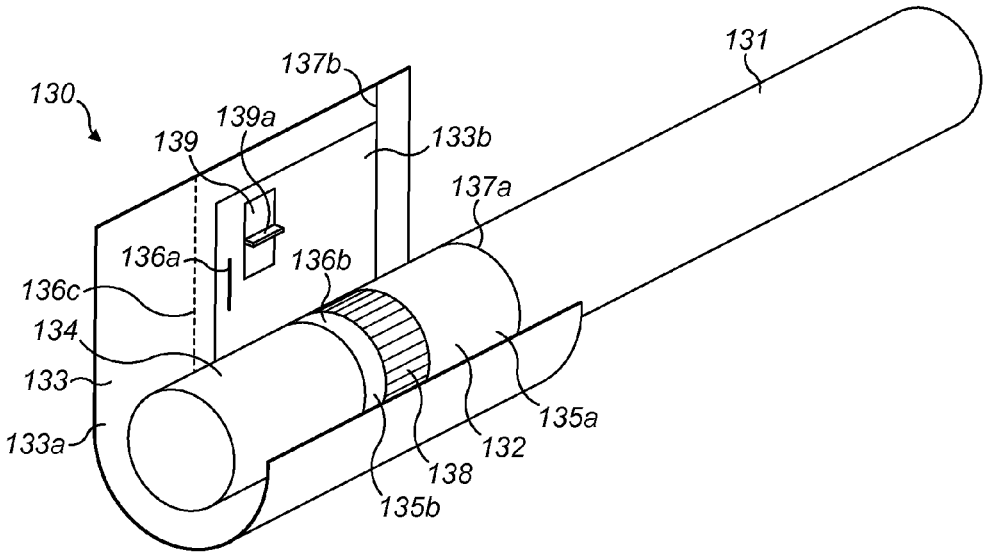
Figure 14:
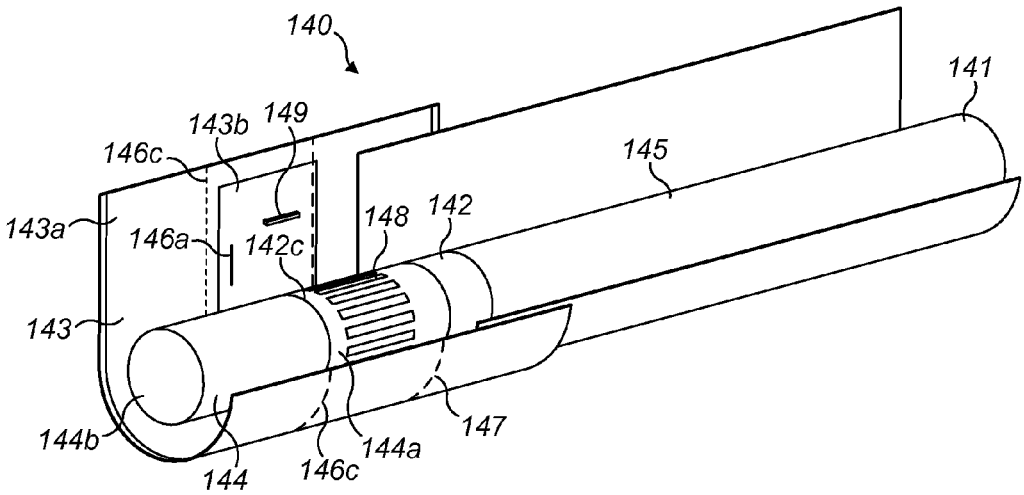
Figure 15:
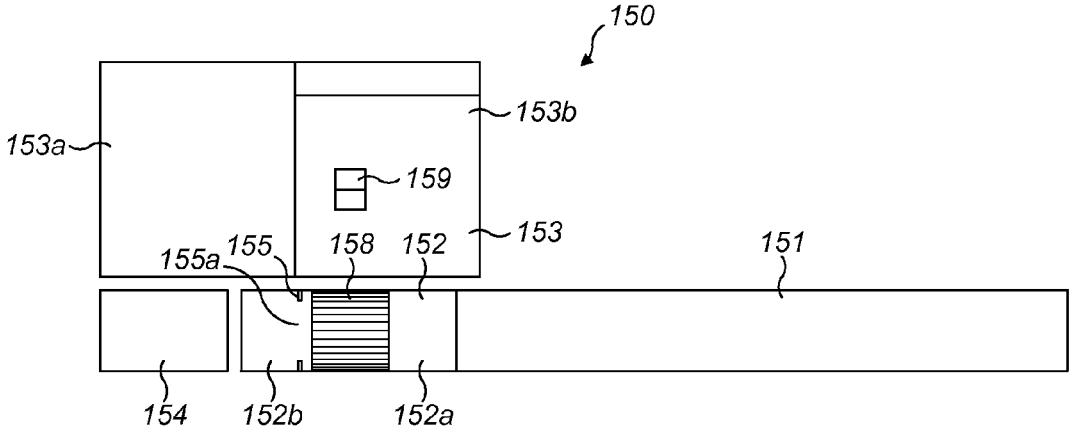
Figure 16:
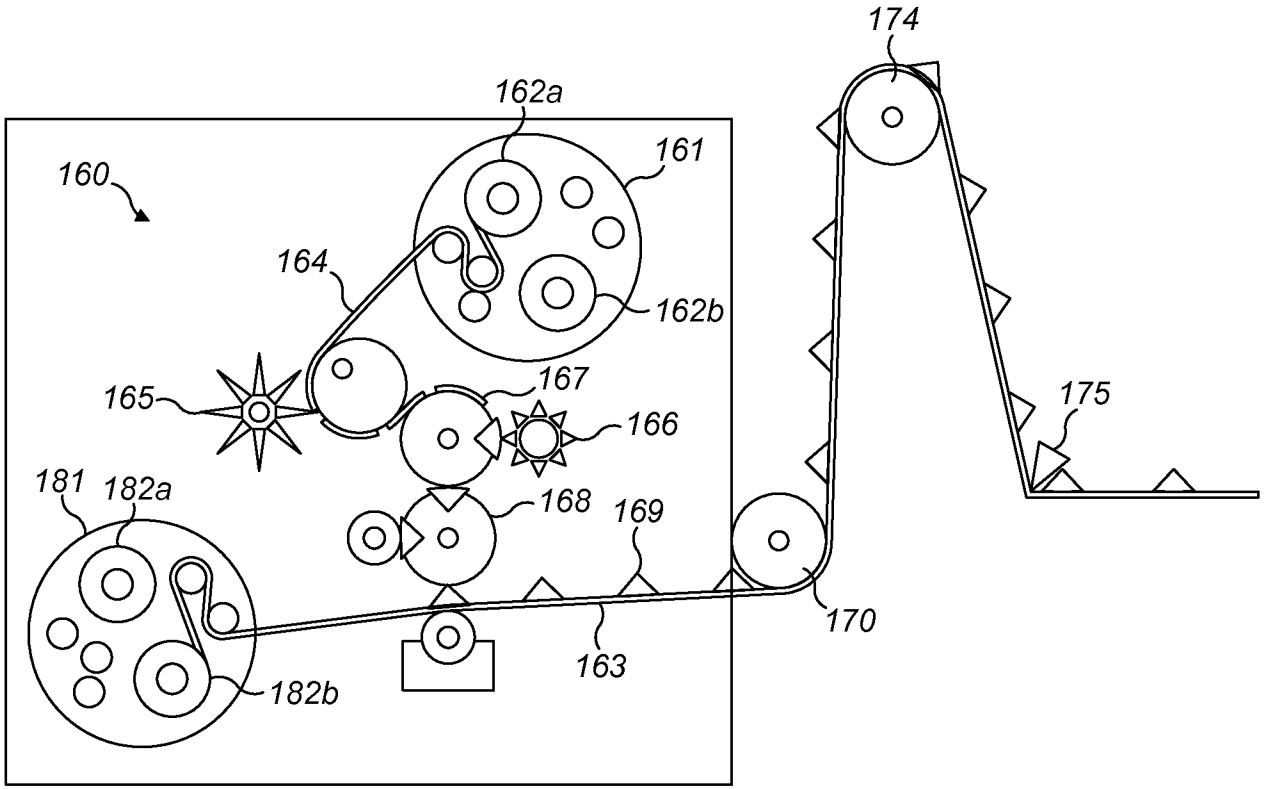
Figure 17A:
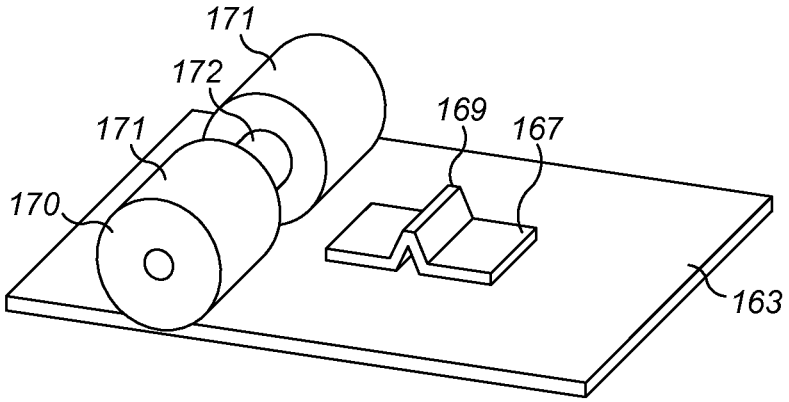
Figure 17B:
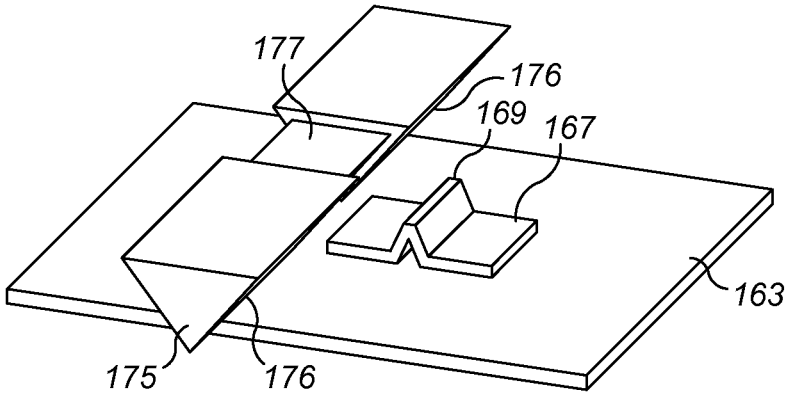
Figure 18A:
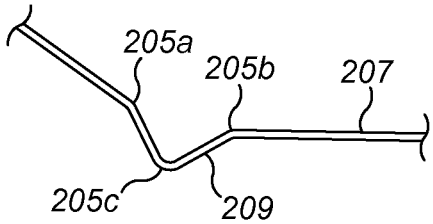
Figure 18B:
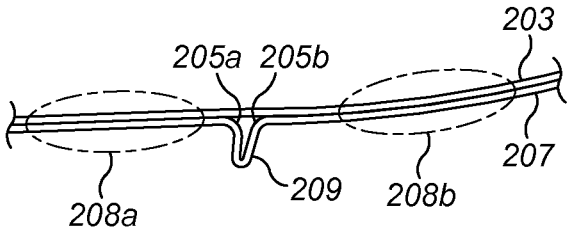
Figure 19:
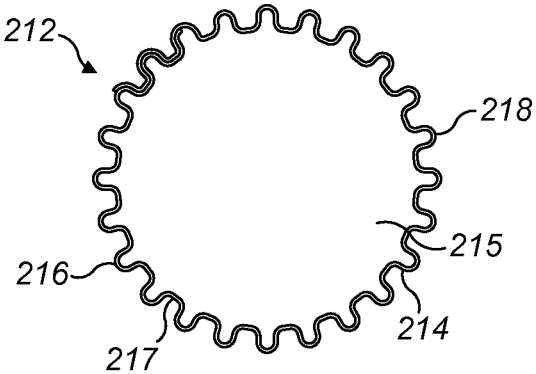
Figure 20A:
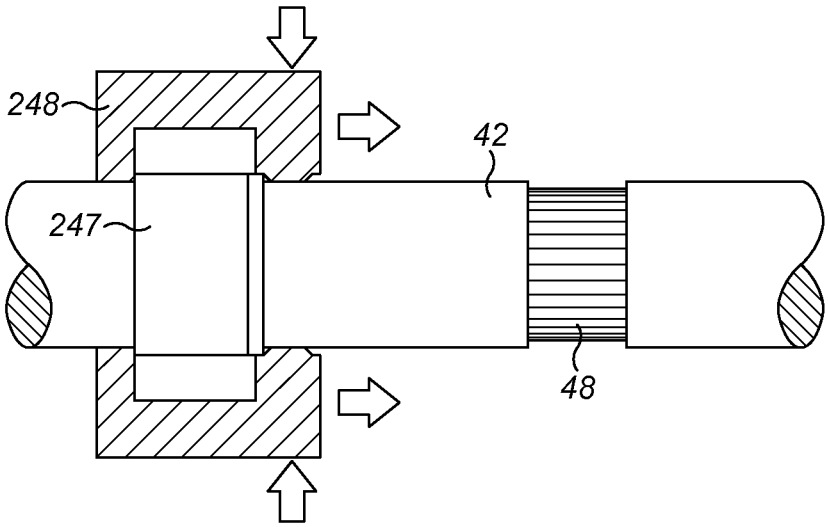
Figure 20B:
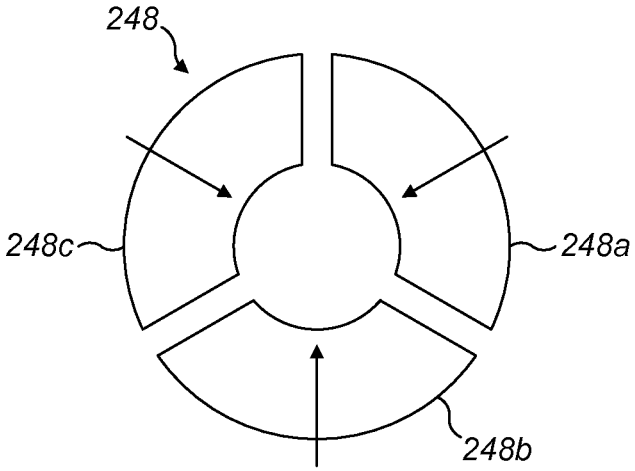

FIG. 7*a* is a perspective view of a smoking article with a sixth embodiment of an indexing mechanism of the first family;

FIG. 7*b* is a side elevation view of a partially formed smoking article with the sixth embodiment of indexing mechanism of the first family;

FIG. 8*a* is a perspective view of a partially formed smoking article with a seventh embodiment of an indexing mechanism of the first family;

FIG. 8*b* is a perspective view of a part of a smoking article with a variation of the seventh embodiment of indexing mechanism of the first family;

FIG. 8*c* is a perspective view of a part of a smoking article with a further variation of the seventh embodiment of indexing mechanism of the first family;

FIG. 9 is perspective view of a smoking article with an eighth embodiment of an indexing mechanism of the first family;

FIG. 10 is a perspective view of a smoking article with a ninth embodiment of an indexing mechanism of the first family;

FIG. 11 is a perspective view of a smoking article according to the present invention;

FIG. 12 is an cut-away side elevation view of a smoking article of a further embodiment of the present invention;

FIG. 13 is a perspective view of a smoking article in a partially formed state of a yet further embodiment of the present invention;

FIG. 14 is a perspective view of a smoking article in a partially formed state of a yet further embodiment of the present invention;

FIG. 15 is a side elevation view of a smoking article in a partially formed state of a yet further embodiment of the present invention;

FIG. 16 is a schematic side elevation view of an apparatus for manufacturing a part of a smoking article according to the present invention;

FIG. 17*a* is a perspective view of part of the manufacturing apparatus shown in FIG. 16;

FIG. 17*b* is a perspective view of a further part of the manufacturing apparatus shown in FIG. 16;

FIG. 18*a* is a perspective view of a part of a smoking article in a partially formed state according to the present invention;

FIG. 18*b* is a perspective view of a part of a smoking article in a further partially formed state according to the present invention;

FIG. 19 is a cut-away side elevation view of a part of a smoking article according to the present invention;

FIG. 20*a* is a side elevation view of a part of a smoking article according to FIG. 4 during manufacture, and having a first type of collar;

FIG. 20*b* is a front elevation view of a part of the apparatus shown in FIG. 20*a;*

Figure 21:
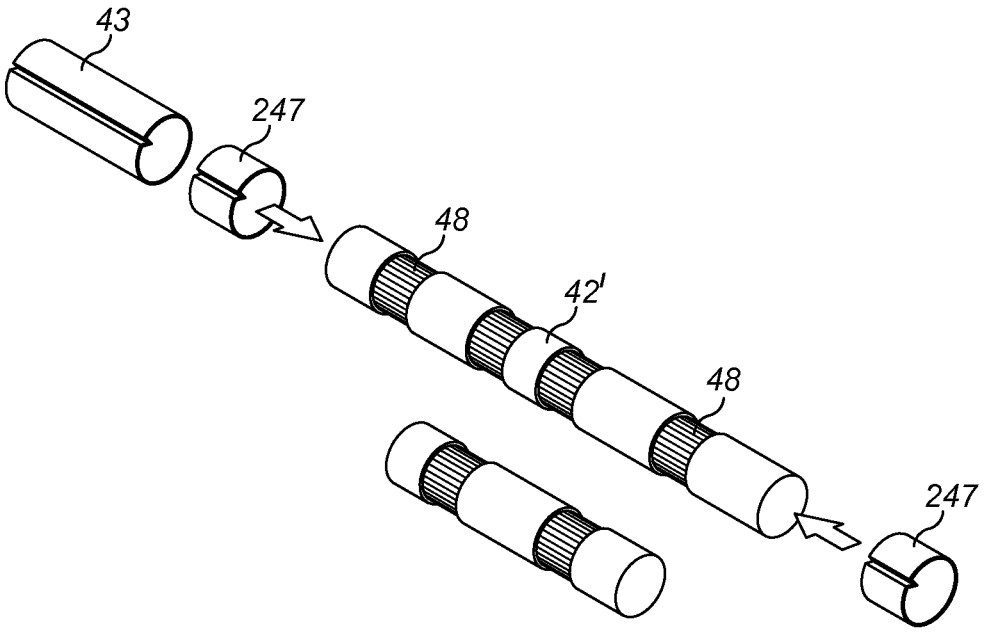
Figure 22:
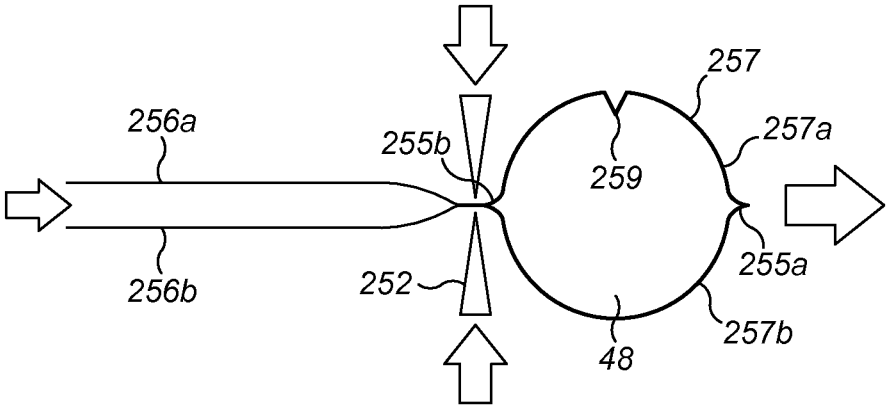
Figure 23:
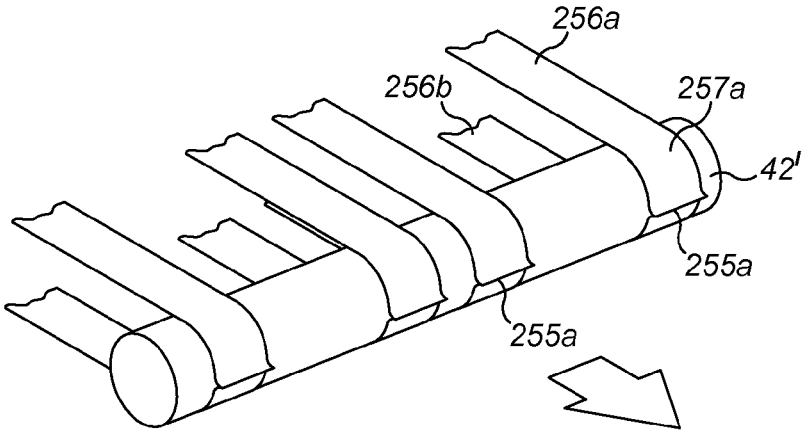
Figure 24:
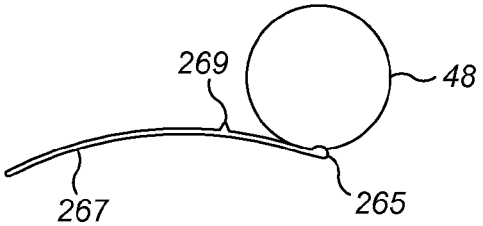
Figure 25:
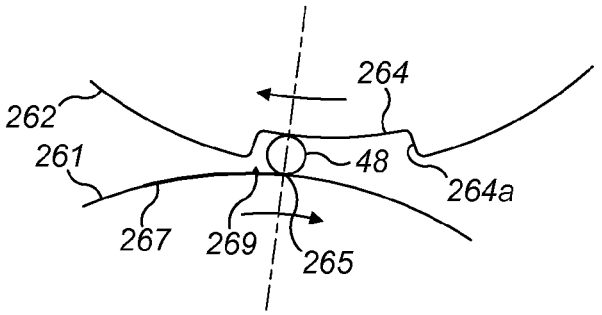
Figure 26A:
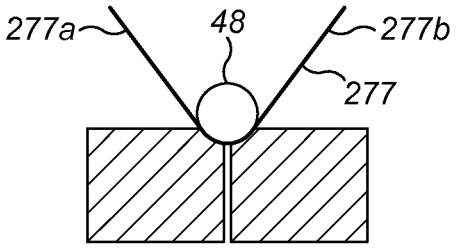
Figure 26B:
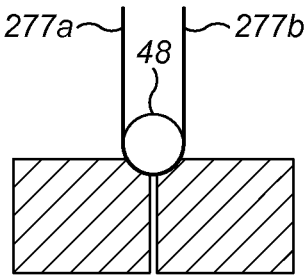
Figure 26C:
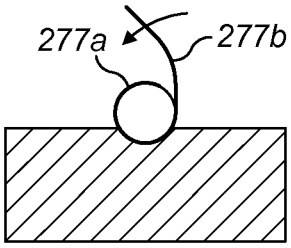
Figure 27:
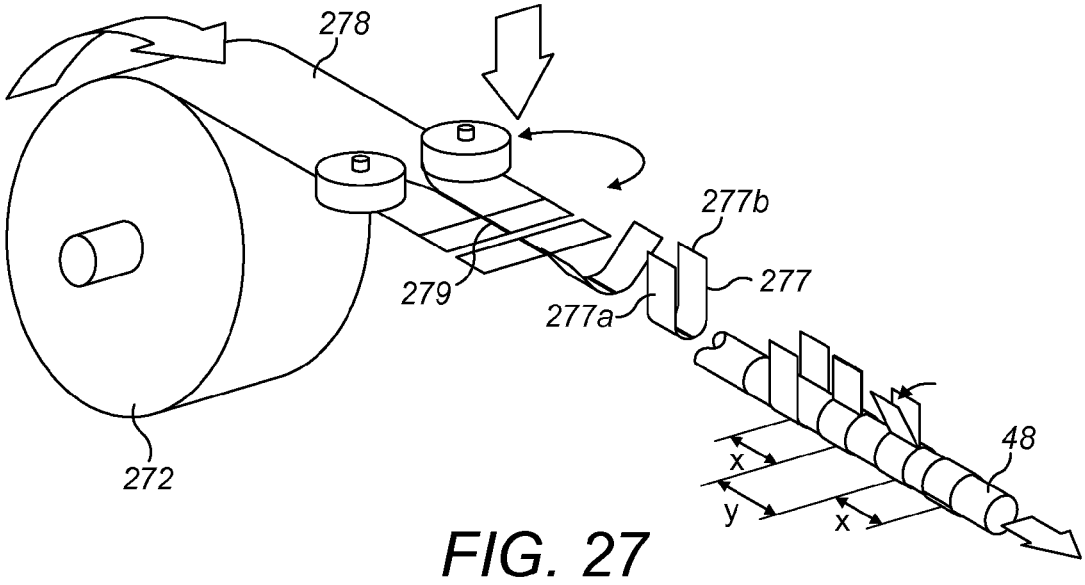
Figure 28:
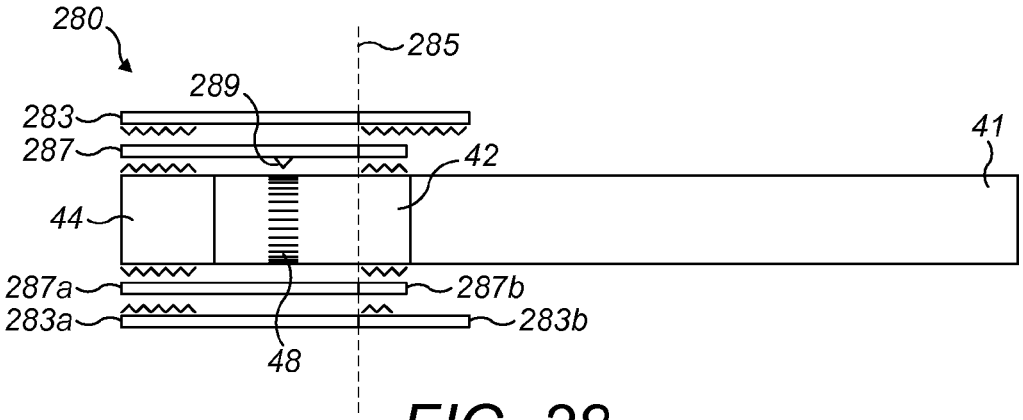
Figure 29:
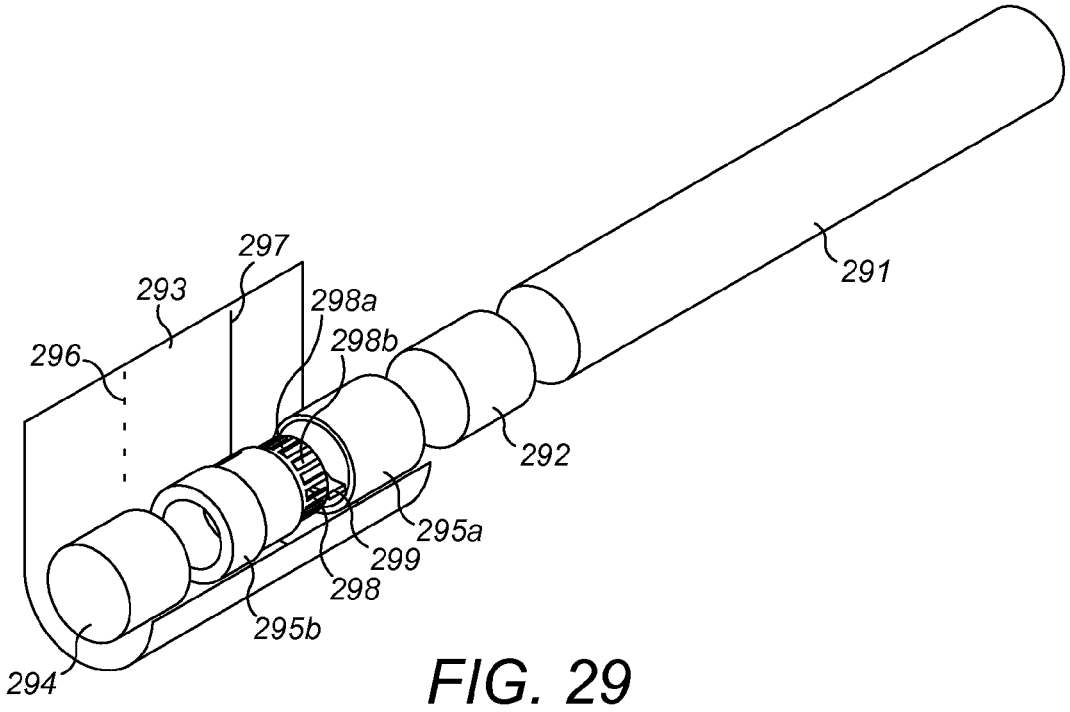
Figure 30:
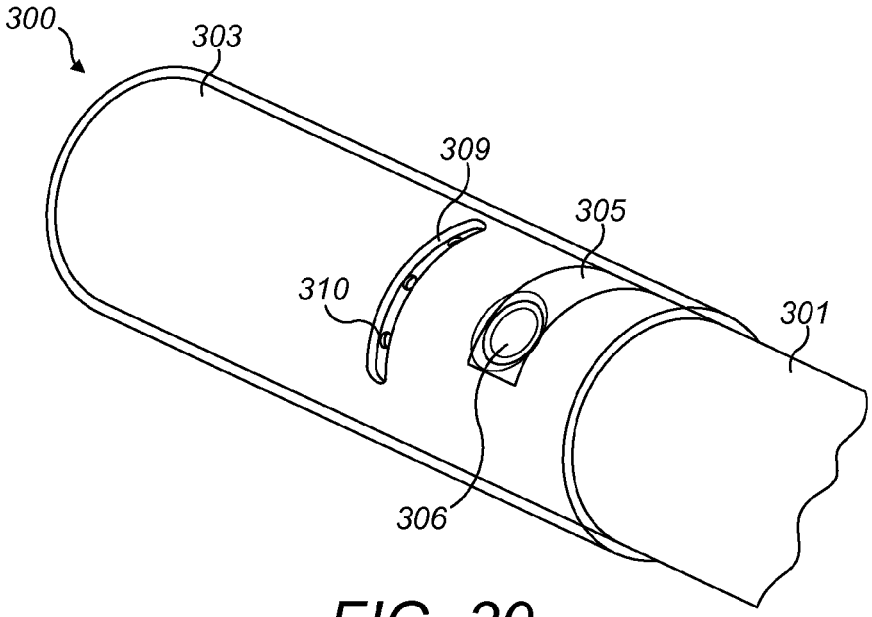
Figure 31:
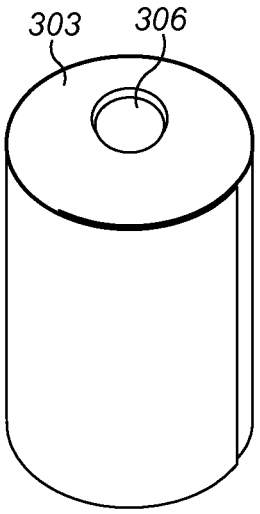
Figure 32:
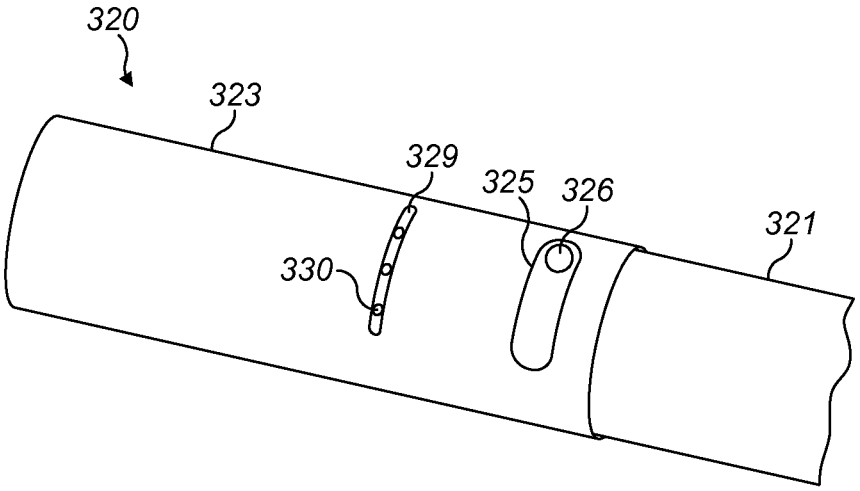
Figure 33:
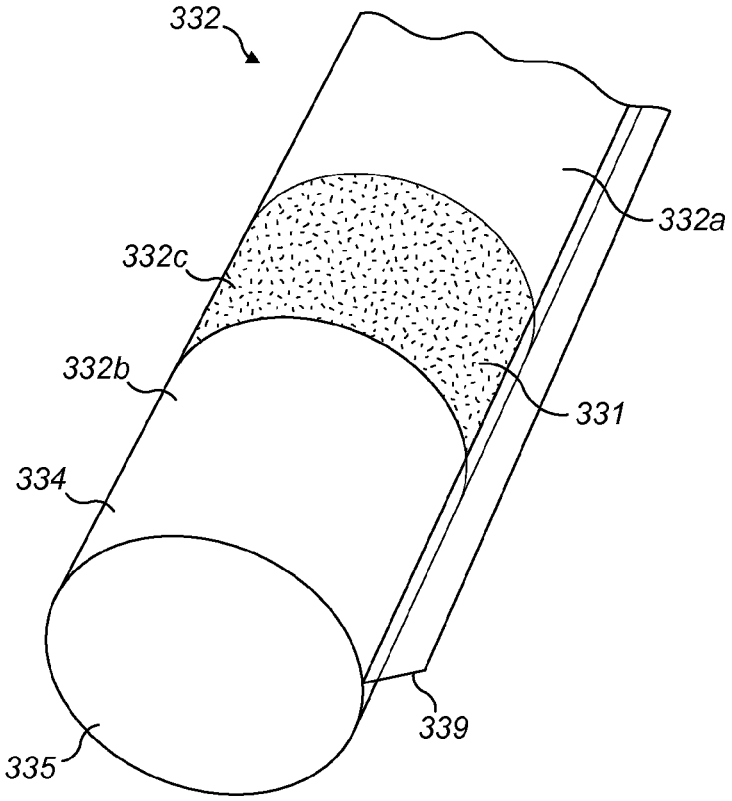
Figure 34:
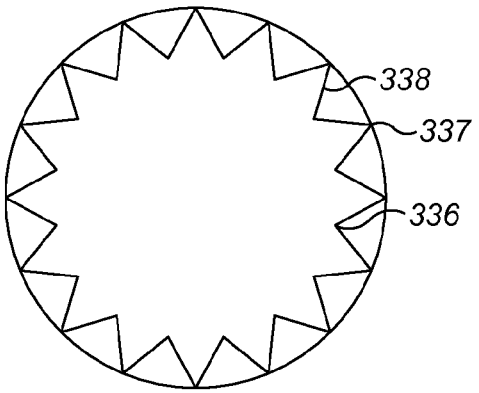
Figure 35:
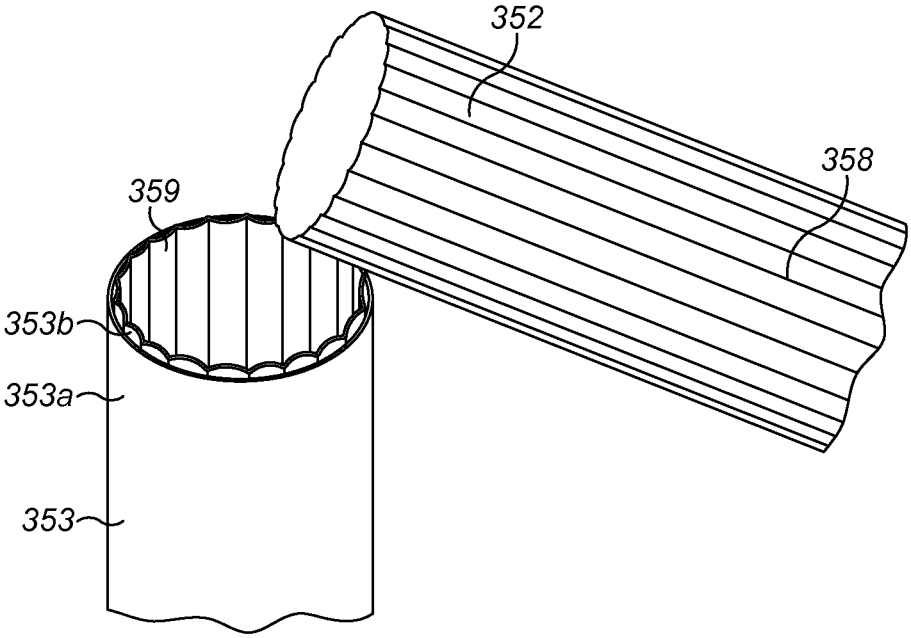
Figure 36:
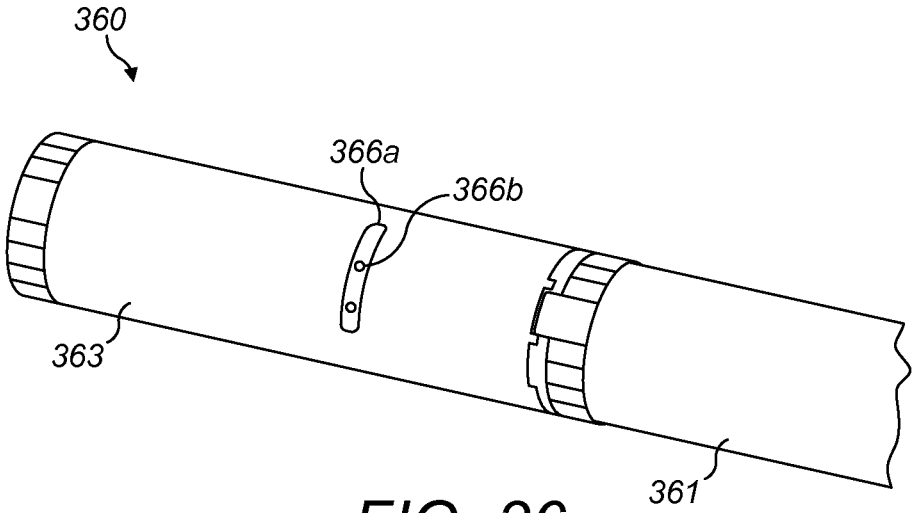
Figure 37A:
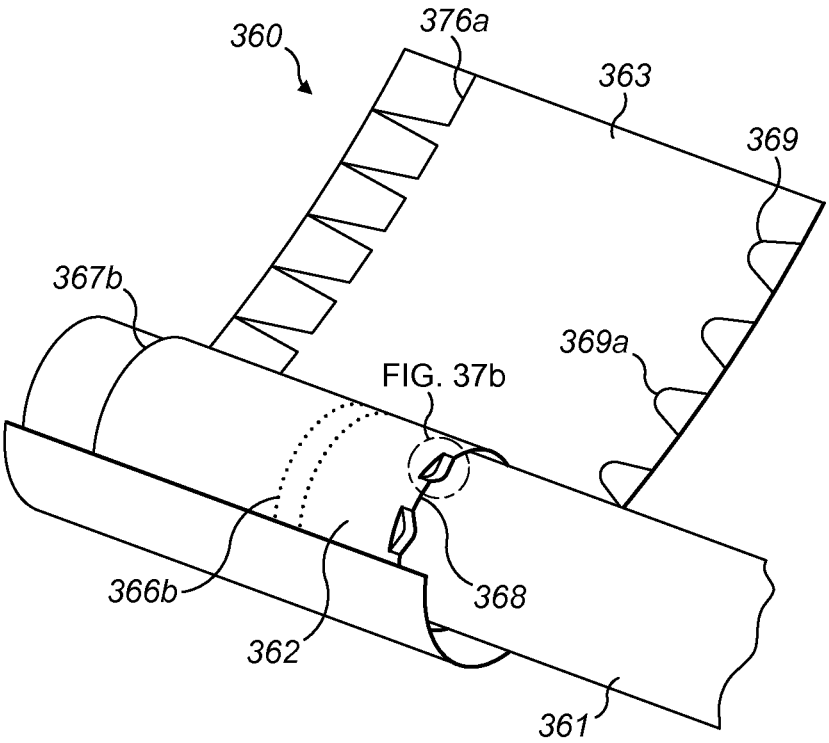
Figure 37B:
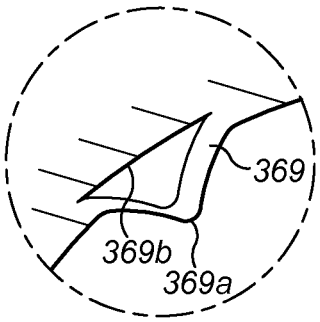
Figure 38:
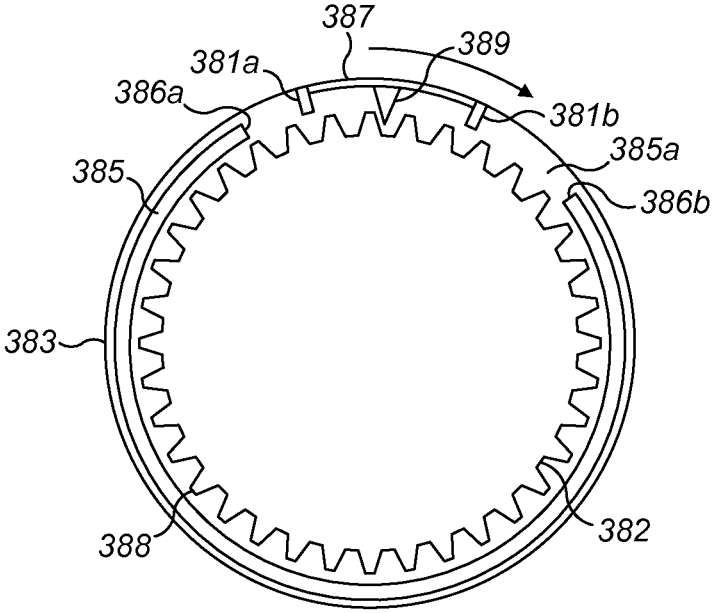
Figure 39:
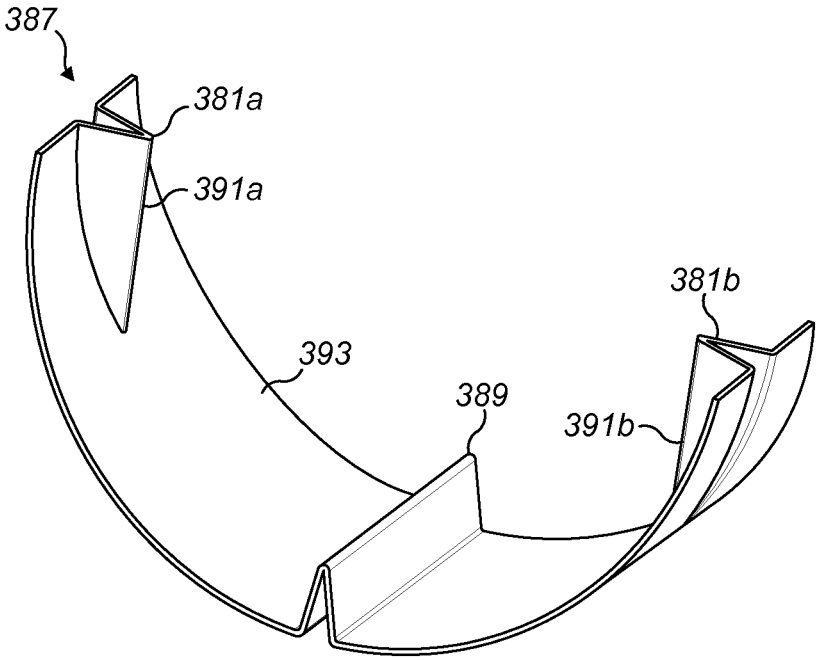
Figure 40:
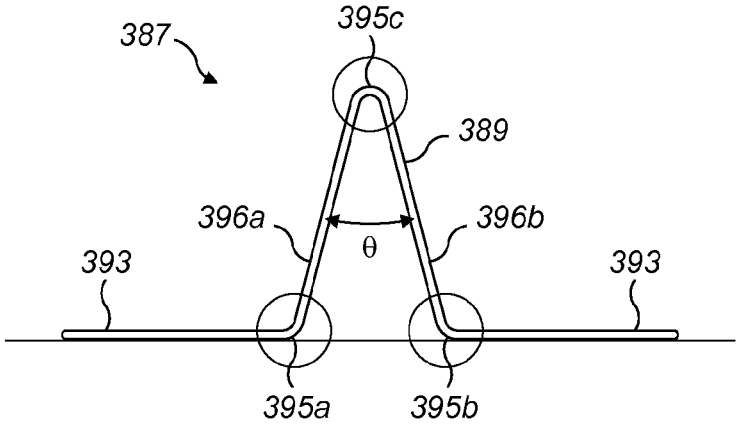
Figure 41A:
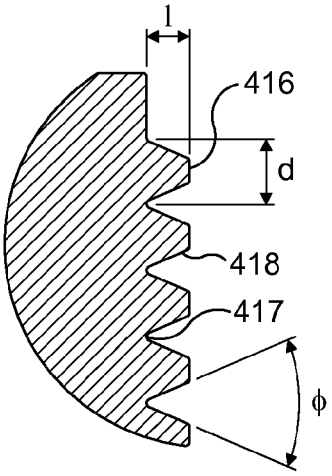
Figure 41B:
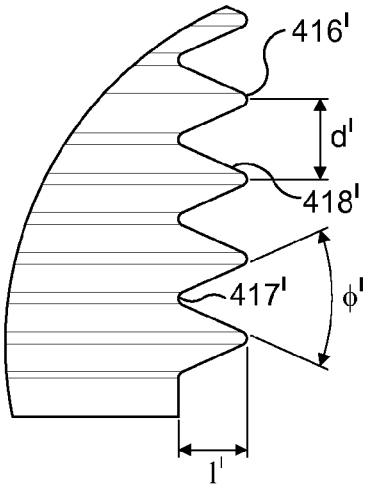
Figure 42:
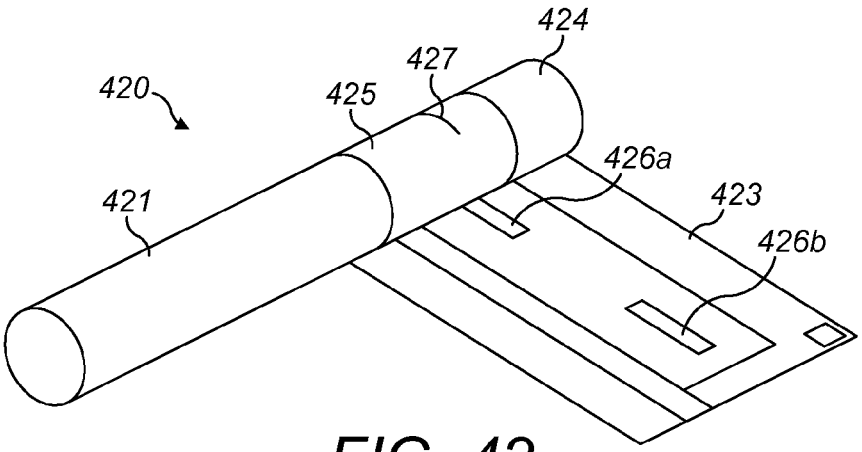
Figure 43:
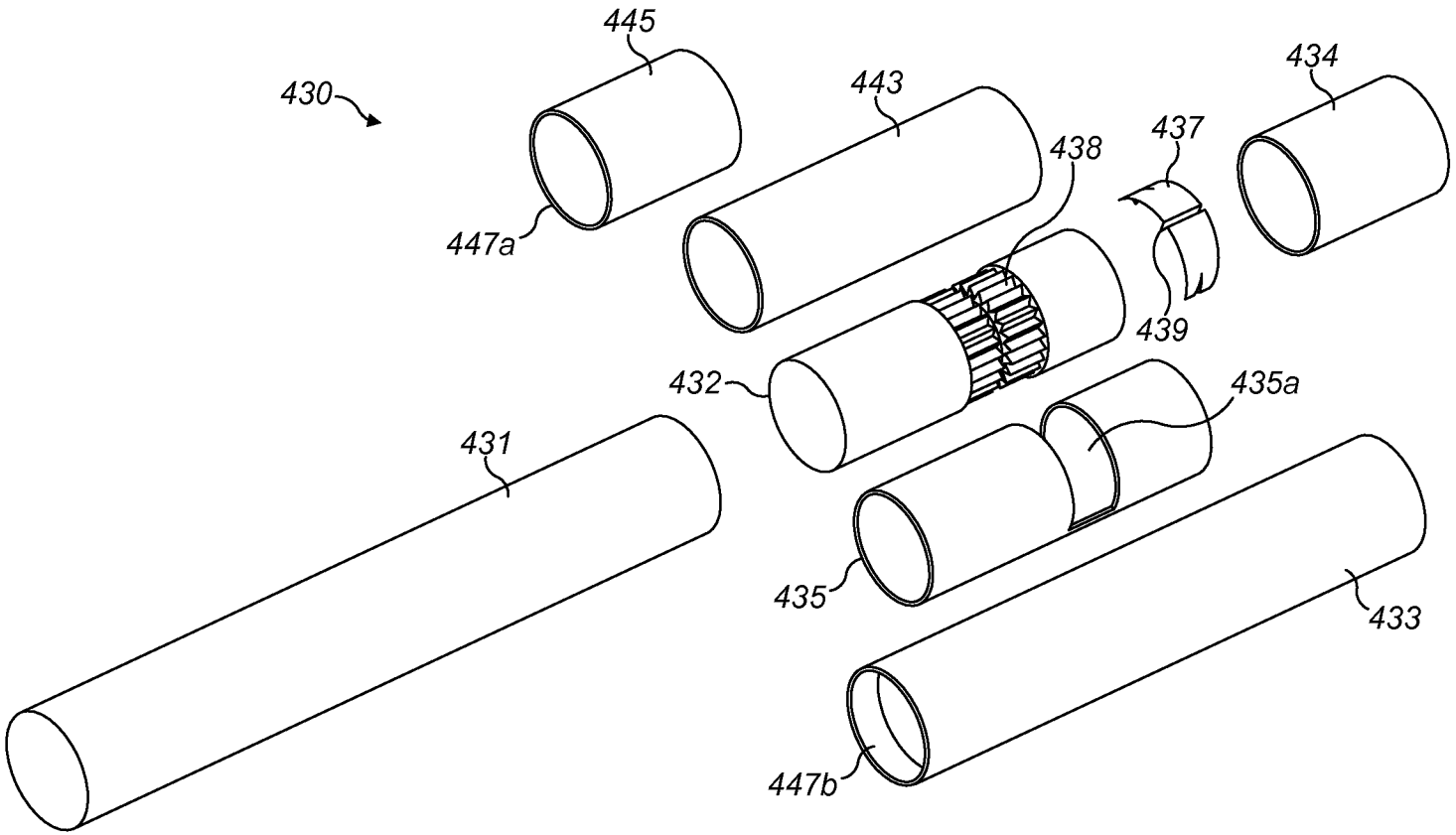
Figure 44:
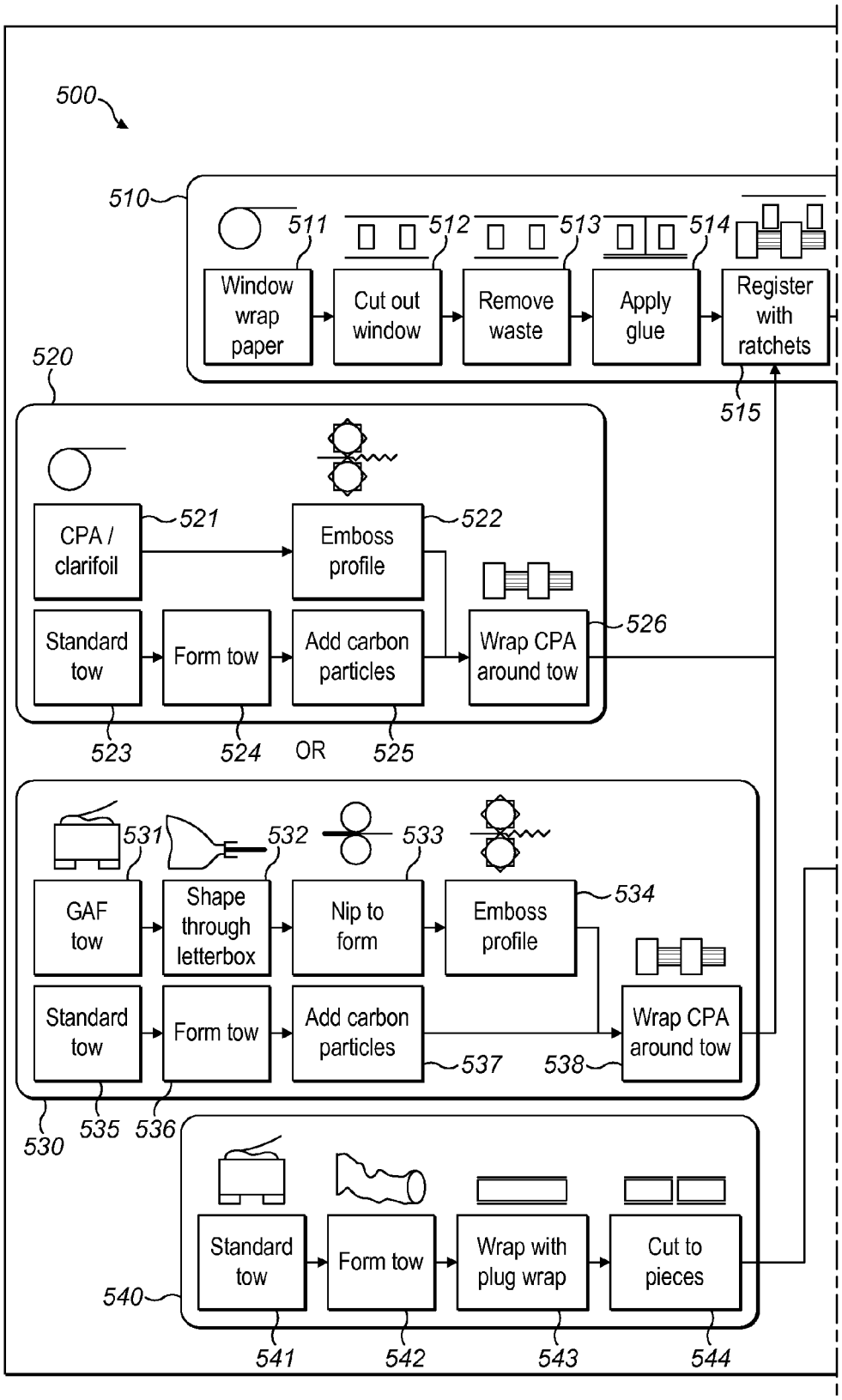
Figure 44:
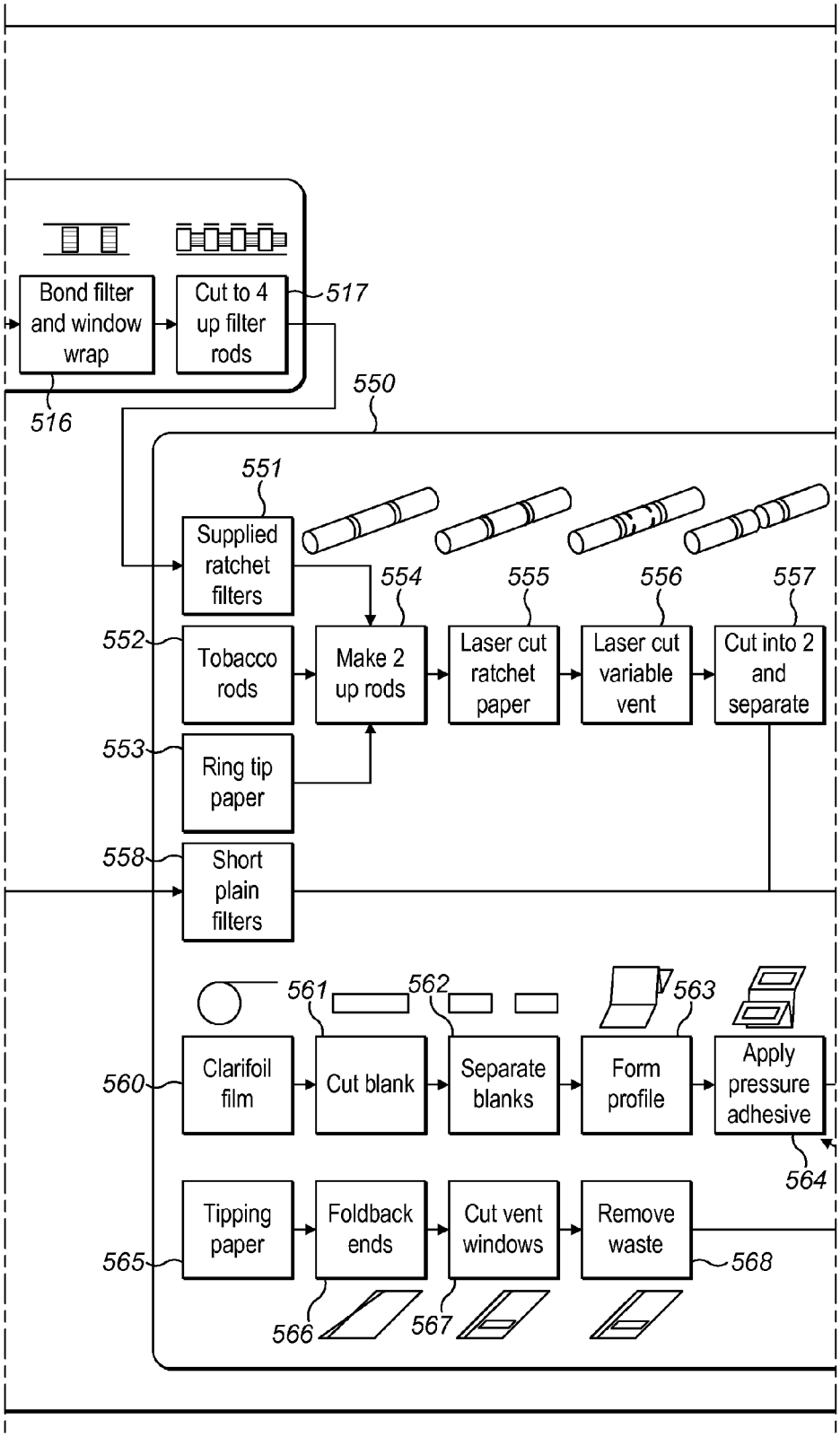
Figure 44:
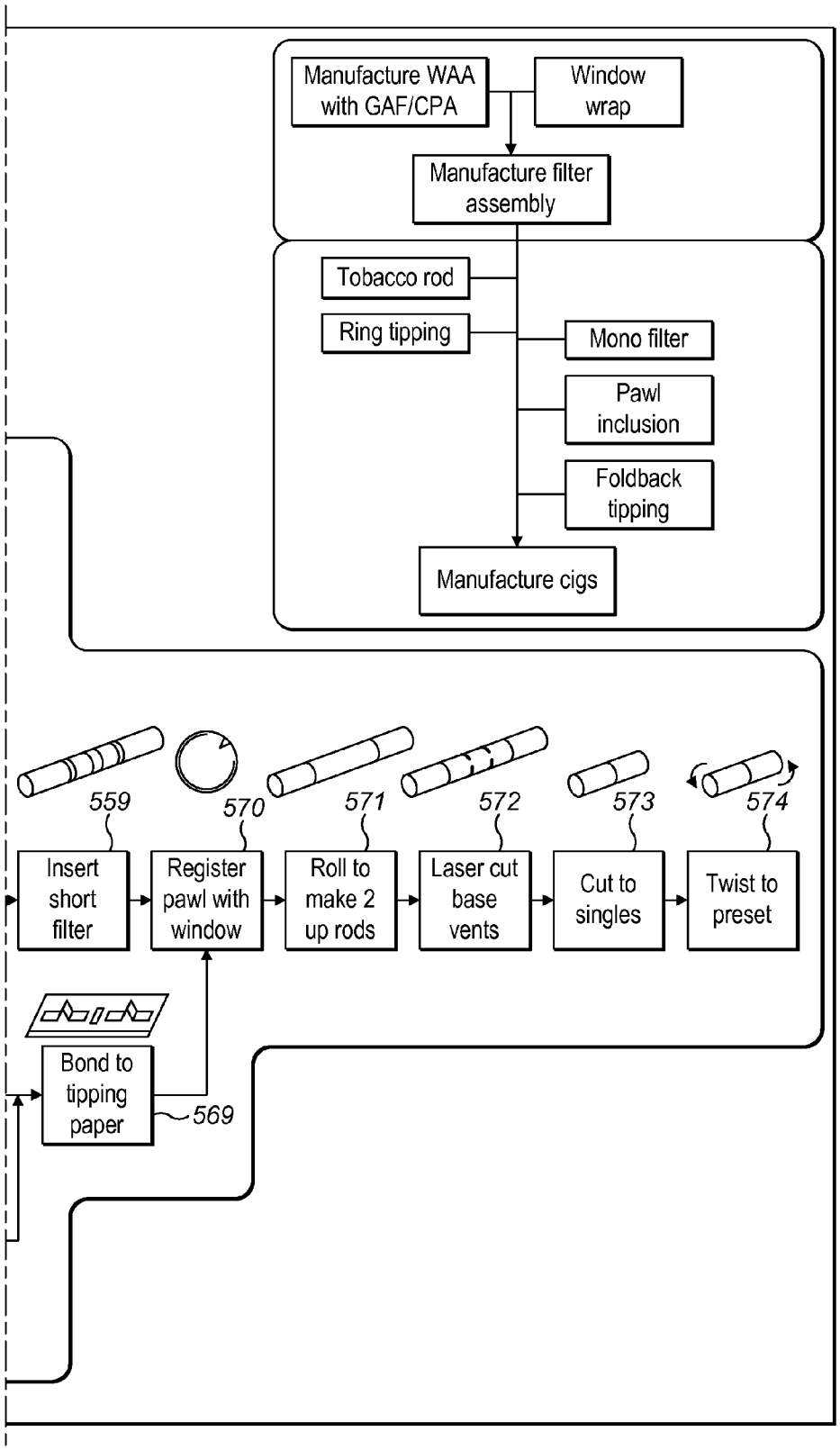
Figure 45:
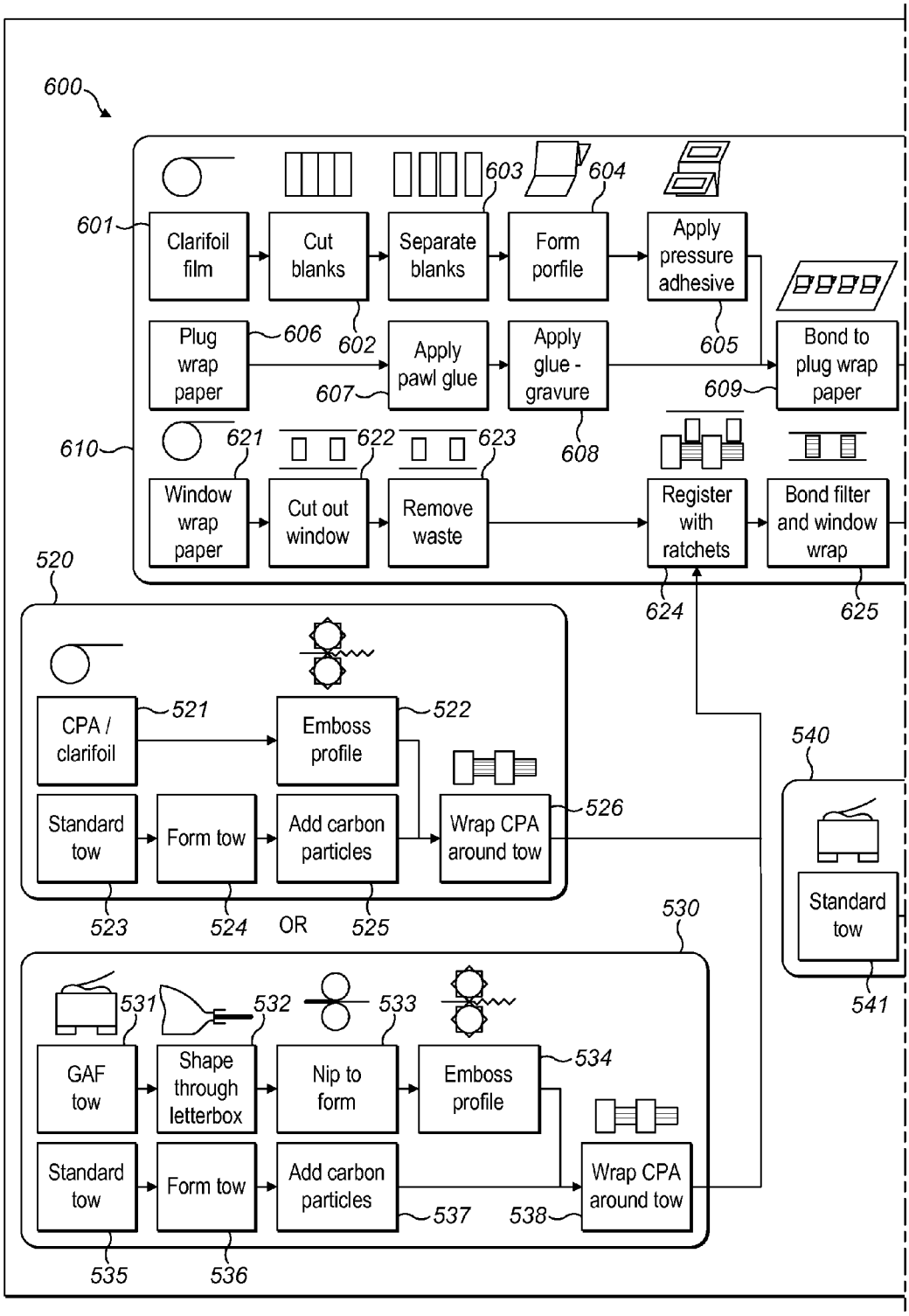
Figure 45:
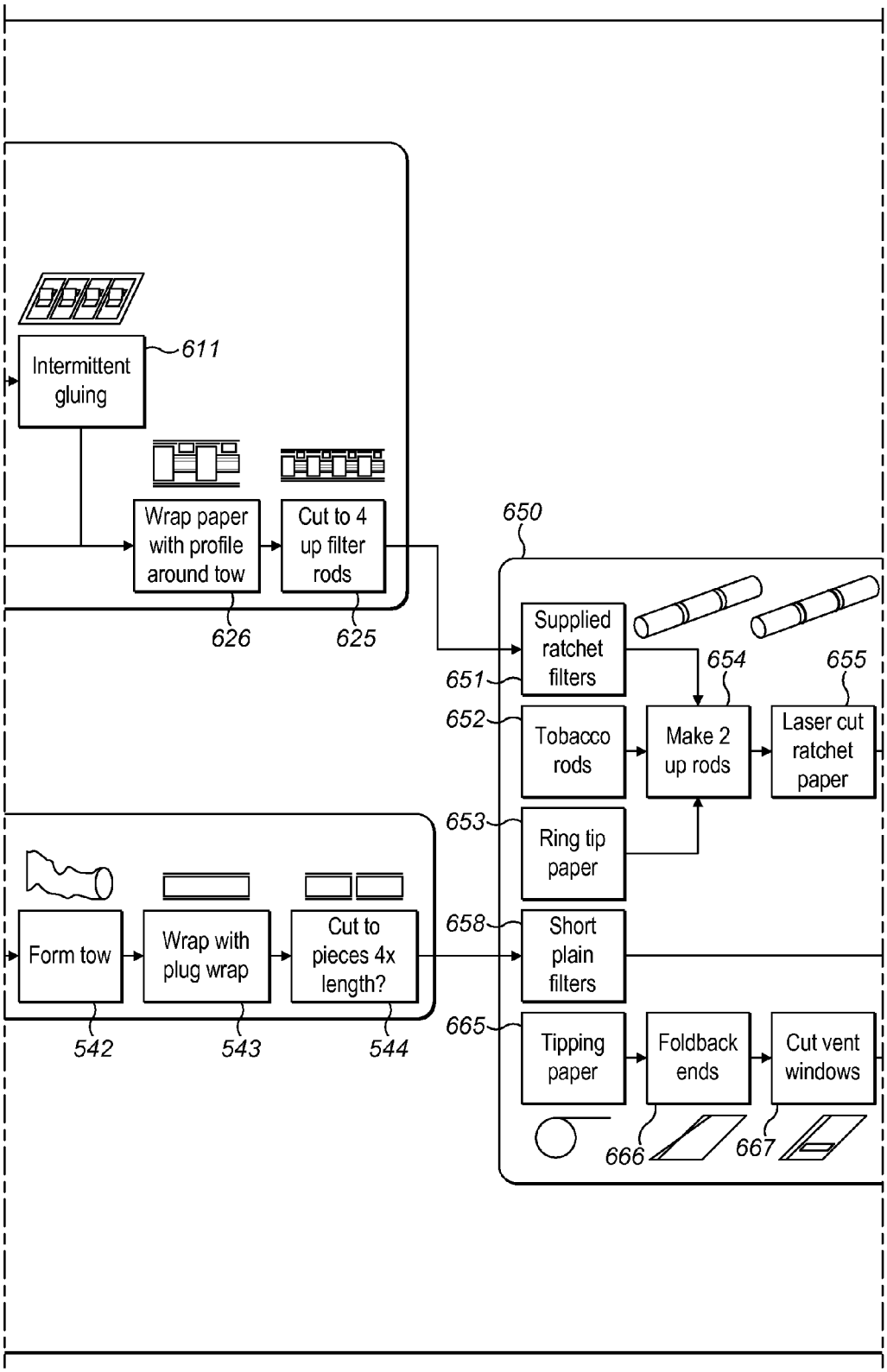
Figure 45:
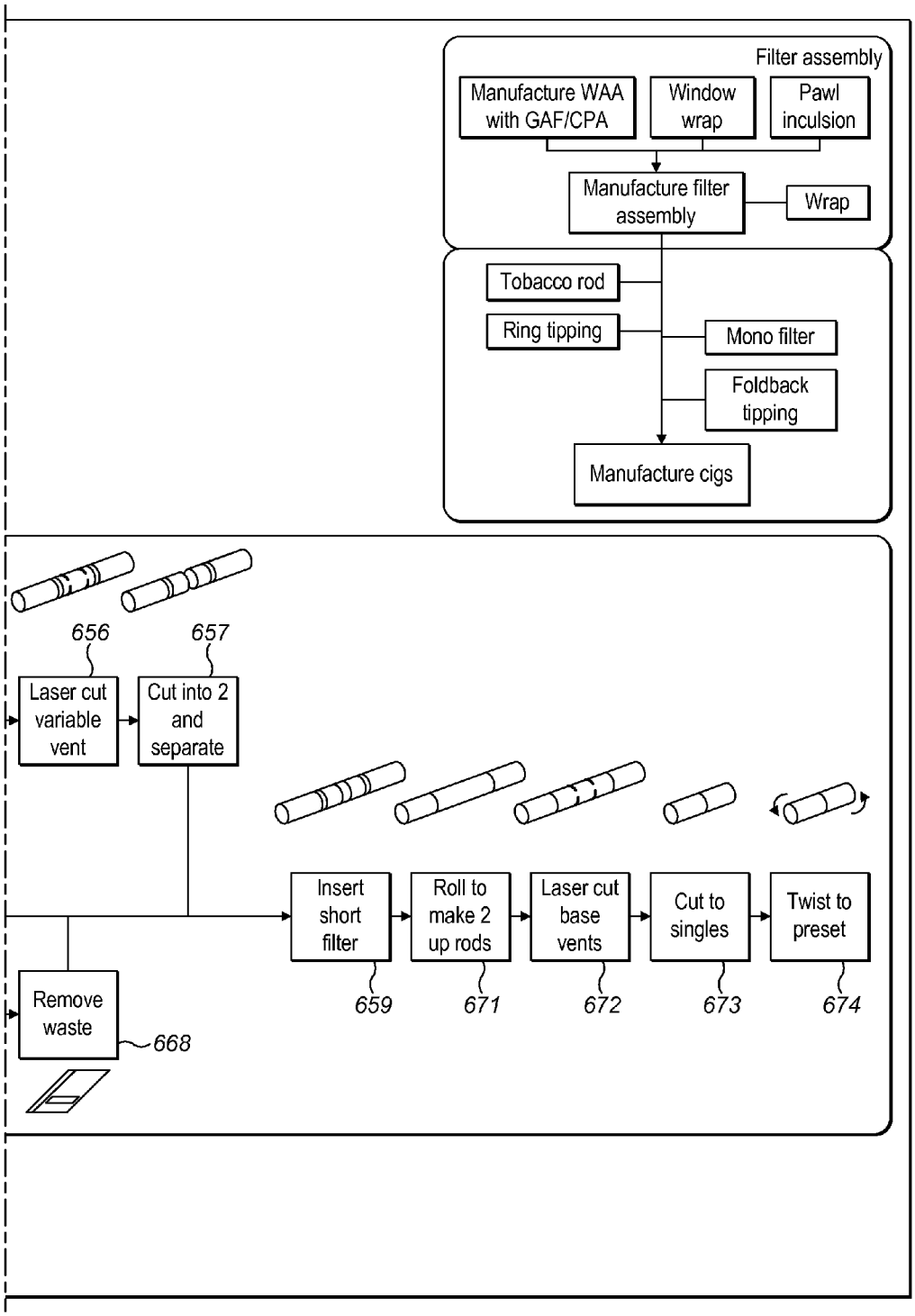

FIG. 21 is a perspective view of parts for smoking articles according to FIG. 4 during manufacture, and having a first type of collar;

FIG. 22 is a side elevation view of a part of a smoking article according to FIG. 4 during manufacture, and having a second type of collar;

FIG. 23 is a perspective view of parts for smoking articles according to FIG. 4 during manufacture, and having a second type of collar;

FIG. 24 is a side elevation view of a smoking article according to FIG. 4 during manufacture, and having a third type of collar;

FIG. 25 is a side elevation view of a smoking article according to FIG. 4 during manufacture, and having a third type of collar;

FIGS. 26*a*,26*b* and 26*c* are side elevation views of a part of a smoking article according to FIG. 4 during manufacture, and having a fourth type of collar;

FIG. 27 is a perspective view of a part of a smoking article according to FIG. 4 during manufacture, and having a fourth type of collar;

FIG. 28 is a cut-away side elevation view of a smoking article according to FIG. 4, and having a fifth type of collar;

FIG. 29 is an exploded perspective view of a smoking article in a partially formed state of a yet further embodiment of the present invention;

FIG. 30 is a perspective view of a smoking article with a first embodiment of an indexing mechanism of the second family;

FIG. 31 is a perspective view of a part of the smoking article with the first embodiment of the indexing mechanism of the second family;

FIG. 32 is a perspective view of a smoking article with a second embodiment of an indexing mechanism of the second family;

FIG. 33 is a perspective view of a smoking article with an indexing mechanism of a third family;

FIG. 34 is a front elevation view of a part of the smoking article with the indexing mechanism of the third family;

FIG. 35 is a perspective view of parts of a smoking article with an indexing mechanism of a fourth family;

FIG. 36 is a perspective view of a smoking article with an indexing mechanism of the fifth family;

FIG. 37*a* is a perspective view of the smoking article with the indexing mechanism of the fifth family in a partially formed state;

FIG. 37*b* is an enlarged perspective view of a part of the smoking article with the indexing mechanism of the fifth family;

FIG. 38 is a front elevation cross-section of a smoking article with a further embodiment of indexing mechanism related to the first family;

FIG. 39 is a perspective view of a part of the smoking article according to any embodiment of the first family;

FIG. 40 is a schematic side elevation view of a part of the smoking article according to any embodiment of the first family;

FIGS. 41*a* and 41*b* are side elevation view of a part of the smoking article according to any embodiment;

FIG. 42 is a perspective view of a partially formed smoking article according to any embodiment;

FIG. 43 is an exploded perspective view of a smoking article according to any embodiment of the first family;

FIG. 44 is a schematic flow diagram showing a first method of manufacturing a smoking article, and FIG. 45 is a schematic flow diagram showing a second method of manufacturing a smoking article.

Figure 1:
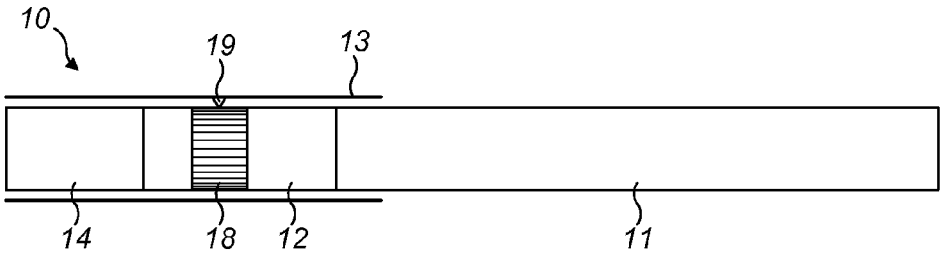
FIG. 1 is a side elevation view of a smoking article with an indexing mechanism according to a first family of the present invention.

FIG. 1 shows a smoking article according to some embodiments. The smoking article may be an article such as a cigarette, cigar or cigarillo, whether based on tobacco, tobacco derivatives, expanded tobacco, reconstituted tobacco or tobacco substitutes and also heat-not-burn products (i.e. products in which flavour is generated from a smoking material by the application of heat without causing combustion of the material). For convenience, these will be referred to as "smoking articles" in this specification. The smoking article to comprises a first part comprising a source of smokable material 11, which may be tobacco. The source of smokable material 11 is in the form of a tobacco rod, and in some aspects a attached first filter 12 is attached to the tobacco rod. The tobacco rod and first filter 12 are connected with a covering layer to affix the first filter to the tobacco rod, for example formed of tipping paper as is conventionally known. The tobacco rod and first filter may be referred to as a tobacco unit. The elongate tobacco rod and first filter define a longitudinal axis of the smoking article.

A second part of the smoking article comprises a sleeve 13 in the form of a cylindrical tube extending around the circumference of the tobacco rod 11 and/or first filter 12. The sleeve 13 may be formed as a tube, for example a cylinder, and in some aspects is formed of paper. The tobacco rod and first filter are dimensioned to rotate as a unit around a longitudinal axis within the sleeve 13. A restraining means (not shown) retains the first part and second part in a fixed longitudinal arrangement, and prevents extension of the smoking article. Thus, the first part cannot slide longitudinally relative to the second part, i.e. the sleeve is not movable longitudinally relative to the tobacco unit.

The second part may optionally further comprise a second filter 14 at a mouthpiece end of the sleeve 13, adjacent to, or connected with, the first filter 12. The second filter 14 is securely attached and fixed within the sleeve. The first and/or second filters are may be made of a conventional filtration material, e.g. cellulose acetate tow, wrapped in a sheet material, in particular paper, e.g. plugwrap.

The tobacco rod 11 and attached first filter 12 are described as connected by tipping paper (not shown). The tipping paper may be standard tipping paper, or a relatively thick recessed tipping paper, or a board type tipping paper. Alternatively, a tube formed of any material may attach the filter material to the source of smokable material. In particular, such a tube may be made of a plastics material, for example, a plastic made from corn starch. Alternatively, the tube may be made from a ceramic material. Alternatively, the tube may be formed from foil, metal or metallised paper.

The smoking article is provided with a ventilation system (not shown) configured to allow adjustment of a ventilation of the smoking article. The ventilation system comprises one or more ventilation areas, comprising ventilation apertures or air permeable material, in one or each of the first part and second part. In some aspects, when ventilation apertures in the sleeve and layers of sheet material around the first and/or second filter are aligned, air can flow into the body of the first and/or second filter. The ventilation is selected by selecting a position of the second part relative to the first part, which is controlled by a control mechanism. The control mechanism may provide an audible sound indicating movement to or from the selected position.

The control mechanism is in the form of an indexing mechanism, configured to control rotation between the sleeve 13 and tobacco unit 11,12. The indexing mechanism comprises a first indexing section (or surface) 18 on the tobacco unit which is engaged with a second indexing section (or surface) 19 on the sleeve 13. The tobacco unit 11,12 comprises the first indexing section 18 at its rearward end, for example around the first filter 12, and surrounded by the sleeve 13.

The sleeve 13 is rotatable relative to the tobacco unit 11 into a plurality of pre-determined indexed rotational positions. The indexed positions are narrowly spaced, providing for incremental step-wise movement. The indexing mechanism of the present invention provides an angle of rotation which may be finely controlled and maintained. The indexing mechanism provides a large number of indexed positions, at least three, or at least five or seven within a limited range of rotation, e.g. 90 or 120 degrees.

In a first family of embodiments, the first indexing section 18 may have a plurality of depressions which are engageable by a protruding feature on the second indexing section. In some aspects, the depressions may form a corrugated exterior surface. In particular, the first indexing section 18 has an outer surface which is not smooth, and in some examples comprise a plurality of depressions separated by ridges. For example, the depressions can be elongate grooves, separated by ridges, which extend substantially longitudinally. In some aspects, the elongate grooves are formed in an exterior of a filter section, and optionally, extend the whole length of the filter section. The smoking article comprises one or more filter sections, of which one or more filter sections comprises depressions as described. The plurality of ridges and grooves may define a sinuous outer surface, which smoothly oscillates in radius, i.e. is not stepped. The ridge between adjacent depressions may have a curved profile with a substantially uniform radius of curvature. The ridge between adjacent depressions defines a single circumferential point of maximum resistance to movement of the engaging feature between the adjacent depressions. Alternatively, the grooves may be formed as flutes, having a concave profile. The ridge between adjacent depressions may have a pointed, creased, or tapering profile, optionally having a substantially sharp point of maximum radius. The ridge between adjacent depressions defines a single circumferential point of maximum resistance to movement of the engaging feature between the adjacent depressions. In some examples, the ridge is resiliently deformable to allow movement of the pawl over the ridge.

In further examples, the extent of a ridge in a direction of indexing movement is shorter than an extent of an adjacent depression. In particular, the extent of a ridge in a circumferential direction is shorter than a circumferential extent of an adjacent depression. In some examples, the ridge can have a substantially flat area at a maximum circumferential extent, i.e. at the tip of the ridge. The flat area at the tip extends substantially circumferentially. The flat area at the tip has a circumferential extent shorter than a circumferential extent of an adjacent depression. In some aspects, the substantially flat area has an extent which is relatively short such that the ridge provides a substantially single point of maximum resistance to movement of the second indexing surface. In a further aspect, one or more sides of the ridges extend at an angle to a radial direction. In particular, for a longitudinally extending ridge, longitudinally extending sides of the ridge are sloped or angled at an angle to a radial direction.

This shape provides for a loud sound when the first and second parts are rotated relative to each other, providing clear audible feedback that the ventilation has been changed.

The first indexing section may be formed on any exterior surface of the first part of the smoking article. In particular, the first indexing section 18 may be formed on a tubular indexing member surrounding the first filter 12. The tubular indexing member surrounding the filter is separate to the filtration material and plugwrap forming the filter, and may optionally connect the filter to the tobacco rod. The tubular indexing member defining the first indexing section 18 may be a cylinder of cellulose acetate film or paper sleeve having depressions and/or protrusions as described above, and may be attached to the filter by an adhesive. The features of the first indexing section are formed when the indexing member is a blank prior to forming a tube, and prior to attachment of the indexing member to the filter, filtration material and/or tobacco rod. References to "film" throughout the specification should be interpreted broadly, to mean any type of layer, sheet material or material dimensions. Alternatively, the tube may be any material described.

The indexing grooves and ridges may extend around the whole circumference of the tobacco unit, or alternatively, extend around only a part of the circumference of the tobacco unit. The indexing grooves and ridges may extend over the whole length or only a part of the length of the indexing member.

Alternatively, the first indexing section 18 is formed in a radially facing curved exterior surface of the filter. The filter having an exterior surface with the indexing section comprises filtration material, for example formed in a cylinder extending longitudinally. The filtration material is any known filtration material, and in particular, is formed of cellulose acetate tow. The filtration material is wrapped in one or more sheets of flexible material. In some aspects, the sheet material is paper or a plastics material or polymer, a polysaccharide e.g. cellulose acetate, polypropylene or polyethylene (PE), cellulose; regenerated cellulose or, any plastics material or polymer not including cellulose acetate, and/or polypropylene and/or polyethylene (PE) and/or ink and/or glue, and may be known as plugwrap. For example, the first indexing surface comprises a polymer material not including cellulose acetate and/or polypropylene. The sheet material extends around the curved sides of the cylinder of filtration material. The sheet material forms, or supports, a continuous outer surface defining the grooves and ridges of the first indexing section. The sheet material is deformed to form the grooves and ridges, and treated such that the shape of the grooves and ridges are permanently maintained in the sheet material. The sheet material is shaped to define grooves and ridges before it is wrapped around the filtration material. The sheet material plugwrap is not cut to define the grooves. The sheet material may be deformed by embossing, extrusion, crimping or applying any form of pressure, in particular using rollers. The sheet material may be heated during formation of the depressions.

The sheet material wrapping the filtration material is optionally overwrapped by a film. The film provides a continuous exterior surface defining the plurality of grooves. The film can be a plastics material, in particular a polymer, for example, polypropylene or polyethylene (PE). The film may be transparent, or may be opaque. The plastics or polymer film provides an exterior surface which may be more rigid or hard than the grooves and ridges formed in the supporting paper alone. The film inhibits the grooves and ridges being smoothed out by contact with the engaging part of the indexing mechanism during rotation. The film is applied to grooves and ridges which have already been formed in the paper plugwrap. Alternatively, the film may be a laminate layer, for example including a non-paper material such as cellulose (regenerated cellulose) or cellulose acetate.

In some examples, the non-paper material is bonded to a paper and then has the grooves applied.

Alternatively, the first indexing surface comprises a relatively rigid or relatively hard material wrapped directly around the filtration material, i.e. without a paper layer. The relatively rigid or hard material can be any material described, for example, a plastics material, bioplastics material, polymer material, e.g. cellulose acetate, cellulose film, regenerated cellulose film, polysaccharide, or a plastics material not including cellulose acetate, and/or not including cellulose and/or not including polypropylene and/or not including ink or glue, or a polymer not including cellulose acetate, not including cellulose and/or not including polypropylene and/or not including ink or glue and/or not including paper.

The sheet material of any embodiment can be any of the mentioned materials not including any other group(s) of materials, e.g. regenerated cellulose not including cellulose acetate or a polysaccharide not including cellulose acetate. The relatively rigid material is more rigid than a conventional paper plugwrap, and/or provides a harder surface than a conventional paper plugwrap wrapped filter. The relatively rigid material is in the form of a sheet of material, optionally wrapped directly around the filtration material. The rigid sheet material defines the first indexing surface. The predetermined high rigidity of the exterior surface provides for a large volume of sound, as the indexing mechanism is moved from one index position to the next.

The sleeve 13 comprises a second indexing section 19. The second indexing section 19 is located on the interior of the sleeve 13, and has one or more features engageable with the first indexing section 18. The second indexing section 19 has one or more protrusions which are engageable with the first indexing section 18. The one or more protrusions have a shape which provides for a loud sound when the first and second parts are rotated relative to each other, providing clear audible feedback that the ventilation has been changed. In a first family of embodiments, the protrusion(s) may comprise one or more pawls, formed by one or more layers of sheet material which are folded to extend radially inwardly from the sleeve 13. The term "pawl" is intended to mean any type of protrusion which can engage with an indexing section to allow indexed movement in two directions. The movement of the first part relative to the second part is may be rotational, such that the indexing mechanism allows indexed clockwise and anti-clockwise rotation. Alternatively, the movement is longitudinal, such that the indexing mechanism allows indexed forward and rearward sliding axial movement.

Rotation of the sleeve 13 is accompanied with a sound, e.g. a click, at each pre-determined position. The sound may be generally audible. The indexing mechanism functions to resist rotation between the first and second parts of the smoking article, unless sufficient force is applied and the parts rotate to the next indexed position. The indexing mechanism provides feedback to a user that the first and second parts have been rotated, for example in the form of touch in the indexing movement and/or sound as each indexing position is engaged. The first and/or second indexing sections 18,19 or separate limiting mechanism may limit rotation to a range of between 90° and 180°, and in particular to a range of approximately 90° to 120°. Alternatively, the indexing mechanism does not limit rotation to a predefined range of rotation.

The sleeve 13 may be restrained from moving forwardly over the tobacco unit. The second indexing section 19 is configured to engage with a part of the tobacco unit. The ridges of the second indexing section 19 extend over only a part of the length of the sleeve and a forward edge engages with a part of the tobacco unit which has a radius greater than the grooves of the first indexing section 18. In particular, the forward edge of second indexing section 19 engages with a part of the tobacco unit which is not grooved, forwardly of the first indexing section 18, and has a radius greater than the protrusion(s) of the second indexing section 19.

The smoking article to is described as having a first filter 12 attached to the tobacco rod, and a second filter 14 attached to the sleeve 13. Alternatively, the smoking article may comprise only a first filter attached to the tobacco rod, such that the sleeve does not have an attached filter. Alternatively, the smoking article may comprise only a second filter attached to the sleeve, such that the tobacco unit does not comprise a filter.

Embodiments of a first family of control mechanism will now be described, with reference to FIGS. 2 to 10. The structure of the smoking article is as described above, unless described as different.

Figure 2:
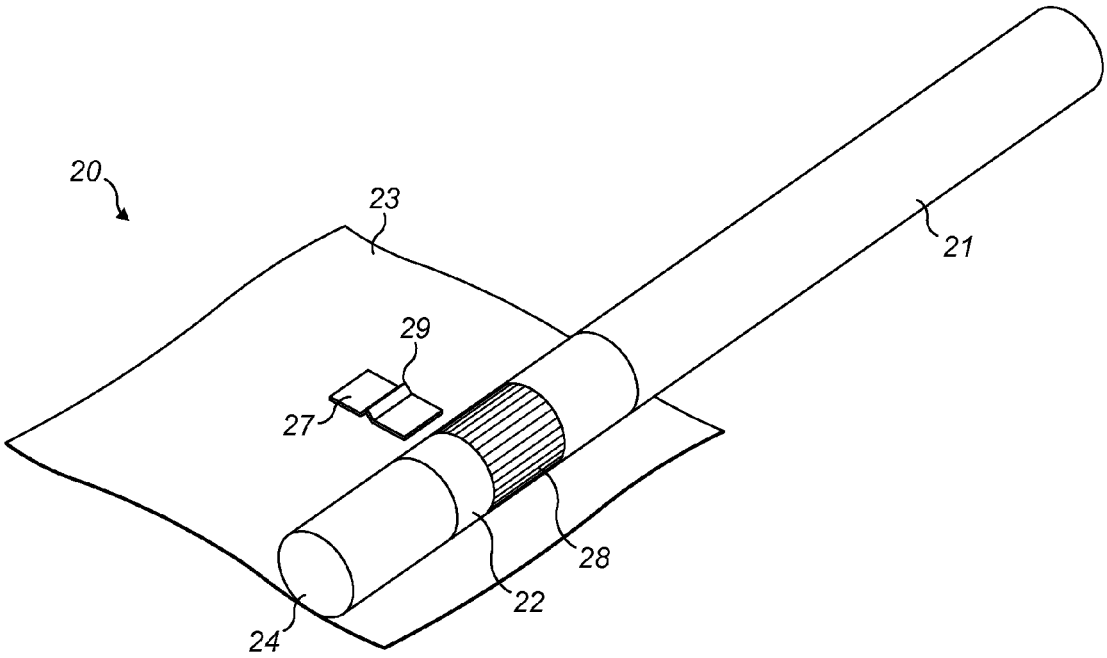
FIG. 2 is a perspective view of a partially formed smoking article with a first embodiment of an indexing mechanism of the first family.

FIG. 2 shows a smoking article 20 having a first embodiment of indexing mechanism of the first family. The smoking article 20 comprises a tobacco rod 21, first filter 22 and second filter 24, arranged as described above. A sleeve blank 23 is shown before forming into a cylindrical sleeve, as described above.

The first indexing section 28 is the same as the first indexing section 18 described above. The second indexing mechanism comprises a pawl 29 engageable with the first indexing section 28 to form an indexing mechanism. The pawl 29 is formed on a pawl unit 27, formed by a strip of sheet material, which is described in more detail below. The sheet material 27 is formed such that a ridge having a substantially triangular cross-section protrudes from the sleeve 23. The upstanding ridge defines an edged peak. The protruding ridge extends over the whole width, i.e. longitudinal extent, of the strip of sheet material 27, which is arranged such that the pawl extends longitudinally, parallel to the ridges of the first indexing section 28 with which the pawl engages. The pawl is formed by folding or creasing, for example, in a die. The pawl is configured to provide a substantially single point of maximum resistance in the direction of movement between indexing positions. As such, the pawl is configured to move rapidly to the next indexing position once the maximum resistance is overcome. The pawl defines an engaging edge (i.e. edged peak) configured to index with the first engaging surface. The engaging (contacting) edge is elongate and extends in a direction substantially perpendicularly to a direction of indexing movement. For example, the term "elongate" can mean that the ridge (or groove) extends perpendicularly to a direction of indexing movement, e.g. longitudinally, at least two times or at least three times longer than a pitch of the ridges (or grooves), i.e. spacing between adjacent ridges or grooves. The elongate contacting edge is configured to engage with an elongate ridge of the first indexing surface during movement between indexing positions. For example, the term "elongate" can mean that the elongate edge of the pawl extends perpendicularly to a direction of indexing movement, e.g. longitudinally, at least 1.5 times, or at least two times or at least three times longer than a pitch of the ridges (or grooves). Alternatively, the elongate edge of the pawl extends perpendicularly to a direction of indexing movement at least 1.5 times, at least two times or at least three times longer than a width of the pawl in the direction of indexing movement.

In some aspects, the edge is formed at a connection between the first and second upstanding sections. The edge can be a fold or crease in the material forming the first and second upstanding sections, for example, a sheet material. The fold or crease defines a distal point or tip of the pawl subtending an acute angle, e.g. an angle less than 90 degrees or less than 40 degrees, or less than 30 degrees. The edged peak can be considered as sharp, as opposed to a semi-circular profile pawl. In particular, the pawl defines one or more corners. In some aspects, the triangular pawl comprises three corners (defined by creases or folds) in the material. In some examples, the pawl comprises one or more generally planar or laminar sections. A sheet material is an example of material for forming the pawl. Alternatively, the pawl of any embodiment is not formed by a sheet material. The pawl can be formed as a three-dimensional object, e.g. by moulding. The pawl comprises one or more generally planar sections, i.e. sections extending substantially in a plane. In a further aspect, the pawl comprises one or more sections of laminar material, i.e. material having a substantially uniform thickness. The laminar material can extend in a plane or with a curve. The planar or laminar sections extend at least partially radially to engage the first indexing surface. In some examples, the pawl has a substantially uniform cross-section in a direction perpendicular to an indexing movement direction. In particular, the pawl has a uniform cross-section in a longitudinal direction when rotation is indexed. In some examples, the cross-section of the pawl (e.g. triangular cross section) defines an open space within the exterior surface. Alternatively, the pawl, e.g. with triangular cross-section, is defined by a solid volume of material.

The pawl, and/or one or more sections defining the pawl, are elongate in a radial direction. In particular, the radial extent of the pawl and/or one or more sections is greater than the circumferential extent. For example, the pawl and/or one or more sections is more than 1.2, 1.5, 1.7 or 2 times greater in a radial extent than in a circumferential. In a further aspect, the pawl and/or one or more sections defining the pawl, are elongate in a direction perpendicular to direction of movement, i.e. in a longitudinal direction for rotational movement. In particular, the extent of the pawl and/or one or more sections in this direction is greater than the circumferential extent. The radial and longitudinal extent of the pawl defines a substantially laminar surface and/or laminar surface which is substantially planar. Alternatively, the one or more sections of the pawl are curved or angled in a radial direction.

The strip of sheet material 27 is affixed to the sleeve 23, for example by adhesive, and in some aspects, at each side of the ridge to maintain the triangular cross-section of the pawl. The strip of sheet material 27 extends laterally over a length which is less than the width (circumference) of the sleeve 23. The width, i.e. longitudinal extent, of the strip of sheet material 27 is less than the longitudinal length of the sleeve 23. The width of the ridge is approximately the same, or slightly less than, the width of the first indexing section 28.

The second indexing section is formed by folding sheet material from a reel to form pawls at spaced apart intervals, cutting the sheet material into strips 27 each having a pawl, and affixing one strip of sheet material 27 to a sleeve blank. One or more rollers may be used to place the strip 27 onto the sleeve 23. The sleeve blank 23 is then formed into a cylindrical tube around the second filter 24. Alternatively, blank strips 27 may be cut prior to a pawl being formed in each one.

Figure 3:
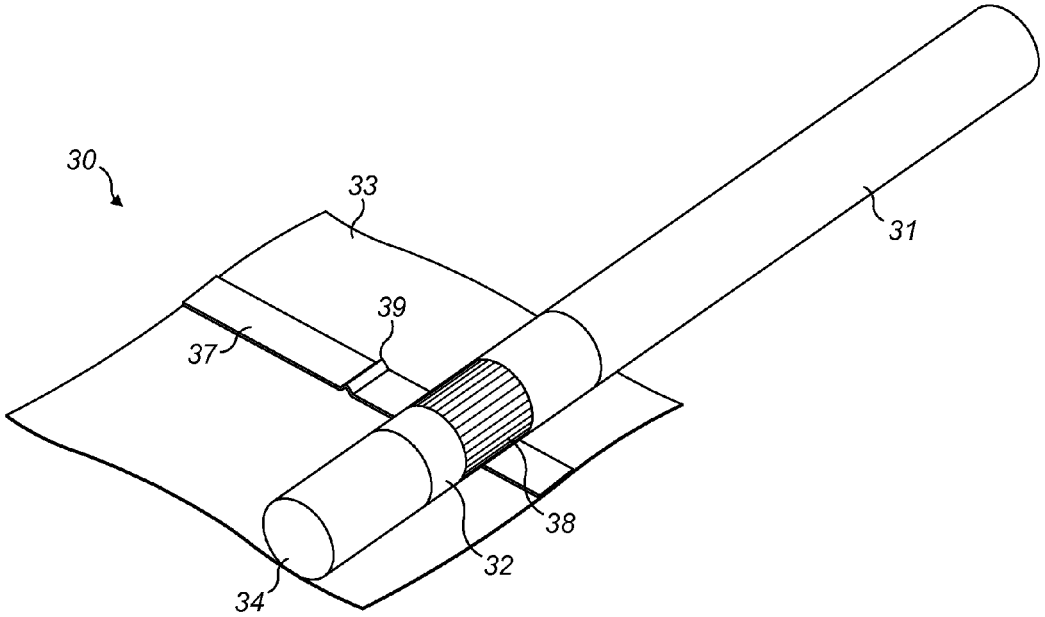
FIG. 3 is a perspective view of a partially formed smoking article with a second embodiment of an indexing mechanism of the first family.

FIG. 3 shows a smoking article 30 having a second embodiment of indexing mechanism of the first family. The smoking article 30 comprises a tobacco rod 31, first filter 32 and second filter 34, arranged as described above. A sleeve blank 33 is shown before forming into a cylindrical sleeve, as described above.

The first indexing section 38 is the same as the first indexing section 18 described above. The second indexing mechanism comprises a pawl 39 engageable with the first indexing section 38 to form an indexing mechanism. The pawl 39 is formed on a pawl unit 37, which is formed by a strip of sheet material, which is described in more detail below. The sheet material 37 is folded or creased such that a ridge having a substantially triangular cross-section protrudes from the sleeve 33. The protruding ridge extends over the whole width, i.e. longitudinal extent, of the strip of sheet material 37, which is arranged such that the pawl extends longitudinally, parallel to the ridges of the first indexing section 38 with which the pawl engages. In some embodiments, the pawl unit 37 is shorter than the sleeve blank 33, such that the sleeve blank 33 can form a lap seam in order to secure the blank 33 as a cylindrical sleeve without the pawl unit 37.

The strip of sheet material 37 is laminated to the sleeve 33, for example by adhesive along the whole area of the strip 37 except for at the ridge. The strip of sheet material 37 extends laterally over the whole width (circumference) of the sleeve 33. The width, i.e. longitudinal extent, of the strip of sheet material 37 is less than the longitudinal length of the sleeve 33. The longitudinal extent of the pawl is approximately the same, or slightly less than, the longitudinal extent of the first indexing section 38.

The second indexing section is formed by folding sheet material from a reel to form pawls at spaced apart intervals, cutting the sheet material into strips 37 each having a pawl, and laminating (affixing) one strip of sheet material 37 with the formed pawl 39 to a sleeve blank. One or more rollers may be used to place the strip 37 onto the sleeve 33. The sleeve blank 33 is then formed into a cylindrical tube around the second filter 34. Alternatively, blank strips 37 may be cut prior to a pawl being formed in each one.

FIG. 4 shows a smoking article 40 having a third embodiment of indexing mechanism of the first family. The smoking article 40 comprises a tobacco rod 41, first filter 42 and second filter 44, arranged as described above. A sleeve blank 43 is shown before forming into a cylindrical sleeve, as described above.

The first indexing section 48 is the same as the first indexing section 18 described above. The second indexing mechanism comprises a pawl (not shown) engageable with the first indexing section 48 to form an indexing mechanism. The pawl is formed on a collar or pawl unit 47, which is described in more detail below, and with reference to FIGS. 20*a* to 29. The collar 47 is a cylindrical tube having a pawl protruding radially inwardly. The collar 47 is pre-assembled on the first indexing section 48, prior to the sleeve 43 being rolled into a cylindrical tube around the collar. The material for the collar is folded or creased such that a pawl in the form of a ridge having a substantially triangular cross-section protrudes inwardly from the collar 43. Alternatively, a pawl may be formed by folding both of the opposing longitudinal edges of the sleeve blank inwardly, and joining the facing surface with a lap joint. A pawl of this type is shown in FIG. 10.

Alternatively, any type of pawl may be formed on the interior surface of the collar 47. The protruding pawl extends over the whole width, i.e. longitudinal extent, of the strip of the collar 47, which is arranged such that the pawl extends longitudinally, parallel to the ridges of the first indexing section 48 with which the pawl engages. The collar 47 is affixed to the sleeve 43, for example by adhesive over part or the whole of the circumference of the collar 47, and in some aspects, not at the position of the pawl. The width of the collar 47 is less than the longitudinal length of the sleeve 43. The longitudinal extent of the pawl is approximately the same, or slightly less than, the longitudinal extent of the first indexing section 48.

The pawl is formed in a blank for the collar 47, and the collar 47 is formed and wrapped around the first indexing section 48, for example as described with respect to FIGS. 20*a* to 29. The collar 47 is pre-assembled on the second indexing section 48 prior to the sleeve 43 being attached. The sleeve blank 43 is then formed into a cylindrical tube around the second filter 24 and collar 47, and affixed to the second filter 24 and collar 47.

Figure 5:
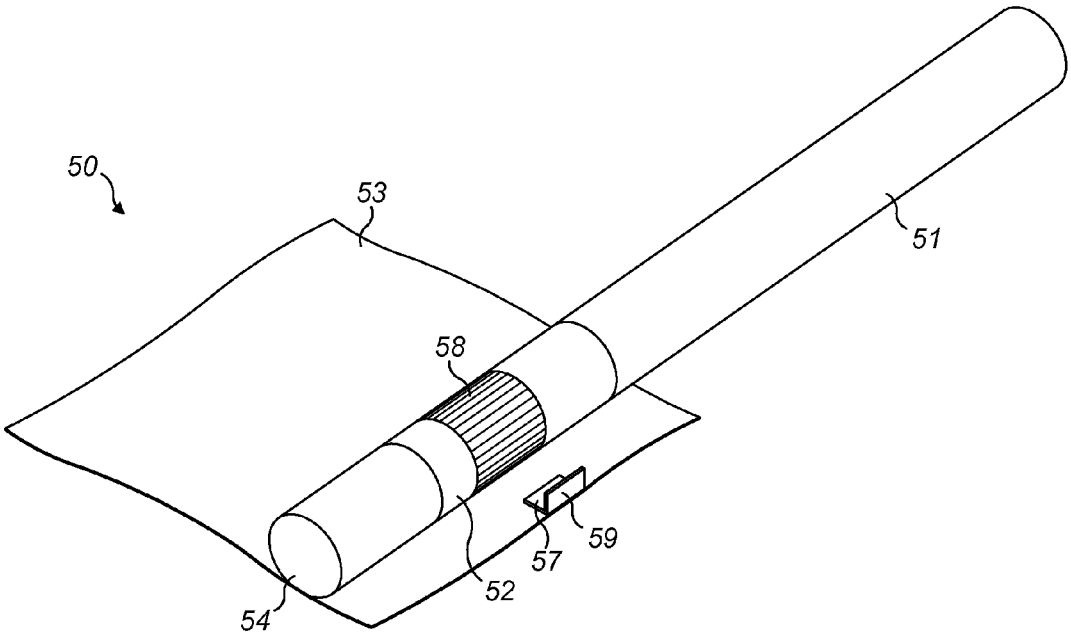
FIG. 5 is a perspective view of a partially formed smoking article with a fourth embodiment of an indexing mechanism of the first family.

FIG. 5 shows a smoking article 50 having a fourth embodiment of indexing mechanism of the first family. The smoking article 50 comprises a tobacco rod 51, first filter 52 and second filter 54, arranged as described above. A sleeve blank 53 is shown before forming into a cylindrical sleeve, as described above.

The first indexing section 58 is the same as the first indexing section 18 described above. The second indexing mechanism comprises a pawl 59 engageable with the first indexing section 58 to form an indexing mechanism. The pawl 59 is formed on a pawl unit 57, formed by a strip of sheet material 57, which is described in more detail below. The sheet material 57 is folded or creased such that the pawl is formed by an end of the strip 57 protruding from the sleeve 53. The protruding end of the strip 57 defines a tab, which may extend at approximately perpendicularly to the material of the sleeve 53. The pawl 57 is a single layer of the strip of sheet material 57. The protruding ridge extends over the whole width, i.e. longitudinal extent, of the strip of sheet material 57, which is arranged such that the pawl extends longitudinally, parallel to the ridges of the first indexing section 58 with which the pawl engages.

The strip of sheet material 57 is affixed to the sleeve 53, for example by adhesive, at one side of the upstanding tab. The strip of sheet material 57 extends laterally over a length which is less than the width (circumference) of the sleeve 53. The width, i.e. longitudinal extent, of the strip of sheet material 57 is less than the longitudinal length of the sleeve 53. The width of the ridge is approximately the same, or slightly less than, the width of the first indexing section 58.

The second indexing section is formed by folding sheet material from a reel to form pawls at spaced apart intervals, cutting the sheet material into strips 57 each having a pawl, and affixing one strip of sheet material 57 to a sleeve blank. One or more rollers may be used to place the strip 57 onto the sleeve 53. The sleeve blank 53 is then formed into a cylindrical tube around the second filter 54. Alternatively, blank strips 57 may be cut prior to a pawl being formed in each one.

Figure 6:
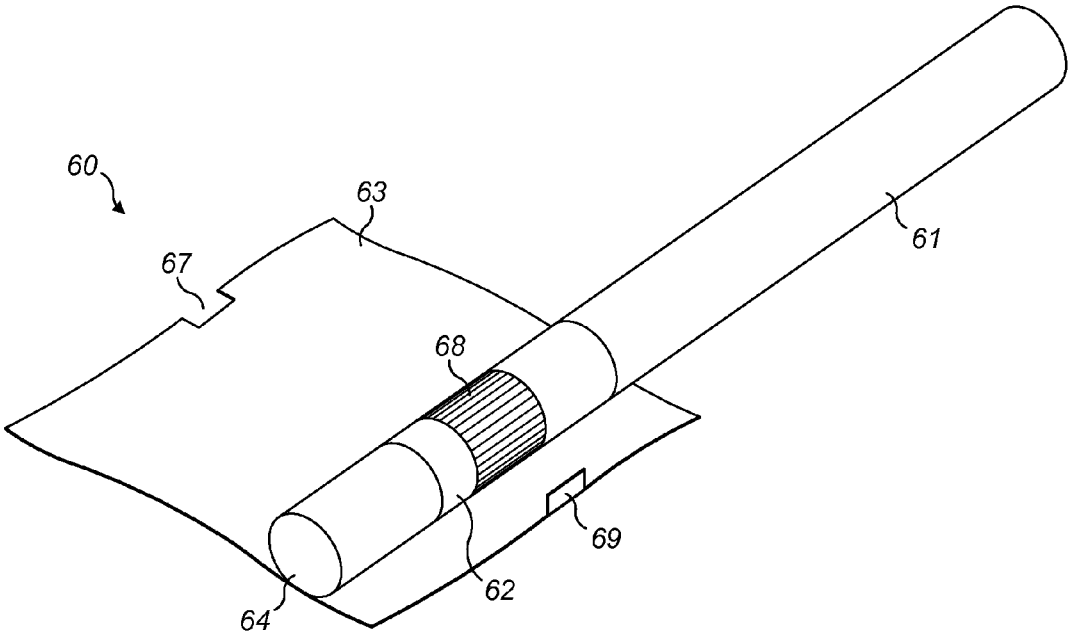
FIG. 6 is a perspective view of a partially formed smoking article with a fifth embodiment of an indexing mechanism of the first family.

FIG. 6 shows a smoking article 60 having a fifth embodiment of indexing mechanism of the first family. The smoking article 60 comprises a tobacco rod 61, first filter 62 and second filter 64, arranged as described above. A sleeve blank 63 is shown before forming into a cylindrical sleeve, as described above.

The first indexing section 68 is the same as the first indexing section 18 described above. The second indexing mechanism comprises a pawl 69 engageable with the first indexing section 68 to form an indexing mechanism. The pawl 69 is formed by the material of the sleeve 63, which is described in more detail below. For example, the material of the sleeve may be a laminate.

The sleeve blank 63 has a protruding tab which is folded or creased such that the pawl is formed by the upstanding protruding tab. The pawl 69 may extend approximately perpendicularly to the adjacent material of the sleeve 63. The pawl 69 is integrally formed with the sleeve 63. The pawl is a single layer of the sheet material forming the sleeve 63. The protruding tab and fold is arranged such that the pawl extends longitudinally, parallel to the ridges of the first indexing section 68 with which the pawl engages.

The sleeve blank 63 comprises a cut-out 67. The cut-out 67 is located on an opposite edge of the sleeve blank 63 to the pawl 69, and has the same dimensions as the pawl 69. The sleeve blank 63 is substantially rectangular, and further comprising the matching protruding tab 69 and cut-out 67. The sleeve blank 63 is cut from a strip of sheet material, and the material of the cut-out 67 forms a tab 69 on a consecutive sleeve blank 63.

The longitudinal extent of the pawl 69 is less than the longitudinal length of the sleeve 63, and the pawl 69 is located between a forward end and rearward end of the sleeve 63. The longitudinal extent of the pawl 69 is approximately the same, or slightly less than, the longitudinal extent of the first indexing section 68.

The sleeve blank 63 is formed by cutting a shaped blank. The second indexing section is formed by folding the blank to form a pawl. The sleeve blank 63 is then formed into a cylindrical tube around the second filter 64, with the pawl extending radially inwardly and engaging with the first indexing section.

The pawl 69 has been described as located between the longitudinal ends of the sleeve. Alternatively, the pawl 69 may extend to a longitudinal end of the sleeve, and may alternatively extend to both longitudinal ends of the sleeve, and so extend over the whole length of the sleeve. Alternatively or in addition, the sleeve blank 63 may not comprise the cut-out 67.

FIGS. 7*a* and 7*b* show a smoking article 70 having a sixth embodiment of indexing mechanism of the first family. The smoking article 70 comprises a tobacco rod 71, first filter 72 and second filter 74, arranged as described above. A sleeve blank 73 is shown before forming into a cylindrical sleeve, as described above.

The first indexing section 78 is the same as the first indexing section 18 described above. The second indexing mechanism comprises a pawl 79 engageable with the first indexing section 78 to form an indexing mechanism. The pawl 79 is formed by the material of the sleeve 73, which is described in more detail below.

An overlapping or folded section 77 forms an overlap section on the substrate. The overlap is doubled-back section, i.e. folded back on itself, and may be formed by folds. A pawl is formed by a part only of the overlap section, which is configured to be upstanding. The overlap section optionally extends over substantially the whole width of the sleeve 73, which is arranged such that the overlap section extends longitudinally, parallel to the ridges of the first indexing section 78 with which the pawl engages. The sleeve 73 is cut perpendicularly to the overlap section at cut lines 76*a*,76*b*, before the sleeve is folded or after the sleeve is folded. The two cut lines 76*a*,76*b* are parallel cuts in the overlap section 77 to define the pawl, the cuts extending between the folds forming the overlap section. The pawl extends from the plane of the substrate in an upstanding orientation. In some embodiments, the overlap section 77 at each side of the pawl 79 are folded down against the adjacent part of the sleeve 73. The pawl is retained in an upstanding orientation.

The sleeve blank 73 has an upstanding pawl 79, which may extend approximately perpendicularly to the adjacent material of the sleeve 73. The pawl 79 is integrally formed with the sleeve 73. The pawl is a double layer of the sheet material forming the sleeve 73. The protruding tab and fold is arranged such that the pawl extends longitudinally, parallel to the ridges of the first indexing section 78 with which the pawl engages.

The longitudinal extent of the pawl 79 is less than the longitudinal length of the sleeve 73, and the pawl 79 is located between a forward end and rearward end of the sleeve 73. The longitudinal extent of the pawl 79 is approximately the same, or slightly less than, the longitudinal extent of the first indexing section 78.

FIG. 7*b* shows the overlap section 77 in more detail, which comprises a first layer 77*a* and a second layer 77*b*. The upstanding ridge is formed by parallel folds 75*a*, 75*b* and a fold 75*c* at the apex of the ridge. The parallel cuts in the sleeve 73 extend between folds 75*a*,75*b*, i.e. over the whole extent of the folded sections 77*a*,77*b*. The second section 77*b* is folded back on an underside of the first section 77*a* of the sleeve blank 73 as shown, which will become an exterior of the sleeve. Alternatively, the second section 77*b* may overlie the first section 77*a*, and is folded back on a top side of the first section 77*a* (not shown), which will become an interior of the sleeve.

The pawl 79 extends upwardly from fold 75*a*, where it is integrally connected with the sleeve 73. The material of the pawl 79 may also be integrally connected to the sleeve 73 at fold 75*b*. Alternatively, as shown in FIG. 7*b*, a further cut is made along fold 75*b* over the longitudinal extent of the pawl 79. The pawl 79 is only connected to the sleeve 73 along fold 75*a*.

The same configuration of pawl 79 is alternatively formed in a different manner. The sleeve 73 is folded back on itself to form an overlap section 77, by folding along folds 75*b* and 75*c*, but not fold 75*a*. Two parallel cuts 76*a*,76*b* are made to the folded sections 77*a*,77*b* to define the pawl, before the sleeve is folded or after the sleeve is folded. The pawl 79 is folded into an upstanding orientation along fold 75*a*, and the overlap section 77 at each side of the pawl 79 is retained against the adjacent part of the sleeve 73.

The sleeve blank 73 is cut substantially in the form of a rectangle. The cuts defining the pawl 79 are then made in the sleeve blank. The second indexing section are formed by folding the sleeve blank to form a pawl 79, as above, with the remaining parts of the overlap section 77 urged or retained flat against the surrounding sleeve. The sleeve blank 73 is then formed into a cylindrical tube around the second filter 74, with the pawl extending radially inwardly and engaging with the first indexing section.

FIG. 8*a* shows a smoking article 80 having a seventh embodiment of indexing mechanism of the first family. The smoking article 80 comprises a tobacco rod 81, first filter 82 and second filter 84, arranged as described above. A sleeve blank 83 is shown before forming into a cylindrical sleeve, as described above.

The first indexing section 88 is the same as the first indexing section 18 described above. The second indexing mechanism comprises one or more pawls engageable with the first indexing section 88 to form an indexing mechanism. The pawls 89*a*,89*b* are integrally formed with the material of the sleeve 83, which is described in more detail below.

The sleeve blank 83 is cut at one or more locations to define the one or more pawls. In some aspects, the sleeve comprises two circumferentially spaced pawls, first pawl 89*a* and second pawl 89*b*.

The first pawl 89*a* is defined by a cut line 86*a* in the sleeve blank 83. The cut line 86*a* defines a tab in the sleeve blank, which remains connected to the remainder of the blank by a single fold line 87*a*. In some examples, the pawl 89*a* is substantially rectangular, and the cut line 86*a* extends over three sides of the material for the rectangular pawl 89*a*. The further side of the rectangular pawl is defined by the fold line 87*a*. An edge of the pawl 89*a* opposite to the fold line 87*a* is configured to engage with the first indexing section, and may be straight and extends longitudinally. The tab is folded along fold line 87*a* such that the pawl is formed by the upstanding protruding tab.

The second pawl 89*b* is formed in the same manner, and substantially simultaneously, with the first pawl 89*a*. The second pawl 89*b* is defined by a cut line 86*b* in the sleeve blank 83. The cut line 86*b* defines a tab in the sleeve blank, which remains connected to the remainder of the blank by a single fold line 87*b*. In some examples, the pawl 89*b* is substantially rectangular, and the cut line 86*b* extends over three sides of the rectangular pawl 89*b*. The further side of the rectangular pawl is defined by the fold line 87*b*. An edge of the pawl 89*b* opposite to the fold line 87*b* is configured to engage with the first indexing section, and may be straight and extends longitudinally. The tab is folded along fold line 87*b* such that the pawl is formed by the upstanding protruding tab.

The pawls 89*a*, 89*b* have the same dimensions, and are aligned longitudinally with each other and the first indexing section. The pawls 89*a*,89*b* are folded upwardly in opposite directions, since the fold lines 87*a*,87*b* are on opposite sides of the pawls 89*a*,89*b*. The pawls may be configured to allow rotation in only a single direction, i.e. uni-directional movement.

The pawls 89*a*,89*b* may extend approximately perpendicularly to the adjacent material of the sleeve 83. The pawls 89*a*,89*b* are integrally formed with the sleeve 83. The pawls 89*a*,89*b* are each a single layer of the sheet material forming the sleeve 83. The pawls 89*a*,89*b* extend longitudinally, parallel to the ridges of the first indexing section 88 with which the pawls engage.

The longitudinal extent of the pawls 89*a*,89*b* is less than the longitudinal length of the sleeve 83, and the pawls 89*a*,89*b* are located between a forward end and rearward end of the sleeve 83. The longitudinal extent of the pawls 89*a*,89*b* is approximately the same, or slightly less than, the longitudinal extent of the first indexing section 88.

The sleeve blank 83 is formed, and cut lines 86*a*,86*b* are made in the blank. The second indexing section is formed by folding the tabs defined by cut lines 86*a*,86*b* to form one or more pawls 89*a*,89*b*. The sleeve blank 83 is then formed into a cylindrical tube around the second filter 84, with the pawls extending radially inwardly and engaging with the first indexing section.

FIG. 8*b* shows a sleeve blank 83', which may be incorporated in a smoking article 80 in place of the sleeve blank 83 described above. The sleeve blank 83' has a single pawl 89*a*, defined by cut line 86*a*. The pawl 89*a* and cut line 86*a* are formed and configured as described with respect to the sleeve blank 83 above. The single pawl 89*a* of sleeve blank 83' is configured to engage in a fluted second indexing section, as described above. The sleeve blank 83' may form the whole sleeve, or may only be a strip affixed to an interior surface of a sleeve. An adhesive may affix the strip onto a sleeve. The blank 83' may be formed of a cellulose acetate film, or alternatively, paper. The paper may have a stiffening agent applied, for example, PVA glue.

FIG. 8*c* shows a second variation of the sleeve blank 83", similar to the sleeve blank 83 shown in FIG. 8*a*. Sleeve blank 83" comprises a plurality of pawls configured to engage with the first indexing section. The sleeve blank 83" comprises a plurality of pawls which are circumferentially aligned. In some examples, at least one pawl is folded out from the sleeve in a direction opposite to at least one other of the circumferentially aligned pawls. In some aspects, a plurality of pawls are circumferentially spaced apart on the sleeve 83". Therefore, the sleeve blank 83" comprises a plurality of pawls which are longitudinally spaced and circumferentially spaced, and in some examples, the longitudinally spaced pawls are arranged in opposite orientations. Alternatively, the circumferentially spaced pawls are arranged in opposite orientations.

FIG. 8*c* shows three pawls 89*c*,89*d*,89*e* which are circumferentially aligned and arranged in a first longitudinally extending row. Three further pawls 89*f*,89*g*,89*h* are circumferentially aligned and arranged in a second longitudinally extending row, circumferentially spaced from the first longitudinally extending row. The longitudinally aligned pairs of pawls 89*c*,89*f*; 89*d*,89*g*; 89*e*,89*h* fold open in the same sense. Pawl 89*d* in the first longitudinally extending row has a fold on a different side to pawls 89*c*,89*e*. Similarly, pawl 89*g* in the second longitudinally extending row has a fold on a different side to pawls 89*f*,89*h*. Each of the pawls may be formed and arranged as described with respect to FIG. 8*a*. The sleeve blank 83" may form the whole sleeve, or may only be a strip affixed to an interior surface of a sleeve.

FIG. 9 shows a smoking article 90 having an eighth embodiment of indexing mechanism of the first family. The smoking article 90 comprises a tobacco rod 91, first filter 92 and second filter 94, arranged as described above. A sleeve blank 93 is shown before forming into a cylindrical sleeve, as described above.

The first indexing section 98 is the same as the first indexing section 18 described above. The second indexing mechanism comprises a pawl 99 engageable with the first indexing section 98 to form an indexing mechanism. The pawl 99 is formed by a strip of sheet material 97, which is described in more detail below.

The strip of sheet material 97 is laminated to the sleeve 93, for example by adhesive, and in some examples along the whole area of the strip 97 except for an area around the pawl. The strip of sheet material may adhere to the sleeve 93 with an adhesive. The strip of sheet material 97 extends laterally over the substantially whole width (circumference) of the sleeve 93. In some embodiments, the pawl unit 97 is shorter than the sleeve blank 93, such that the sleeve blank 93 can form a lap seam in order to secure the blank 93 as a cylindrical sleeve without the pawl unit 97. The width, i.e. longitudinal extent, of the strip of sheet material 97 is less than the longitudinal length of the sleeve 93. The laminating material may be cellulose acetate film, and may be attached to the sleeve blank with adhesive. The longitudinal extent of the pawl is approximately the same, or slightly less than, the longitudinal extent of the first indexing section 98.

The sleeve 93 is cut to allow formation of the pawl 99. For example, two parallel cuts are made in the sleeve material, which extend laterally along cut lines 96*a*,96*b*. The cuts along cut lines 96*a*,96*b* may be made prior to lamination of the strip 97, or made following lamination of the strip 97 and located outside of the strip 97, or made following lamination of the strip 97 and located within the strip 97 such that the cuts along cut lines 96*a*,96*b* extend through the sleeve material and laminated strip 97. In some embodiments, the strip 97 is not adhered to the sleeve blank 93 around the pawl.

A tab 97*a* is defined between the cut lines 96*a*,96*b*. A forming head (not shown) presses between the cut lines 96*a*,96*b* to deform the tab and form the pawl 99. The double layer of sheet material 93 and laminated strip 97 is deformed such that fold lines 95*a*,95*b* are formed extending longitudinally at each end of the cut lines 96*a*,96*b*. The pawl 99 comprises a fold 95*c* at the apex of the ridge. The tab 97*a* is folded or creased such that a ridge having a substantially triangular cross-section protrudes from the sleeve 93 to form the pawl 99. The protruding ridge may extend over the majority or substantially the whole width, i.e. longitudinal extent, of the strip of sheet material 97, which is arranged such that the pawl extends longitudinally, parallel to the ridges of the first indexing section 98 with which the pawl engages. The double layer of sleeve blank 93 and laminating strip 97 provides a rigid pawl 99.

The second indexing section is formed by laminating (affixing) a strip of sheet material 97 to a sleeve blank 93. The pawl is formed only in the section of the sleeve which is laminated. The laminated sleeve blank 93 is then cut along cut lines 96*a*,96*b*. The cuts extend through the lamination strip and sleeve blank. A cutting roller may form the cuts along cut lines 96*a*,96*b*. The sleeve blank 93 may then be cut from adjacent sleeve blanks supplied as a continuous length on a reel. The tab 97*a* is extruded by a forming head, which may be a roller, to protrude from the sleeve 93 and form the pawl 99. The sleeve blank 93 is then formed into a cylindrical tube around the second filter 94.

Alternatively, the sleeve blank 93 may not be laminated with a strip 97. The sleeve blank can be formed from a heavy weight paper, for example, 100 gsm or more. The same cut lines and extrusion of the tab to form the pawl are made, as above.

In a further embodiment, the pawl and sleeve blank are formed from a single layer of material. The single layer of material can be of any material described, and in particular, formed of cellulose acetate sheet, e.g. cast cellulose acetate sheet. The pawl and sleeve blank are integrally formed, such that wrapping of the sleeve blank around the filter engages the upstanding pawl with the first indexing section. The pawl can be formed by stamping the sleeve blank. The pawl can have an upstanding triangular profile.

In a further aspect, the pawl may be formed by stamping the sleeve blank. The sleeve blank may not be initially cut around the pawl (i.e. no cut lines 96*a*, 96*b*). The stamping deforms the material of the sleeve blank (e.g. cellulose acetate) to form the pawl defining a longitudinal ridge. The pawl is substantially triangular in cross-section, i.e. on a lateral view. The circumferentially extending sides of the upstanding pawl remain connected to the adjacent sleeve blank material. In particular, the sleeve blank material extends out of the plane of the sleeve to connect the sleeve and triangular pawl profile, over the whole circumferential extent of the pawl. This has the advantage of supporting the upstanding triangular pawl. This connecting material is substantially on the area indicated by cut-lines 96*a*,96*b* in the different embodiment of FIG. 9. The sleeve material may be plastically deformed by the stamping to form the upstanding pawl.

FIG. 10 shows a part of a smoking article having a ninth embodiment of indexing mechanism of the first family. The smoking article comprises a tobacco rod, first filter and second filter, arranged as described above. A sleeve 103 is shown, formed into a cylindrical tube, substantially as described above.

The smoking article comprises a first indexing section which is the same as the first indexing section 18 described above. The second indexing mechanism comprises a pawl 109 engageable with the first indexing section to form an indexing mechanism. The pawl 109 protrudes radially inwardly from the sleeve 103. The pawl 109 extends longitudinally, parallel to the ridges of the first indexing section with which the pawl engages.

The sleeve 103 is formed from a blank. Longitudinal sections 109*a*,109*b* of the blank adjacent the two longitudinal edges are folded in the same direction, prior to the blank being rolled into a cylinder. When the blank is rolled into a cylinder, the sections 109*a*,109*b* are abutting and protrude radially inwardly to form the pawl 109. The surfaces 109*a*,109*b* are joined together to secure the blank as a cylinder. The surfaces 109*a*,109*b* form a lap joint, and may be joined by adhesive.

The pawl 109 is formed of two layers of the sheet material forming the sleeve, and so is relatively rigid. The longitudinal extent of the pawl is approximately the same, or slightly less than, the longitudinal extent of the first indexing section.

The pawl 109 protrudes radially inwardly over a part of the length of the sleeve 103, and may be folded flush with the interior surface of the sleeve over a further part. The second filter may be attached at a part where the pawl 109 is folded flush with the interior surface. A cut (not shown) may provide a boundary between the section of pawl which is protruding and the section of pawl which is folded flush. Alternatively, the pawl 109 may protrude radially inwardly over substantially the whole length of the sleeve. In some embodiments a filter is located within the sleeve. The filter may be secured only at a mouthpiece end.

The material of the sleeve may be formed of a single layer of sheet material, or may be formed by two (or more) layers of the same or different sheet materials laminated together. The pawl 109 may be formed by all of the layers of sheet material forming the sleeve, or may be formed only by one or more of the innermost layers of sheet material. In this case, one or more exterior layers may be secured as a cylinder independently and around the abutting sections 109*a*,109*b*. The exterior layer may cover the fold in the interior layer, preventing the fold from being visible from the exterior.

The second indexing section is formed by folding a blank 103 for the sleeve adjacent both of its longitudinal edges in the same direction. The sleeve blank is then formed into a cylindrical tube, in some examples, around the second filter. The folded longitudinal sections 109*a*,109*b* are adhered together to secure the blank as a cylinder and form the radially inwardly extending pawl 109.

FIG. 11 shows a smoking article to according to the present invention. The features of smoking article to may be present in combination with any embodiment of indexing mechanism. The smoking article to comprises a tobacco rod 11, first filter 12 and second filter 14, arranged as described above. A sleeve blank 13 is shown before forming into a cylindrical sleeve, as described above.

The first indexing section (not shown) may be the same as any embodiment of first indexing section described. The second indexing mechanism (not shown) may be the same as any embodiment of first indexing section described to form an indexing mechanism.

The sleeve 13 is prevented from longitudinal movement over the tobacco unit by a restraining means. The restraining means comprises a first and second engaging surfaces 17*a*, 17*b* preventing rearward movement of the sleeve 13 relative to the tobacco unit 11,12. The first engaging surface 17*a* may be formed on the tobacco unit, on a section of increased diameter. The first engaging surface 17*a* is formed on a step change in diameter from a forward section of the tobacco unit. The forward facing first engaging surface 17*a* may be formed by a sheet material (e.g. paper) wrapped around the tobacco unit and forming a section of increased diameter. The first engaging surface 17*a* may be formed by a sheet of material connecting the source of smokable material to the first filter 12, e.g. tipping paper, or another sheet material wrapped around the tobacco unit.

The second engaging surface 17*b* is provided within an interior surface of the cylindrical tube forming the sleeve. The second engaging surface 17*b* is formed between the forward and rearward ends of the sleeve, and on an interior surface of the sleeve. The second engaging surface 17*b* is provided on an inwardly folded section of the sleeve 13, formed by folding a forward edge of a blank for forming the sleeve. The forward edge of the blank is folded through approximately 180 degrees, such that the second engaging surface 17*b* faces rearwardly. The second engaging surface 17*b* does not extend over the whole width of the sleeve blank. The sleeve blank comprises a cut-out aligned with the folded section forming the second engaging surface 17*b*. The cut-out is configured such that the second engaging surface 17*b* extends around the whole circumference of the formed sleeve 13. The sleeve is secured as a cylinder with an overlap of opposite longitudinal edges. The cut-out is configured such that the folded section defining the second engaging surface 17*b* does not overlap with an opposite longitudinal edge. The restraining means 17*a*,17*b* allows free rotation whilst preventing removal or rearward longitudinal movement of the sleeve 13 relative to the tobacco unit 11,12.

The sleeve 13 is provided with one or more first ventilation apertures 16*a*. In some aspects, the sleeve 13 comprises a single first ventilation aperture 16*a* extending circumferentially over a part only of the circumference, and may be at a single longitudinal position. In some examples, the first ventilation aperture 16*a* is in the form of a narrow circumferential slit. The tobacco unit 11,12 comprises one or more second ventilation apertures 16*b*. In some aspects, the tobacco unit 11,12 comprises a single second ventilation aperture 16*b* extending circumferentially over a part only of the circumference, and may be at a single longitudinal position. In some examples, the second ventilation aperture 16*b* is in the form of a narrow circumferential slit. The second ventilation aperture 16*b* allows ingress of air into the tobacco unit, for example into the first filter 12, and/or into the tobacco rod 11 containing a source of smokable material. The second ventilation aperture 16*b* is an aperture or air permeable area allowing air into the filtration material of the first filter 12, through the layers of sheet material surrounding the filtration material.

The ventilation apertures in the sleeve and/or tobacco unit may be formed by a laser. In particular, the laser may simultaneously generate aligned ventilation apertures in the sleeve and tobacco unit. Alternatively, the ventilation apertures may be formed as a slit by a mechanical cutting tool. Alternatively, the ventilation apertures may be formed as a cut-out area. Alternatively, the ventilation apertures may be formed by an air permeable material, which is either manufactured as a permeable material or made permeable by the addition of apertures or by processing.

The first and second filters may be separate filters which are not directly connected. Alternatively, the first and second filters may be formed as a single integral filter. The first filter 12 is partially separated from the second filter 14 by a lateral cut. The lateral cut extends over a radially outer part of the first and second filters 12,14. A radially inner core connects the first and second filters 12,14. The central core of filtration material maintains the attachment of the first filter to the second filter. The first and second filters 12,14 can rotate relative to each other, with the central core twisting around a longitudinal axis. The central core maintains the attachment of the first filter to the second filter whilst twisted.

FIG. 12*a* shows a further embodiment of smoking article 120, substantially as described above. The smoking article 120 may comprise any embodiment of indexing mechanism described. The smoking article comprises a tobacco rod 121, and a first filter 122 adjacent to the tobacco rod 121. A second filter 124 is located rearwardly of the first filter 122. The tobacco rod 121 comprises a rod of tobacco material 121*a* circumscribed by a wrap 121*b*.

The smoking article 120 comprises an adsorbent additive. In some aspects, the adsorbent additive may be carbon, for example, activated charcoal. Alternatively, the adsorbent additive may be a resin. The resin may be an ion exchange resin with a polyamine group as chelating ligand bonded onto a cross-linked polystyrene matrix, for example, Diaion® CR20. The adsorbent additive may be located only in the first filter 122, such that smoke subsequently passes through the second filter 124 which does not contain an adsorbent additive.

The smoking article 120 comprises a pod 128, for example located wholly in the first filter 122. The pod 128 is located centrally within the first filter 122, and surrounded by filtration material. The pod 128 extends substantially the same length as the first filter 122. The pod 128 comprises permeable walls containing an adsorbent additive, for example carbon, optionally in the form of charcoal. The walls prevent the additive from moving through the smoking article, whilst allowing smoke into contact with the adsorbent additive. The pod 128 has the advantage that the adsorbent additive can be located within a relatively short longitudinal length. The pod 128 may extend only within the first filter, or may extend from the first filter to the second filter, such the pod 128 is located in both the first and second filters.

Alternatively, the adsorbent additive may be located in a cavity (not shown). The cavity may be defined between the first and second filters 122,124. The adsorbent additive may be granules of carbon, for example in the form of charcoal, or any suitable adsorbent additive.

Alternatively, the adsorbent additive may be distributed within the filtration material of the first filter 122. The adsorbent additive may be substantially uniformly distributed in the filtration material, for example, cellulose acetate tow. Alternatively, the adsorbent additive is located in a separate filter section only containing the adsorbent additive. The adsorbent additive may be granules of carbon, or any suitable adsorbent additive.

The adsorbent additive of any embodiment can be located in the filter section comprising the first indexing surface.

Alternatively, the adsorbent additive may be located around a periphery of the first filter section. The adsorbent additive may be affixed to an inner surface of a wrapper of sheet material surrounding the filtration material. The adsorbent additive may be adhered to the inner surface with an adhesive. The wrapper may be a porous paper, e.g. plugwrap.

The smoking article 120 comprises a sleeve 123 which is rotatable relative to the tobacco rod 121. The sleeve 123 comprises a first area 123*a* which is affixed to the second filter 124. In some aspects, adhesive in the first area 123*a* attaches the sleeve to the second filter 124 to rotate together. The sleeve 123 comprises adhesive in a first area 123*a* forwardly of the second filter 124, in order to affix opposite longitudinal sides of the sleeve blank together, to form a cylinder. The sleeve 123 is not provided with adhesive in a second area 123*b*. The second area 123*b* can rotate freely over the first filter 122.

The sleeve 123 is provided with one or more first ventilation apertures 126*a*. In some examples, the sleeve 123 comprises a single first ventilation aperture 126*a* extending circumferentially over a part only of the circumference, and may be at a single longitudinal position. In some aspects, the first ventilation aperture 126*a* is in the form of a narrow circumferential slit. The tobacco unit 121,122 comprises one or more second ventilation apertures (not shown). In some examples, first filter 122 comprises a single second ventilation aperture extending circumferentially over a part only of the circumference, and may be at a single longitudinal position. For example, the second ventilation aperture is in the form of a narrow circumferential slit. The second ventilation aperture allows ingress of air into the tobacco unit, for example into the first filter 122, and in particular into the filtration material of the first filter 122 through the sheet material surrounding the filtration material. Ventilation through the apertures is dependent on alignment of the apertures, which is determined by the rotational position of the tobacco unit 121,122 (first part of the smoking article) relative to the sleeve 123 (second part of the smoking article).

The sleeve 123 may comprise one or more further ventilation apertures 126*b*. The ventilation apertures 126*b* provide ventilation which is independent of the rotational position of the position of the tobacco unit 121,122 (first part of the smoking article) relative to the sleeve 123 (second part of the smoking article). The ventilation apertures 126*b* provide a base level, or minimum, ventilation to the smoking article. The ventilation apertures 126*b* allow air through the sleeve, and into the second filter 124, for example, adjacent a forward end of the second filter 124. The second filter 124 comprises filtration material surrounded by a porous paper wrap (e.g. plugwrap), which allows the ventilating air into the filtration material of the second filter 124.

The sleeve 123 comprises a separation line 127, which extends substantially circumferentially. The sleeve is configured to easily break along the separation line 127 into a forward part and a rearward part. The rearward part is affixed to the second filter 124. The forward part is affixed to the first filter 122 and the tobacco rod 121, for example by adhesive over a forward part of area 123*a*. In some aspects, the forward part of the sleeve 123 connects the tobacco rod 121 and first filter 122. The separation line 127 may be defined by a plurality of perforations through the sheet material (e.g. paper) of the sleeve 123. In use, the forward and rearward parts of the sleeve are initially connected. The smoking article has a defined initial ventilation, set by the ventilation apertures 126*b*, and a pre-determined initial alignment of the first and second ventilation apertures. The sleeve is not readily rotatable (or slidable) relative to the tobacco unit. Application of a rotational force to the rearward part of the sleeve 123, relative to the tobacco unit, breaks the sleeve along the separation line 127. The sleeve 123 is then freely rotatable, subject to the indexing mechanism 129, to vary the ventilation by alignment of the first and second ventilation apertures.

The ventilation aperture in the sleeve may comprise one or more ventilation areas. The ventilation areas may be formed by electrostatic perforation (EP) or by on machine laser (OML). The porosity of a ventilation area formed by electrostatic perforation may be reduced by closing the EP apertures with adhesive.

The smoking article may comprise an inner wrap of sheet material, for example tipping paper, in which the ventilation apertures for providing variable ventilation and a base level of ventilation are formed. The inner wrap may also connect the first filter to the tobacco rod, and may also define the first indexing section. An outer wrap, comprising the sleeve 123 described, may overlie the inner wrap. The sleeve 123 is rotatable around the inner wrap.

FIG. 13 shows a smoking article 130 according to the present invention. The features of smoking article 130 may be present in combination with any embodiment of indexing mechanism. The smoking article 130 comprises a tobacco rod 131, first filter 132 and second filter 134, arranged as described above. A sleeve blank 133 is shown before forming into a cylindrical sleeve, as described above. The first filter 132 may optionally comprise an adsorbent additive, for example, carbon (e.g. activated charcoal) distributed within the filtration material. The first and second filters are separate filters, which abut without a direct connection.

A first indexing section 138 may be the same as any embodiment of first indexing section described. For example, the first indexing section is formed as a tubular indexing member surrounding the first filter 132, and separate to the filtration material and wrap forming the filter. The indexing member may be formed of a rolled piece of cellulose acetate film, having longitudinal grooves formed therein. Alternatively, the sheet material defining the first indexing surface may directly surround and retain the filtration material (i.e. function as plug wrap). The second indexing mechanism 139 may be the same as any embodiment of first indexing section described to form an indexing mechanism.

The sleeve 133 is prevented from longitudinal movement over the tobacco unit by a restraining means. The restraining means comprises a first and second engaging surfaces 137*a*, 137*b* preventing rearward movement of the sleeve 133 relative to the tobacco unit 131,132. The first engaging surface 137*a* may be formed on the tobacco unit, on a section of increased diameter. The first engaging surface 137*a* is formed on a step change in diameter from a forward section of the tobacco unit. The forward facing first engaging surface 137*a* may be formed by a sheet material 135*a* (e.g. paper) wrapped around the tobacco unit and forming a section of increased diameter. The first engaging surface 137*a* may be formed by formed by a sheet of material 135*a* connecting the source of smokable material to a filter, e.g. tipping paper, or another sheet material wrapped around the tobacco unit. The first engaging surface 137*a* is substantially the same as the first engaging surface 17*a* described with respect to FIG. 11.

The second engaging surface 137*b* is provided within an interior surface of the cylindrical tube forming the sleeve. The second engaging surface 137*b* is formed between the forward and rearward ends of the sleeve, and on an interior surface of the sleeve. The second engaging surface 137*b* is provided on an inwardly folded section of the sleeve 133, formed by folding a forward edge of a blank for forming the sleeve. The second engaging surface 137*b* is substantially the same as the second engaging surface 17*b* described with respect to FIG. 11. The restraining means 137*a*,137*b* allows free rotation whilst preventing removal or rearward longitudinal movement of the sleeve 133 relative to the tobacco unit 131,132.

The sleeve 133 is provided with one or more first ventilation apertures 136*a*. In some examples, the sleeve 133 comprises a single first ventilation aperture 136*a* extending circumferentially over a part only of the circumference, and for example at a single longitudinal position. In some aspects, the first ventilation aperture 136*a* is in the form of a narrow circumferential slit. The tobacco unit 131 comprises one or more second ventilation apertures 136*b*. In some examples, the tobacco unit 11 comprises a single second ventilation aperture 136*b* extending circumferentially over a part only of the circumference, and may be at a single longitudinal position. In some aspects, the second ventilation aperture 136*b* is in the form of a narrow circumferential slit. The second ventilation aperture 136*b* allows ingress of air into tobacco unit, for example into the first filter 132, and/or into the tobacco rod 131 containing a source of smokable material. The second ventilation aperture 136*b* is an aperture or air permeable area allowing air into the filtration material of the first filter 132, through the layers of sheet material surrounding the filtration material. The second ventilation aperture 136*b* is may optionally be formed in a impermeable sheet material 135*b*, for example tipping paper. The sheet material 135*b* is located rearwardly of the first indexing means 138, and only extends over the first filter 132. The sheet material 135*b* is radially adjacent to the sleeve 133 to preventingress of air through the first ventilation aperture 136*a*, when not aligned with the second ventilation aperture 136*b*. Ventilation through the apertures 136*a*,136*b* is dependent on alignment of the apertures 136*a*, 136*b*, which is determined by the rotational position of the tobacco unit 131,132 (first part of the smoking article) relative to the sleeve 133 (second part of the smoking article).

The sleeve 133 may optionally comprise one or more further ventilation apertures 136*c*. The ventilation apertures 136*c* provide ventilation which is independent of the rotational position of the position of the tobacco unit 131,132 (first part of the smoking article) relative to the sleeve 133 (second part of the smoking article). The ventilation apertures 136*c* provide a base level, or minimum, level of ventilation to the smoking article. The ventilation apertures 136*c* allow air through the sleeve, and into the second filter 134, for example, adjacent a forward end of the second filter 134. The second filter 134 comprises filtration material surrounded by a porous paper wrap (e.g. plugwrap), which allows the ventilating air into the filtration material of the second filter 134.

The sleeve 133 comprises a first area 133*a* which is affixed to the second filter 133*a*. In some aspects, adhesive in the first area 133*a* attaches the sleeve to the second filter 133*a* to rotate together. In addition, adhesive in the first area 133*a* forwardly of the second filter 134 affixes opposite longitudinal sides of the sleeve blank together, in order to form a cylinder. The sleeve 133 is not provided with adhesive in a second area 133*b*. The second area 133*b* can rotate freely over the first filter 132 and tobacco rod 131.

The first indexing section 138 is the same as the first indexing section 18 described above. The second indexing mechanism comprises a pawl 139*a* engageable with the first indexing section 138 to form an indexing mechanism. The pawl 139*a* is formed by a strip of sheet material 139, for example as described with respect to FIG. 2. The sheet material 139 is folded or creased such that a ridge having a substantially triangular cross-section protrudes from the sleeve 133. The protruding ridge extends over the whole width, i.e. longitudinal extent, of the strip of sheet material 139, which is arranged such that the pawl extends longitudinally, parallel to the ridges of the first indexing section 138 with which the pawl engages.

FIG. 14 shows a smoking article 140 according to the present invention. The features of smoking article 140 may be present in combination with any embodiment of indexing mechanism. The smoking article 140 comprises a tobacco rod 141, first filter 142 and second filter 144, arranged as described above. A sleeve blank 143 is shown before forming into a cylindrical sleeve, as described above. The first filter 142 may optionally comprise an adsorbent additive, for example, carbon in the form of charcoal distributed within the filtration material.

The second filter 144 may optionally comprise a forward section 144*a* and a separate rearward section 144*b*. The forward section 144*a* and rearward section 144*b* may be formed as a single integral filter, and cut into separate filter sections online.

A first indexing section 148 may be the same as any embodiment of first indexing section described. The second indexing mechanism 149 may be the same as any embodiment of second indexing section described to form an indexing mechanism.

A sheet material 145 connects the first filter 142 and tobacco rod 141. The sheet material 145 may be paper, e.g. tipping paper, wrapped around the first filter and tobacco rod. The sheet material 145 may extend over substantially the whole length of the tobacco rod. The tobacco rod 141 may comprise tobacco material covered in a wrap. Thus, the tobacco material is covered in two layers. The inner wrap may be a tobacco sheet.

The sleeve 143 is provided with one or more first ventilation apertures 146*a*, substantially as described with respect to FIG. 13 or any embodiment. The tobacco unit 141 comprises one or more second ventilation apertures (not shown), substantially as described with respect to FIG. 13 or any embodiment. The sleeve 143 may comprise one or more further ventilation apertures 146*c*, substantially as described with respect to FIG. 13 or any embodiment.

The sleeve 143 comprises adhesive in the first area 143*a* forwardly of the rearward section 144*b* of the second filter 144, in order to affix opposite longitudinal sides of the sleeve blank together, to form a cylinder. The sleeve 143 is not provided with adhesive in a second area 143*b*. The second area 143*b* can rotate freely over the first filter 142.

The sleeve 143 comprises separation line 147, which extends substantially circumferentially. The sleeve is configured to easily break along the separation line 147 into a forward part and a rearward part. The rearward part is affixed to the rearward section 144*b* of the second filter 144. The forward part is affixed to the forward section 144*a* of the second filter, the first filter 142 and optionally also the tobacco rod 141, example by adhesive over a forward part of area 143*b*. The sleeve 143 connects the forward section 144*a* of the second filter and the first filter 142. The separation line 147 may optionally be defined by a plurality of perforations through the sheet material (e.g. paper) of the sleeve 143. In use, the forward and rearward parts of the sleeve are initially connected. The smoking article has a defined initial ventilation, set by the ventilation apertures 146*c*, and a pre-determined initial alignment of the first and second ventilation apertures. The sleeve is not readily rotatable (or slidable) relative to the tobacco unit. Application of a rotational force to the rearward part of the sleeve 143, relative to the tobacco unit, breaks the sleeve along the separation line 147. The sleeve 143 is then freely rotatable, subject to the indexing mechanism 148,149, to vary the ventilation by alignment of the first and second ventilation apertures. The sleeve 143 and tobacco unit 141,142 may remain connected since the first and second filters have a connected central core, or the first and second filters may be separate, and the pawl 149 engaged in the first indexing section 148 prevents longitudinal movement between the first and second parts of the smoking article.

FIG. 15 shows a smoking article 150 according to the present invention. The features of smoking article 150 may be present in combination with any embodiment of indexing mechanism. The smoking article 150 comprises a tobacco rod 151, first filter 152 and second filter 154, arranged as described above. A sleeve blank 153 is shown before forming into a cylindrical sleeve, as described above. The first filter 152 may optionally comprise an adsorbent additive, for example, carbon in the form of charcoal distributed within the filtration material.

The first filter 152 may optionally comprise a forward section 152*a* and a rearward section 152*b*. The forward section 152*a* and rearward section 152*b* may be formed as a single integral filter. The forward section 152*a* is partially separated from the rearward section 152*b* by a lateral cut 155. The lateral cut 155 extends over a radially outer part of the first filter 152. A radially inner core 155*a* connects the forward section 152*a* and rearward section 152*b*. The central core of filtration material maintains the attachment of the forward section 152*a* to the rearward section 152*b*. The forward section 152*a* and rearward section 152*b* can rotate relative to each other, with the central core twisting around a longitudinal axis. The central core maintains the attachment of the forward section 152*a* and rearward section 152*b* whilst twisted. The sleeve 153 is attached to the rearward section 152*b* over an area 153*a*, for example covered in adhesive. The connection between the filter sections 152*a*, 152*b* therefore connects the sleeve 153 to the tobacco rod 151.

A first indexing section 158 may be the same as any embodiment of first indexing section described. The second indexing mechanism 159 may be the same as any embodiment of first indexing section described to form an indexing mechanism.

The sleeve 153 is provided with one or more first ventilation apertures (not shown), substantially as described with respect to FIG. 13 or any embodiment. The tobacco unit 151 comprises one or more second ventilation apertures (not shown), substantially as described with respect to FIG. 13 or any embodiment. The sleeve 153 may optionally comprise one or more further ventilation apertures (not shown), substantially as described with respect to apertures 136*c* in FIG. 13 or any embodiment.

The sleeve 153 comprises adhesive in the first area 153*a* forwardly of the rearward section 152*b* of the second filter 154, in order to affix opposite longitudinal sides of the sleeve blank together, to form a cylinder. The sleeve 153 is not provided with adhesive in a second area 153*b*. The second area 153*b* can rotate freely over the forward section of the first filter 152.

The sleeve 153 connects the second filter and rearward section 152*b* of the first filter 152, by the first area 153*a* of the sleeve. A separate connection (not shown), for example a paper wrap, connects the forward section 152*a* of the first filter 152 to the tobacco rod 151. In use, the forward and rearward sections of the first filter 152 are connected without twisting. The smoking article has a defined initial ventilation, set by a pre-determined initial alignment of the first and second ventilation apertures. The sleeve 153 is then freely rotatable, subject to the indexing mechanism 158,159, to vary the ventilation by alignment of the first and second ventilation apertures. The sleeve 153 and tobacco unit 151,152*b* remain connected since the first filter sections have a connected central core.

FIGS. 16, 17*a* and 17*b* illustrate parts of a manufacturing apparatus configured to manufacture smoking articles according to any embodiment of the present invention. In particular, a known manufacturing apparatus is modified, or added to by a module, to manufacture the second indexing mechanism shown in FIG. 2, and a smoking article having the second indexing mechanism shown in FIG. 2. A corresponding modification may be made for the further embodiments, as appropriate.

FIG. 16 shows a schematic drawing of a manufacturing apparatus 160 forming part of a manufacturing system, and which functions as a bobbin/reel loader or feeder. The apparatus 160 may be a modification of a HAUNI® BOB ME bobbin.

The apparatus 160 is a module configured to form and output a pawl 169 attached to a sleeve material 163 for forming a sleeve, for example as substantially as described with respect to FIG. 2. The sleeve material 163 is a sheet material, for example, paper, e.g. tipping paper. The sleeve material 163 with attached pawl 169 is then fed into a further apparatus (not shown) for forming into a smoking article, for example as substantially as described with respect to FIG. 2. The further apparatus may be a (modified) HAUNI®M5. The further apparatus may comprise two units for applying tipping paper. The first unit may apply the inner wrap on which the first indexing surface is defined. The second unit may apply the outer wrap forming the sleeve, on which the second indexing surface is attached.

The apparatus 160 comprises a source of pawl material 161 for forming the pawls 169. The pawl material 164 is a sheet material, for example, paper, cellulose acetate film, a laminate of paper and cellulose acetate film, or any material described. The pawl material 164 is stored on at least one bobbin 162*a*. In some aspects a continuous length of the pawl material 164 is stored on a first bobbin 162*a* and a second bobbin 162*b*, which can alternately feed pawl material 164 to ensure an uninterrupted stream of pawl material 164.

The pawl material 164 is cut by a cutting mechanism 165 into discrete sections or strips 167 of pawl material, which may be termed a pawl unit 167. Each strip 167 forms a single pawl 169. The cutting mechanism 165 may comprise a rotating cutting roller or knife which cuts the pawl material 164 against an adjacent roller.

The separate strips 167 are fed to a forming mechanism 166 for forming fold lines in the strip 167 to define the pawl 169. The forming mechanism 166 may be formed by a rotating roller configured to deform the planar strip 167 against an adjacent roller. The strip 167 is folded such that a protruding ridge is permanently formed.

The strips 167 are then fed to an attachment mechanism 168. The gluing mechanism is configured to apply an adhesive to the strips 167 with a roller. The adhesive is applied to the side of the strip 167 opposite to the protruding ridge defining the pawl 169. The attachment mechanism is further configured to locate the strips 167 on a continuous length of sleeve material 163.

The sleeve material 163 is sourced from a source of sleeve material 181. The sleeve material 163 is stored on at least one bobbin 182*a*. In some examples, a continuous length of the sleeve material 163 is stored on a first bobbin 182*a* and a second bobbin 168*b*, which can alternately feed sleeve material 163 to ensure an uninterrupted stream of sleeve material 163.

The sleeve material 163 may be marked in order to accurately cut the sleeve material 163 into separate sections for forming individual (or pairs) of sleeves. The marks (not shown) may also be used to accurately locate the strips 167 on the continuous length of the sleeve material 163. For example, a camera (not shown) may detect printed registering marks on the sleeve material 163. The strip 167 is located a pre-determined distance from the registering mark.

After attachment of the strip 167 to the sleeve material 163, the sleeve material 163 is fed by a first roller 170 and a second roller 174 for further forming into a smoking article. The first roller 170 is on the side of the sleeve material 163 facing the pawl 169. A conventional cylindrical roller would impact the pawl 169, and so is not suitable for handling the sleeve material with attached pawl. The first roller 170 is shown in more detail in FIG. 17*a*. The second roller 174 is on the opposite side of the sleeve material to the pawl 169. The second roller 174 may be a conventional cylindrical roller.

An adhesive applicator (not shown) may be configured to apply adhesive to the sleeve material 163 between the first and second rollers 170,174. The adhesive applicator is configured to apply adhesive in a pattern to form a smoking article according to any embodiment, and for example, applies adhesive to only a part of the sleeve material 163. The adhesive applicator may comprise two rollers, namely a patterned roller receiving adhesive only in a pre-determined pattern corresponding to the adhesive pattern of the sleeve material. The patterned roller transfers the adhesive to a plain roller, which transfers the adhesive pattern to the sleeve material. The adhesive affixes the sleeve material 163 to a filter and/or tobacco rod in the main manufacturing apparatus.

FIG. 17*a* shows the first roller 170 with sleeve material 163, or substrate, having an attached strip 167 defining a pawl 169. The roller 170 comprises one or more first sections 171, and for example two first sections 171, which may be cylindrical. The first sections have a first lateral extent, in particular a first diameter, and are configured to contact the material supporting the pawl, i.e. sleeve material 163. The roller 170 further comprises a second section 172 having a second lateral extent. The second section 172 may be cylindrical having a second diameter. The second section 172 is located adjacent, and may be between, the first sections 171. The second diameter is less than the first diameter. The second section 172 is configured not to contact the sleeve material 163, or the pawl 169. The second section 172 provide an area of the roller 170 which allows the pawl 169 to pass through without impacting the pawl 169. The second section 172 may be cylindrical, or may have any cross-section which does not contact the pawl 169.

The use of rollers 170,174 allows the strip 167 to be connected to the sleeve material 163 prior to entering the main manufacturing apparatus. The main manufacturing apparatus therefore does not require major modifications in order to handle the sleeve material 163 with pawl attached. The addition of the pawl 169 in a separate bobbin apparatus provides time for adhesive connecting the strip 167 and sleeve material 163 to dry, optionally using a dryer (heater) operating on the sleeve material 163 after the second roller 174.

The sleeve material 163 with pawl attached is fed into the main manufacturing apparatus after the second roller. After passing the second roller 174, the sleeve material engages with a curling bar 175, which is modified as described in FIG. 17*b*.

FIG. 17*b* shows the curling bar 175. The curling bar 175 is configured to curl the sleeve material 163 as preparation for rolling into a cylindrical sleeve. A conventional curling bar having a continuous edge would impact the pawl 169, and so is not suitable for handling the sleeve material with attached pawl. The curling bar 175 comprises first curling sections 176 defining edges extending in a plane, and configured to contact the sleeve material 163. The curling bar 175 further comprises a second section 177 defining an edge which is spaced from the plane of the first sections 176. The second section 177 is configured not to contact the sleeve material 163, or the pawl 169. The second section 177 provides an area of the curling bar 170 which allows the pawl 169 to pass through without impacting the pawl 169. The second section 177 may have any cross-section which does not contact the pawl 169.

Alternatively, a curling bar (not shown) may be located to curl the sleeve material 163 prior to attachment of the strip 167. The curling bar may be located between the source of sleeve material 181 and the attachment mechanism 168, in association with rollers configured to draw the sleeve material 163 around the curling bar. The curling bar may be a conventional curling bar, since the pawl 169 has not yet been attached.

FIGS. 18*a* and 18*b* show two stages in the manufacture of a pawl 209 forming a second indexing section, engageable with a first indexing section to form an indexing mechanism, substantially according to any embodiment of the present invention. For example, the pawl 209 may be relate to the second indexing section substantially as described with respect to FIG. 2.

FIG. 18*a* shows a first stage in the formation of the pawl 209. In the first stage, a strip 207 of sheet material for forming the pawl 209 has been deformed by a forming tool (not shown). The forming tool comprises a punch having an edge which presses the strip 207 into a die block to deform the strip and generate an upstanding ridge. In some examples, the punch has a uniform triangular cross-section. The die block defines a complementary uniform triangular cross-section. The punch may subtend an angle of from 10 to 35 degrees, and more particularly from 15 to 25 degrees, and in particular, approximately 20 degrees. The pawl formed by the punch subtends the same angle, i.e. from 10 to 35 degrees, and in particular from 15 to 25 degrees or 20 to 30 degrees, or from 10 to 55 degrees, and optionally from 15 to 40 degrees or from 15 to 30 degrees or less than 5, 10, 15, 20, 25, 30, 35 degrees, or greater than 5, 10, 15, 20, 25, 30, 35 degrees or from and to any angle mentioned, and in particular, approximately 20 degrees. The pawl may subtend the same range of angles when formed by any suitable means. The selection of a pawl subtending from 10 to 35 degrees, or 15 to 25 degrees, provides for a well formed ridge subtending the same angle, and avoids the strip 207 being fractured or cut. The angle defined by the pawl may vary as the pawl is mounted on a curved substrate. In some aspects, the angle defined by the pawl does not vary or only varies a small amount when attached to a substrate. Alternatively, the pawl may be compressed to define a smaller angle when attached to a substrate.

The upstanding ridge is formed by parallel folds 205*a*, 205*b* and a fold 205*c* at the apex of the ridge, or edged peak. The folds 205*a*, 205*b*, 205*c* define a substantially triangular cross-section, and as shown, a substantially equilateral triangular cross-section. The folds 205*a*,205*b* are spaced apart when the ridge is first formed. The pawl of any embodiment may extend radially by between 0.5 mm and 1.5 mm, and may be between 0.5 and 1 mm, and may be around 0.7 mm. The pawl of any embodiment can have a length, e.g. a longitudinally extent selected from one of: 1 mm to 8 mm, 2 mm to 7 mm, 3 mm to 6 mm, or 3 mm to 5 mm. In particular, the elongate edge of the pawl has a length selected from one of these ranges. Any dimension in a range can be used in combination with any other dimension in a range.

FIG. 18*b* shows a later second stage in the formation of the pawl 209. The triangular ridge is compressed laterally to the length of the ridge. The folds 205*a*,205*b* are urged together, such that they are substantially adjacent. The distance from the folds 205*a*,205*b* to the ridge fold 205*c* is significantly larger than the distance between the folds 205*a*,205*b*. The pawl 209 is a protruding ridge having a substantially minimum cross-section in the plane of the strip 207, such that the pawl 209 defines a closed triangle, and not the earlier equilateral triangle in cross-section.

In some embodiments, the punch (male part) is pushed in to partially form the pawl. The die block (female part) may then move inwardly against the punch in order to complete the pawl profile.

The compressed strip 207 is affixed to sleeve material 203 for forming a sleeve according to any embodiment. The compressed strip 207 is affixed with adhesive in a first area 208*a* and a second area 208*b*. The first and second areas 208*a*,208*b* are on each lateral side of the pawl 209, and are configured to prevent the compressed strip 207 from expanding.

The first and second areas 208*a*,208*b* are spaced from the protruding ridge of the pawl 209, and do not extend underneath the pawl 209. The absence of adhesive on the pawl 209 may assist in generating an improved audible sound.

The pawl of any embodiment of this type may be formed of a sheet material defining an edged peak. In some aspects, the pawl comprises integral first and second upstanding sections of sheet material, which converge to an edge. The pawl may define an edged peak formed by a fold in a sheet material, to define a ridge. The pawl may be defined by a sheet material having a plurality of folds to define an edged peak.

In some embodiments, the pawl and ridges forming the first and second indexing surfaces are configured to generate an audible sound when rotated relative to each other. In particular, the pawl is configured to engage and be restrained by a first ridge, such that the pawl is resiliently deformed when the pawl rotates around a longitudinal axis. The pawl is rotated and deformed until the first ridge no longer restrains the pawl. The pawl then resiliently returns to its original shape, and in some embodiments, impacts a second, adjacent, ridge. The pawl of some examples can be resiliently deformable in a direction of indexing movement, e.g. substantially circumferential direction. In particular, a tip or peak of the pawl, distal from the substrate, is arranged to move in a resiliently deformable manner relative to the pawl substrate, e.g. in an indexing (substantially circumferential) direction. For example, the pawl can resiliently rotate around its base, i.e. attachment point. Alternatively or in addition, the upstanding section(s) of the pawl are resiliently deformable by bending. In some examples, the tip of the pawl is configured to resiliently move in a curved arc around its base at the substrate. The arc of motion is such that circumferential motion provides a radial deflection of the tip of the pawl, allowing transition between indexing positions. In particular, the pawl is configured to deflect due to a circumferential force applied to the tip of the pawl by contact with the ridge with which the pawl indexes. Alternatively, the pawl is movable substantially in a radial direction by contact with the indexing surface. The pawl substrate and/or indexing surface (and/or pawl) are resiliently deformable or movable in a radial direction by force in a radial direction. The indexing surface contacted by the pawl is at an angle to a radial direction (i.e. at an angle of less than 90 degrees), i.e. sloped. The pawl comprises one or more sections at an angle to a radial direction, i.e. sloped.

In some examples, the primary mechanism by which the pawl is movable over a ridge of the first indexing surface is by resilient deformation of the pawl, e.g. rotation or bending or the pawl. The deformation of the pawl is primarily in the indexing direction, i.e. a circumferential direction. The indexing direction is an axis or path along which the indexing positions are spaced (e.g. circumferentially), and does not imply a direction along the path. In particular, the pawl resiliently deforms in a direction opposite to the direction of movement of the pawl substrate, as the pawl is initially restrained by contact with the second indexing surface. A lesser contribution to the movement of the pawl over a ridge can be from radial outward movement of the whole pawl, e.g. movement of the pawl substrate. A still lesser contribution is expected from deformation of the first indexing surface.

Indexing movement of the pawl against the indexing surface results in contact between the two sloped surfaces, generating a radial force which allows a resilient radial movement (e.g. of the pawl) over the ridge and into the adjacent depression. A sound is generated when the pawl is released suddenly, for example, from a substantially single point of maximum resistance of the ridge. Once the pawl is released from the ridge, the pawl returns to its original shape from the resilient deformed shape. This return movement provides a rapid movement of the pawl. The ridge is configured to contact the pawl and provide for release at substantially single point, allowing rapid return of the pawl to its original shape without further contact with the peak of the ridge. The groove can be configured to be substantially wider in an indexing direction (e.g. circumferential) than the engaging edge of the pawl, e.g. 1.2 times or more wider, 1.5 times or more wider, 1.7 times or more wider, two times or more wider, or three times or more wider. The width of the groove can be defined as the extent of the groove in the indexing direction (e.g. circumferentially) at the radial position of the distal end (i.e. tip) of the pawl. Alternatively, the width of the groove can be defined as the extent between ridges, or between flat lands on the grooves or at a position of half the radial extent of the ridges. Thus, the groove width is higher than the pawl width such that the pawl is movable within the groove, to generate a sound.

The width of the engaging edge of the pawl comprising a folded edge of a sheet material can be considered as approximately two times the thickness of the sheet material. Alternatively, the width of the engaging edge of the pawl in an indexing direction is less than one of: 1 mm, 0.9 mm, 0.8 mm, 0.7 mm, 0.6 mm 0.5 mm, 0.4 mm, 0.3 mm, 0.2 mm or 0.1 mm. For example, the width of the engaging edge is less than 0.6 mm, or from 0.3 mm to 0.6 mm, or between any two values mentioned. In some examples, the groove is configured to allow free movement without contact with a bottom of the groove. The pawl and groove are configured such that return movement brings the pawl into contact with a surface of the first indexing surface, e.g. an adjacent ridge. This sudden release of the pawl from a resiliently deformed position against a relatively hard surface contributes to generating an indexing sound.

The shape of the ridge and pawl allows the pawl to move rapidly to contact the relatively hard surface of the adjacent depression or ridge. The exterior surface of the adjacent depression/ridge is harder than a conventional filter paper wrap. For example, the hardness is due to the first indexing surface and/or second indexing surface comprising a plastics material. For example, the material can be or comprise one or more of: a polymer, a polysaccharide, cellulose sheet, regenerated cellulose, cellulose acetate, or a plastics material or polymer not including one or more of: cellulose acetate and/or cellulose and/or polypropylene and/or ink and/or glue; or an additive in paper. The resilient deformation required for movement between indexing positions is substantially all from movement (primarily circumferential movement) of the pawl. The attached pawl substrate deforms less than the pawl, and in some examples, does not substantially move, deflect or deform in movement between indexing positions. Alternatively, the substrate can twist around a longitudinal axis as the pawl is deformed. In particular, the base (substrate) does not substantially deform in a radially outward direction when moving between indexing positions. In addition, the pawl is not configured to deform only in a radial direction. Alternatively, ridges of the first indexing surface and/or a substrate supporting the pawl are configured to resiliently deform in addition to, or instead of, resilient deformation of the pawl.

The resilient movement of the pawl, and optionally, impact against an adjacent ridge generates an audible sound. In some embodiments, the audible sound may at least partially be formed by initial movement of pawl when released from the first ridge. In various embodiments, the resilient deformation of the pawl is provided by the use of a selected sheet material. Optionally, the properties of the resilient deformation are provided by the substantially triangular profile of the pawl, in particular, the first and second upstanding sections of sheet material, having a peaked edge at an apex and spaced joins to a substrate. Optionally, the peaked edge and/or joins to a substrate are formed by folds in the sheet material.

The level of sound generated by the pawl may be determined by the dimensions and materials of the pawl. In particular, the sound may be determined by selecting one or more of the following properties to generate a generally audible sound of the required sound level. The amplitude of the pawl movement may be determined by the force of the impact of the pawl on the filter. Increasing stiffness of the pawl requires an increased force to deflect, which results in a greater velocity of the pawl on impact, generating a louder sound or 'click'. The size of the sounding body may determine the sound generated, the larger the sounding body, the larger the surface area. This means a larger volume of air is able to vibrate resulting in increased intensity and sound level. Thus, larger pawl dimensions provide an increased surface area to vibrate, and increased sound levels. In addition, a reduction in sound absorbing bodies or media (e.g. filtration material) in proximity to the pawl will generate a louder sound. The human ear is more sensitive to a middle part of the audible range. Thus, the pawl may be configured to generate a frequency of sound in a middle part (e.g. middle third) of the audible range. The hardness of the pawl, and/or density of the pawl material, may also be increased to increase the intensity and sound level of the pawl.

In some aspects, the pawl may be considered as a deflection of a lever fixed at one end. Modelling the pawl as a cantilever beam or lever with a concentrated load at the free end, standard equations providing the slop, deflection at any point and maximum deflection can be calculated. The force applied to the lever/pawl is from a user input achieved through turning of the filter, and as such is not a variable of the pawl. The larger the length of the pawl/lever, the greater the deflection, and the greater the velocity with which the pawl strikes the ratchet (ridges), and the greater the sound level. The length is limited by the need to pass each engaging ridge. The pawl material must be elastic (resiliently deformable). The material is selected to have a stiffness which is low enough to avoid being too rigid and breaking, and high enough to avoid too much elasticity. The second moment of area of the lever/pawl is determined by the width and thickness of the pawl. The thickness is cubed in one or more standard equations providing the maximum deflection, and so is the dominant factor. Using these characteristics of the pawl and smoking article, the pawl can be configured to generate an improved sound on movement of the pawl.

In some aspects, the Young's modulus of the sheet material forming the first and/or second indexing surface can be defined as greater than one of the following values: 2 GPa, 3 GPa, 4 GPa, 5 GPa, 6 GPa, 7 GPa, 8 GPa, 9 GPa, to GPa. A tensile strength for the sheet material forming the first and/or second indexing surface can be defined as greater than one of the following values: 50 MPa, 100 MPa, 150 MPa, 200 MPa, 250 MPa. For example, a 45 micron thick regenerated cellulose film, e.g. NATUREFLEX™ has a Young's Modulus approximately between 6.5 GPa and 7.5 GPa, for a strain rate of between 50%/min and 200%/min in the machine direction. A tensile strength for this material is between 140 and 180 MPa for a strain rate of between 50%/min and 200%/min in the machine direction.

In some aspects, the bending stiffness of the sheet material forming the first and/or second indexing surface can be defined using a Handle-o-meter as manufactured by Thwing-Albert™. For example, the bending stiffness for the sheet material as measured on the Handle-o-meter can be greater than a value selected from one: 30 g, 40 g, 45 g, 50 g, 55 g, 60 g, 65 g, 70 g, 80 g, 90 g, 100 g. For example the bending stiffness can be between 40 g and 60 g. The bending stiffness of a 45 micron thick regenerated cellulose film, e.g. NATUREFLEX™, is between 50 g and 55 g on this scale, and is approximately 55 g. An 85 micron thick polyethylene (PE) film is 50 g on this scale.

The above values can apply to the polymer layer only, to the polymer layer only in a laminate, or to the laminate as a whole. The first and/or second indexing surface can have a range between any two of the values mentioned.

In some examples, the smoking article generates a peak sound of at least 33 decibels (dB) at a distance of 750 mm. In particular, the smoking article generates a peak sound of at least 35 dB, or at least 37 dB, or at least 40 dB, or at least 41 dB, or at least 43 dB, or at least 46 dB at a distance of 750 mm. For example, the peak sound is between 40 dB and 46 dB, or between 41 dB and 45 dB.

The sheet material described in any embodiment defining the first indexing surface and/or second indexing surface may be selected from any one or more of the following options below or above, in any combination.

The sheet material may be paper, having an area density of greater than 40 g/m$^2$, greater than 60 g/m$^2$, greater than 80 g/m$^2$, or greater than too g/m$^2$. The paper may optionally be treated with an additive or stiffening agent to be more rigid, for example, starch, an adhesive (e.g. PVA glue) or shellac.

The sheet material may be a cast cellulose acetate film, for example, the film known as CLARIFOIL manufactured by Deutsche-Benkert. The film may have a thickness of approximately, or greater than, 20 μm, 50 μm or 100 μm. In some examples, the film has a thickness of between 20 and 50 μm.

In some examples, any sheet material described has a thickness selected from one of: 5 μm to 200 μm, 10 μm to 100 μm, or 20 μm to 80 μm, or 30 μm to 70 μm. These values apply in particular to the polymer materials. In some examples, the total thickness of the laminate material (e.g. including paper layer) can be from 0.1 mm to 0.5 mm, 0.1 mm to 0.3 mm, or from 0.15 mm to 0.25 mm.

The sheet material may be a cellulose acetate film formed from cellulose acetate tow. The tow is treated with at least one of steam, heat and pressure, and fed through an aperture. The cellulose acetate is optionally further rolled to form a film, which may have a thickness as mentioned above. The cellulose acetate film of any type can be considered as regenerated cellulose film, or generally, as a polysaccharide or polymer film.

The sheet material may be a cellulose film or sheet. For example, the cellulose film known as NATUREFLEX made by Innovia Films. The thickness of the film may be as mentioned in any embodiment above. This film may be transparent. The cellulose sheet is made of regenerated cellulose. The cellulose sheet is a polymer material. For example, the cellulose film may be the sheet material known as Cellophane™. The cellulose sheet is substantially pure cellulose. The cellulose sheet is not paper. The sheet is a polymer, in particular, a polymer of glucose. Any general property of this material can be used to describe the material. In one example, cellulose from wood or other sources is dissolved in alkali and carbon disulphide to make a solution called viscose, which is then extruded through a slit into a bath of dilute sulphuric acid and sodium sulphate to reconvert the viscose into cellulose. The film is then passed through several more baths, one to remove sulphur, one to bleach the film, and one to add glycerin to prevent the film from becoming brittle.

The sheet material may be a laminate of any two sheet materials. In particular, the sheet material may be a laminate of paper and plastic sheet, or paper and polymer sheet, or paper and cellulose acetate film (formed by any method) or paper and cellulose film. The sheet materials may be affixed together, for example with an adhesive, or may only be co-located without being affixed together. The polymer (plastic) layer can have any thickness mentioned in any other embodiment. The polymer or plastics material is a different type of material to paper.

In particular, the sheet material forming the first indexing section and pawl unit (second indexing section) may comprise a cellulose acetate film by itself or as a laminate.

The sheet material may be paper laminated with cellulose acetate film. Alternatively, an example sheet material forming the first indexing section is a laminate of 20 μm to 80 μm cellulose sheet affixed to a paper of at least 50 gsm. The plastics material or polymer material defines the exterior surface. A particular example for the pawl is regenerated cellulose sheet.

The polymer material of any embodiment can alternatively be defined as a biopolymer derived from a biological source, carbohydrate, starch, protein, polyorganic acid, alginate or any suitable polymer.

Any of the above materials, for example, the polymer materials or laminate sheet material, may be used for either or both of the first and second indexing surfaces, i.e. for forming the pawl and/or exterior of the filter. Any of the materials may also be used for the sleeve, or any other part of the smoking article. The first and second indexing surfaces may be formed of the same or different materials. For example, the pawl may be formed of a paper with a stiffening agent, or a laminate of paper and cellulose acetate film, and the corresponding grooved first indexing surface may be cellulose acetate film or a laminate of paper and cellulose acetate film. The depressions and ridges of the first indexing surface can be pre-formed in the sheet material prior to surrounding the filtration material, or formed after attachment to the filtration material.

In some examples, the material defining the first indexing surface and/or second indexing surface is configured to be sufficiently hard or rigid so as not to substantially deform as the second indexing surface is indexed. In one measure of hardness, a 3 mm rounded probe is applied to a planar sheet of material for wrapping around filtration material to define the first indexing surface. In some examples, the material is such that a deflection of 1 mm or more requires a force of at least one of: 0.5N (Newtons), 0.8N, 1N, 1.5N, 2N, 3N, 4N, 5N, 6N, 7N, 8N, 9N, 10N. However, other test of hardness or rigidity are applicable, and these figures can be taken as not limiting. In some examples, the type of material and/or thickness of material provides an alternative measure of hardness.

FIG. 19 shows an example of the first indexing section of any embodiment, which is formed on an exterior surface of the tobacco unit. A filter 212 comprises the first indexing section 218 on an exterior surface, as described above. The first indexing section 218 comprises a plurality of longitudinally extending grooves 217 separated by longitudinally extending ridges 216. The plurality of ridges 216 and grooves 217 may define a substantially continuous surface, and may define a sinuous outer surface, which smoothly oscillates in radius or substantially squared steps. The ridge between adjacent depressions may have a curved profile with a substantially uniform radius of curvature. The ridge between adjacent depressions defines a single circumferential point of maximum resistance to movement of the engaging feature between the adjacent depressions. The grooves 217 are dimensioned to receive a pawl, as described in any embodiment. The groove 217 is dimensioned to have a larger radial extent than the pawl. The groove 217 has a circumferential extent which allows for vibration of the pawl, allowing the pawl to generate an audible sound when rotated into a groove.

The filter 212 comprises an outer layer of sheet material 214, which defines the grooves and ridges. The sheet material 214 contains filtration material 215, which may be a conventional cellulose acetate tow. The sheet material 214 is a relatively rigid sheet material, which may be formed by paper or cellulose acetate, or a laminate of paper and cellulose acetate. The paper may be treated with one or more additives to increase rigidity.

Alternatively, the first indexing section may be formed on a tubular member formed of cellulose acetate or paper, which is affixed around a filter or tobacco rod. The exterior surface of the first indexing section is the same as described above.

FIGS. 20*a* to 29 show five embodiments and manufacturing methods for forming the collar 47 described in FIG. 4. The smoking article in each of the five embodiments is substantially as described with reference to FIG. 4 unless described to the contrary, and the same reference numerals indicate the same parts.

FIGS. 20*a*,20*b* and 21 show a first type of collar 247. The collar 247 has an integral pawl (not shown), comprising a radially inwardly extending ridge. The collar 247 may be formed of cellulose acetate. The collar 247 with pawl may be formed by extrusion. A plurality of collars 247 are formed by extrusion in a continuous tube, which is then cut to length (approximately 5 mm for each collar 247).

The collar 247 may optionally be located on the first indexing section 48 after the first indexing section 48 has been formed around a filter 42. The collar 247 with pawl defines an inner radial space which is smaller than then filter 42, since the pawl is configured to engage with the first indexing section 48. The formed collar 247 is slid onto the filter 42 by compressing the filter 42 with a collet 248. The collar 247 is optionally located around a mandrel (not shown). The mandrel assists in sliding the collar 247 onto the filter 42 before the filter is compressed by the collet. The collar 247 is slid along the filter 42, compressed by the collet 248, until located around the first indexing section 48. The collet 248 extends longitudinally at each side of the collar 247, and is configured to only compress the filter around the collar 247.

FIG. 20*b* shows a front elevation view of the collet 248. The collet 248 is formed in three equal parts 248*a*,248*b*, 248*c*, defining between them a substantially circular cross-section. The three parts 248*a*,248*b*,248*c* are movable radially to decrease the diameter of the defined cross-section and compress the filter, and increase the diameter to allow easy removal of the collet 248.

FIG. 21 shows the insertion of two collars 247 onto a double-length filter 42' having two first indexing sections 48. A sleeve 43 is also shown prior to wrapping around the double-length filter 42'.

FIGS. 22 and 23 show a second type of collar 257. The collar 257 is formed in two separate parts 257*a*,257*b*, which are joined together around the first indexing section. The two parts 257*a*,257*b* are strips of sheet material, for example cellulose acetate. The two parts 257*a*,257*b* are strips of material which extend laterally to a longitudinally axis of the filter, and are connected longitudinal joins 255*a*,255*b*. The parts 257*a*,257*b* may overlap and the overlapping sections connected, for example, by adhesive, heat sealing or any suitable means. The joins 255*a*,255*b* may be fin seals, and protrude radially outwardly. The joins may be formed by heat seals. One of the parts 257*a* comprises a radially inwardly extending ridge defining pawl 259. The pawl 259 may be formed with rollers prior to bringing the strip into contact with the filter.

The collar 257 is formed by bringing two strips of sheet material around the first indexing section. Each strip is longer than is required to form the two parts 257*a*,257*b*. A first end of the strips is connected to form the join 255*a*. The strips surround the first indexing section, and are brought together at a diametrically opposite point to form the join 255*b*. The strips are cut by a cutting mechanism 252, which may comprise oppositely moving blades, to remove excess material 256*a*, 256*b* from each strip.

FIG. 23 shows a plurality of collars 257 being formed around an elongate filter rod 42' for forming a plurality of smoking articles, for example four. The two strips of sheet material for forming each collar 257 have been located around the first indexing sections. The first join 255*a* on each collar has been made. In some aspects, the first join 255*a* is made prior to the filter 42' being inserted between the strips 255*a*,255*b*. The second join 255*b* has not yet been made, and the excess material 256*a*,256*b* has not yet been removed.

FIGS. 24 and 25 shows the manufacture of a third type of collar, formed from collar blank 267. The collar is formed from a single strip of sheet material 267, for example cellulose acetate. A pawl 269 is formed on the collar blank 267 prior to attachment to the first indexing section 48 of the smoking article. The first indexing section 48 may be formed on a filter, or other part of the smoking article as described in any embodiment, and so the part of the smoking article will be referred to generally as the first indexing section 48. The collar comprises the strip of sheet material circumscribing the first indexing section 48, with opposite longitudinal sides overlapping and affixed together with a permanent adhesive.

The collar is formed using the follow method of manufacture. The collar blank 267 is temporarily affixed to a part of the smoking article which the collar will surround. A temporary adhesive affixes the blank 267 of sheet material for forming the collar to the first indexing section 48. In some examples, the collar blank 267 is affixed adjacent, or at, an edge. The attached edge extends longitudinally, parallel to a longitudinal axis of the first indexing section 48 and smoking article. The temporary adhesive is configured to secure the collar blank 267 in position during manufacture of the cylindrical collar, and then release to allow rotation between the collar and the first indexing section 48.

FIG. 25 shows the wrapping of the collar blank 267 around the first indexing section 48, to which the collar blank 267 is temporarily affixed. The first indexing section 48 and collar blank 267 are in contact with an exterior of a first roller 267. The first indexing section 48 is additionally in contact with an exterior surface of a second roller 262. The rollers 261 are configured to contact the first indexing section 48 on diametrically opposed slides.

The rollers 261,262 are configured to rotate. The areas of the rollers 261,262 in contact with the first indexing section 48 are configured to move in opposite directions. As shown, the area of contact of the first roller 261 move to the right, and the area of contact of the second roller 262 moves to the left. This opposite movement is achieved by both rollers 261,262 rotating in the same rotational direction, i.e. clockwise. In some examples, the linear movement of each of the rollers 261,262 is equal and opposite.

The first indexing section 48 is urged to rotate about its longitudinal axis by the rollers 261,262, in an anti-clockwise direction as shown. The collar blank 267 is configured to initially extend away from the first indexing section 48 to wrap around the first indexing section 48 when the first indexing section 48 rotates. The temporary attachment of the collar blank 267 to the first indexing section 48 means that the collar blank 267 is drawn around the first indexing section 48, instead of the first indexing section 48 merely rolling over the collar blank 267 without being wrapped around. The equal and opposite linear movement of the rollers 261,262 means that the absolute position of the first indexing section 48 does not change as the first indexing section 48 rotates. The collar blank 267 may have a permanent adhesive applied, such that when the opposite longitudinal sides overlap they are affixed together with the permanent adhesive to secure the collar blank 267 as a cylinder.

The first indexing section 48 may contact an area 264 of the second roller 262, which has a smaller diameter than surrounding areas of the second roller 262. The area 264 has a circumferential extent which is sufficient for the collar blank 267 to wrap around the first indexing section 48. A radially extending step 264*a* defines a circumferential edge of the area 264. The first roller 261 has an area of smaller diameter (not shown), which in use, corresponds with the area 264 adjacent the step 264*a*. The smaller diameter area of the first roller 261, optionally in combination with the edge 264*a*, urges or allows the first indexing section 48 out of contact with the first and second rollers, so that the first indexing section 48 with attached collar can be processed further.

FIGS. 26*a* to 26*c*, and 27, show a fourth type of collar, formed from collar blank 277. The collar is formed from a single strip of sheet material 277, for example cellulose acetate. A pawl 279 is formed on the collar blank 277 prior to attachment to the first indexing section 48 of the smoking article. The first indexing section 48 may be formed on a filter, or other part of the smoking article as described in any embodiment, and so the part of the smoking article will be referred to generally as the first indexing section 48.

The collar blank 277 is located on the first indexing section 48, such that initially only a part of the collar blank 277 is in contact with the first indexing section 48. In some aspects, a laterally central part of the collar blank 277 is in contact with the first indexing section 48. A first part 277*a* of the collar blank 277 extends from the first indexing section 48 on one side, and a second part 277*b* of the collar blank 277 extends from the first indexing section 48 on the other side. The collar blank 277 may be in contact with a bottom part of the first indexing section.

The first part 277*a* is wrapped around the first indexing section 48. After the first part 277*a* has been folded against the first indexing section 48, the second part 277*b* is then wrapped against the first indexing section 48. The first and second parts 277*a*,277*b* are therefore wrapped consecutively. The second part 277*b* may be provided with an adhesive configured to attach the second part 277*b* to the first part 277*a* and secure the blank 277 as a cylinder.

FIG. 27 shows a schematic view of a possible apparatus for forming a plurality of first indexing section 48 each having a collar. A continuous length of sheet material 278 is obtained from a bobbin 272, on which is formed a continuous ridge defining a pawl 279. The sheet material 278 is cut into a plurality of collar blanks 278. The collar blanks 278 are then partially folded into a U-shape around a laterally central point, and wrapped around an elongate rod 48' defining a plurality of first indexing sections 48. The collar blanks 278 are located around the first indexing sections 48, and the ends 277*a*,277*b* consecutively folded down and attached together.

FIG. 28 shows a fifth type of collar 287 in a smoking article 280. The smoking article comprises a tobacco rod 41, first filter 42 and second filter 44. The first filter 42 and second filter 44 may be connected together by a central core, allowing relative rotation, as described previously. Alternatively, the first and second filter may be separate filter sections with no connecting core. The first and second filters are connected by the surrounding layers of sheet material.

The smoking article 280 comprises a first indexing section 48 substantially as described above, formed in an exterior surface of first filter 42. The first filter 42 comprises filtration material (and optionally an adsorbent additive), surrounded by a sheet material. The sheet material defines an exterior surface of the filter 42, and may be deformed to define the grooves and ridges of the first indexing section 48 prior to surrounding the filtration material. Sheet material may be a film of cellulose acetate, or other sheet material having a relatively high rigidity, e.g. treated paper, or a laminate of cellulose film or cellulose acetate film and paper. The first and second filters 42,44 are surrounded by the collar 287. The collar is formed from a single strip of sheet material, for example cellulose acetate. A pawl 289 is formed on the collar blank 287 prior to attachment to the first indexing section 48 of the smoking article. The collar 287 is adhered to the second filter 44 only, and is not attached to the first filter 42. The collar 287 extends the whole length of the first and second filters 42,44, and may be formed in a manner similar to a known method for attaching plugwrap around filtration material.

The collar 287 is surrounded by a sleeve 283. The sleeve 283 is formed from a sheet material wrapped around the first and second filters 42,44 and tobacco rod 41. The sleeve 283 secures the first filter 42 to the tobacco rod 41, and so functions as a conventional tipping paper. The sleeve 283 is secured to the collar 287, for example at only a rearward end, surrounding the second filter 44.

The sleeve 283, and optionally also the collar 287, comprises a separation line 285, which extends substantially circumferentially. The separation line 285 in the sleeve 283 and collar 287 are aligned. The sleeve 283 and collar 287 are configured to easily break along the separation line 285 into a forward part 283*b*,287*b* and a rearward part 283*a*,287*a*. The rearward part is affixed to the second filter 44. The forward part is affixed to the first filter 42, and the forward part 283*b* of the sleeve 283 is also attached to the tobacco rod, for example by adhesive. The separation line 285 may be defined by a plurality of perforations through the sheet material of the sleeve 283 and collar 287. In use, the forward and rearward parts of the sleeve are initially connected. The smoking article has a defined initial ventilation, and a pre-determined initial alignment of the first and second ventilation apertures (not shown). The sleeve is not readily rotatable (or slidable) relative to the tobacco unit. Application of a rotational force to the rearward part 283*a* of the sleeve, relative to the tobacco unit, breaks the sleeve and collar along the separation line 285. The sleeve 283 is then freely rotatable, subject to the indexing mechanism 48,289, to vary the ventilation by alignment of the first and second ventilation apertures. The sleeve 283 and tobacco unit 41,42 remain connected since the second filter sections have a connected central core.

Alternatively, the collar 287 may not have a separation line, and the separation line 285 in the sleeve is forwardly of the collar 287. Alternatively, the sleeve 283 is initially formed in two separate parts, which independently connect the first filter to the tobacco rod, and rotates around the first filter.

FIG. 29 shows a smoking article 290 according to the present invention. The features of smoking article 290 may be present in combination with any embodiment of indexing mechanism. The smoking article 290 comprises a tobacco rod 291, first filter 292 and second filter 294, arranged as described above. A sleeve blank 293 is shown before forming into a cylindrical sleeve, as described above. The first filter 292 may optionally comprise an adsorbent additive, for example, carbon in the form of charcoal distributed within the filtration material.

The smoking article 290 comprises and an inner rotary body 295*b* (first indexing part) and an outer rotary body 295*a* (second indexing part). The outer rotary body 295*a* is rotatable relative to, and around, the inner rotary body 295*ba*. The outer rotary body 295*a* and inner rotary body 295*b* define the indexing mechanism, configured to provide for a plurality of indexed rotational positions as described above. One or both of the outer rotary body 295*a* and inner rotary body 295*b* are formed of a plastics material. The outer rotary body 295*a* and inner rotary body 295*b* are located axially between the first filter 292 and second filter 294.

The inner rotary body 295*b* comprises a first indexing section 298. The first indexing section 298 is substantially as described in any other embodiment, having a plurality of longitudinally extending ridges 298*a* and grooves 298*b*. The grooves 298*b* may be in the form of apertures. The ridges 298*a* may be in the form of a circumferentially extending ladder, i.e., or a plurality of spaced apart longitudinally extending bars supported by circumferential supports. Alternatively, the grooves may be in the form of recesses. In some embodiments, the annular first indexing section 298 defines a chamber within the first indexing section 298.

The outer rotary body 295*a* comprises a second indexing section comprising a radially inwardly extending pawl 299. The pawl 299 is configured to releasably engage with ridges 298*a* to form an indexing mechanism. The first and second indexing surfaces engage radially. The pawl 299 may be integrally formed with the outer rotary body 295*a*, or may be affixed to the outer rotary body 295*a*.

The inner rotary body 295*b* has a stepped outer surface. At least some of the first indexing part is located radially within the second indexing part such that the first and second indexing surfaces are engaged. A forward part has a smaller diameter than a rearward part. The forward part is configured to fit within the outer rotary body 295*a*. The rearward part is configured to locate rearwardly of the outer rotary body 295*a*, and has substantially the same diameter as the outer rotary body 295*a*. The first indexing section is attached within the forward part of the inner rotary body 295*b*. A retaining tab (not shown) maintains the inner and outer rotary bodies 295*a*,295*b* from being pulled apart, once connected.

A sheet material (not shown) connects the outer rotary body 295*a*, first filter 292, tobacco rod 291. The sheet material may be paper, e.g. tipping paper. At least some of the first indexing part has a same external diameter as the second indexing part.

The sleeve 293 is provided with one or more first ventilation apertures, substantially as described with respect to FIG. 13 or any embodiment. The tobacco unit 291,292,295*a* comprises one or more second ventilation apertures (not shown), substantially as described with respect to FIG. 13 or any embodiment. Relative rotation between the sleeve 293 and tobacco unit, as controlled by the indexing mechanism, determines the overlap of the first and second ventilation apertures. The sleeve 293 may comprise one or more further ventilation apertures 296, substantially as described with respect to FIG. 13 or any embodiment providing a base level of ventilation.

The sleeve 293 is affixed to the second filter 294 and inner rotary body 295*b*. The first indexing section 298 is rotatable with the sleeve 293 and mouthpiece filter, as described for the second indexing section in the embodiments above. The second indexing section 299 is rotatable with the source of smokable material, as described for the first indexing section in the embodiments above. The sleeve 293 is rotatable relative to the outer rotary body 295*a*.

The sleeve 293 comprises separation line 297, which extends substantially circumferentially. The sleeve is configured to easily break along the separation line 297 into a forward part and a rearward part, substantially as described in FIG. 14. The sleeve 293 and tobacco unit 291,292 may remain connected by the pawl 299 engaged in the first indexing section 298 preventing longitudinal movement between the first and second parts of the smoking article.

FIG. 30 shows a smoking article 300 having a first embodiment of indexing mechanism of a second family. The smoking article 300 comprises a tobacco rod 301, first filter (not shown) and second filter (not shown), arranged as described above. A sleeve 303 is movable relative to the tobacco rod 301, as described above. The sleeve 303 and first filter or tobacco rod comprise ventilation apertures as described above, which may be selectively aligned by rotation between the parts of the smoking article.

A first indexing section is the same as the first indexing section 18 described above. The second indexing surface comprises a pawl 306 engageable with the first indexing section to form an indexing mechanism. The pawl 306 comprises one or more protruding male features formed on an interior surface of the sleeve 303. The pawl 306 is a radially inwardly projecting boss on the sleeve 303. The boss 306 may be substantially hemispherical in shape, having an apex extending radially inwardly. The boss 306 may be formed of adhesive, for example, as a pip or a dot of adhesive. The adhesive is affixed to the interior surface of the sleeve. The adhesive is not tacky when in contact with the tobacco unit. The pawl 306 is configured to index on the surface of the first indexing section of the filter. Alternatively, the boss 306 may be formed by embossing or punching the sheet material to define a raised feature forming the second indexing surface. Alternatively, the boss 306 may be formed by an attached section of sheet material, for example, affixing by adhesive.

The sleeve 303 comprises one or more ventilation aperture 309. The aperture 309 may be in the form of a circumferentially extending slit or slot. The aperture 309 is selectively alignable with one or more ventilation apertures 310 in the first part of the smoking article. The tobacco unit may comprise a plurality of discrete ventilation apertures spaced circumferentially. The overlap between the ventilation apertures 309,310 determines the ventilation.

FIG. 31 shows the sleeve 303 in isolation. The sleeve 303 comprises sheet material, for example an air impermeable paper formed in a cylinder with an overlapping seam. The boss 306 is shown on an inner surface of the sleeve 303, for example formed as a dot of adhesive (glue).

FIG. 32 shows a smoking article 320 having a second embodiment of indexing mechanism of a second family. The smoking article 320 comprises a tobacco rod 321, first filter (not shown) and second filter (not shown), arranged as described above. A sleeve 323 is movable relative to the tobacco rod 321, as described above. The sleeve 323 and first filter or tobacco rod comprise ventilation apertures as described above, which may be selectively aligned by rotation between the parts of the smoking article.

A first indexing section has substantially the same grooves and ridges as the first indexing section 18 described above. However, the first indexing section is formed on an interior surface of the sleeve 323. The second indexing mechanism comprises a pawl 326 engageable with the first indexing section to form an indexing mechanism. The pawl 326 comprises one or more protruding male features formed on an exterior surface of the first filter (or tobacco rod). Alternatively, the pawl 326 may be raised ink and printed on an exterior of the first filter, or may be attached to the exterior of the first filter with adhesive, e.g. a hot melt adhesive. The pawl 326 engages with recesses formed in the sleeve 323 to provide a plurality of indexing positions to control rotational movement of the sleeve. The pawl 326 is a radially outwardly projecting boss on the sleeve 323. The boss 326 may be substantially hemispherical in shape, having an apex extending radially outwardly. The boss 326 may be formed of adhesive. The adhesive is affixed to the exterior surface of the first filter or tobacco rod. The adhesive is not tacky when in contact with the sleeve.

The sleeve 323 comprises one or more ventilation aperture 329. The aperture 329 may be in the form of a circumferentially extending slit or slot. The aperture 329 is selectively alignable with one or more ventilation apertures 330 in the first part of the smoking article. The tobacco unit may comprise a plurality of discrete ventilation apertures spaced circumferentially. The overlap between the ventilation apertures 329,330 determines the ventilation.

FIGS. 33 and 34 show parts of a smoking article having an indexing mechanism of a third family. The smoking article comprises a tobacco rod, first filter 332 and second filter (not shown), arranged as described above. A sleeve 333 is movable relative to the tobacco rod, as described above. The sleeve 333 and first filter or tobacco rod comprise ventilation apertures as described above, which may be selectively aligned by rotation between the parts of the smoking article.

A first indexing section 338 has substantially the same grooves and ridges as the first indexing section 18 described above. However, the first indexing section is formed on an interior surface of the sleeve 333. The second indexing mechanism comprises a pawl 339 engageable with the first indexing section to form an indexing mechanism. The pawl 339 comprises one or more protruding male features formed on an exterior surface of the first filter 332.

FIG. 33 shows the filter 332 comprising an outer layer of sheet material 334, which defines the pawl 339. The sheet material 334 contains filtration material 335, which is may be a conventional cellulose acetate tow. The sheet material 334 is a relatively rigid sheet material, which may be formed by paper or cellulose acetate, or a laminate of paper and cellulose acetate. The paper may be treated with one or more additives to increase rigidity. The pawl 339 may be formed as a tab of two layers of sheet material adhered or bonded together and extending radially outwardly from the filtration material 335. The pawl 339 may be formed by a join which secures the sheet material in a cylinder, for example, a fin seal or lap seam. In some aspects, interior surfaces of the sheet material at opposite longitudinal sides are brought together and permanently joined, for example, by one or more of heat, pressure and/or adhesive.

The filter 332 may comprise one or more sections. As shown, the filter 332 may a forward section 332*a* and a co-axial rearward section 332*b*. The forward section 332*a* and rearward section 332*b* comprise conventional filtration material, e.g. cellulose acetate tow, surrounded by the sheet material 334 forming the pawl 339. The forward section 332*a* and rearward section 332*b* are spaced apart longitudinally to define a cavity 332*c* containing adsorbent additive 331. The adsorbent additive 331 may be granules of carbon, for example in the form of charcoal, or any suitable adsorbent additive. The sheet material 334 connects the forward and rearward sections 332*a*,332*b*, and contains the adsorbent additive 331 within the cavity 332*c*.

Alternatively, the filter 332 may comprise only a single section of filtration material 335 surrounded by the sheet material 334. Alternatively, the cavity containing adsorbent additive may be located between the first filter attached to the tobacco rod and a second filter attached to the sleeve.

FIG. 34 shows a cross-section through the sleeve 333. The interior of the sleeve 333 defines the first indexing section, having alternating ridges 336 and grooves 337. The first indexing section is configured to engage and index with the tab forming the pawl 339. The profile of the ridges 336 and grooves 337 may be triangular as shown, or may be sinuous and rounded as described above, or have any profile suitable for engaging the pawl 339.

FIG. 35 shows parts of a smoking article having an indexing mechanism of a fourth family. The smoking article comprises a tobacco rod, first filter 352 and second filter (not shown), arranged as described above. A sleeve 353 is movable relative to the tobacco rod and first filter, as described above. The sleeve 353 and first filter 352 or tobacco rod comprise ventilation apertures as described above, which may be selectively aligned by rotation between the parts of the smoking article.

A first indexing section 358 has substantially the same grooves and ridges as the first indexing section 18 described above. The second indexing mechanism comprises grooves and ridges substantially as described for the first indexing section, formed on an interior surface of the sleeve 353. The sleeve 353 defines a plurality of longitudinally extending pawls 359 in the form of ridges, which are engageable with the ridges of the first indexing section to form an indexing mechanism.

The sleeve 353 comprises an outer layer 353*a* and an inner layer 353*b*. The inner layer 353*b* may optionally be corrugated to define the ridges and grooves of the second indexing section, as is described above for the first indexing section. In particular, the corrugations are formed by a combination of steam, starch and rollers. The corrugated inner layer 353*b* is wrapped around the first filter 352. The outer layer 353*a* is wrapped around, and affixed to, the inner layer 352*b*. The outer layer 353*a* is not corrugated, and has a smooth cylindrical exterior surface.

FIGS. 36,37*a* and 37*b* show a smoking article 360 having an indexing mechanism of a fifth family. The smoking article 360 comprises a tobacco rod 361, first filter 362 and optionally a second filter (not shown), arranged as described above. A sleeve 363 is movable relative to the tobacco rod 361, as described above. The sleeve 363 and first filter or tobacco rod comprise one or more ventilation apertures 366*a* in the tobacco unit, and one or more ventilation apertures 366*b* in the sleeve, substantially as described above, which may be selectively aligned by rotation between the parts of the smoking article.

A first indexing section 368 is formed on the tobacco unit, and may overlie the first filter 362. The first indexing section 368 comprises a profiled edge which extends radially outwardly from the first filter 362, and defines a step increase in diameter from an area forwardly of the first indexing section 368. The first indexing section 368 is profiled in a longitudinal, or axial, direction. The first indexing section 368 extends to a uniform diameter, and so is profiled in a plane perpendicular to the first indexing section 18 described above. The longitudinal profile of the first indexing section 368 defines ridges and grooves, i.e. alternating sections of varying longitudinal position. The longitudinal position of the first indexing section 368 may vary smoothly around the circumference, or may be stepped. The first indexing section 368 may be formed by one or more layers of sheet material overlying the first filter or tobacco rod, and defining a profiled edge at a forward end.

The sleeve 363 comprises a second indexing section 369, configured to engage with the first indexing section 368 to form an indexing mechanism. The second indexing section 369 comprises one or more protrusions 369*a* which extend radially inwardly. The protrusions are circumferentially spaced, for example adjacent a forward edge of the sleeve 363. The protrusions 369*a* are positioned to locate in the grooves of the first indexing section 368, i.e. the parts of the first indexing section 368 which are relatively longitudinally rearwardly. The protrusions of the second indexing section 369 are configured to resiliently deform longitudinally forwardly and/or radially outwardly in order to rotate from one groove to another. The resilient deformation provides for a rotational indexing of the first and second parts of the smoking article.

The smoking article further comprises a restraining means for limiting longitudinal movement of the sleeve 363 over the first filter 362. The tobacco unit comprises a first engaging surface 367*b* adjacent a rearward end, extending radially outwardly. The first engaging surface 367*b* is a step increase in diameter over an area rearwardly of the first engaging surface 367*b*. The sleeve 363 comprises a second engaging surface 367*a* formed on an interior surface of the sleeve 363. The second engaging surface 367*a* adjacent a rearward end, and extends radially inwardly. The second engaging surface 367*a* is a step decrease in diameter over an area forwardly of the second engaging surface 367*a*. In some aspects, the second engaging surface 367*a* is formed by folding inwardly and forwardly a section of blank for forming the sleeve. The second engaging surface 367*a* is formed in sections separated by cut-outs, since the material is the same as the surrounding sleeve 363, although the circumference of the second engaging surface 367*a* is smaller than the surrounding cylindrical tube forming the sleeve. The first engaging surface 367*b* and second engaging surface 367*a* engage to allow free rotational movement between the sleeve 363 and tobacco unit, and prevent forward movement of the sleeve 363 over the tobacco unit. In some embodiments, a second filter is attached within the mouthpiece end of the sleeve.

FIG. 37*b* shows an enlarged view of a protrusion 369*a* of the second indexing section 369. The protrusion 369*a* is formed by a part of the sheet material of the sleeve being deformed radially inwardly. In some examples, a circumferentially extending cut 369*b* through the sleeve material precisely defines a rearward edge of the protrusion 369*a*. The sheet material is deformed forwardly of the cut 369*b*, and not deformed rearwardly of the cut 369*b*. Alternatively, a forward edge of the sleeve 363 may be deformed inwardly to form circumferentially spaced protrusions without a circumferential cut.

In the embodiment shown in FIG. 37*a*, the sleeve 363 is not attached to a second filter. Alternatively, the sleeve 363 may be attached to a second filter, rearwardly of the first filter 362, which may prevent forward movement of the sleeve. The smoking article may not comprise the first and second engaging surfaces 367*a*,367*b* for preventing forward longitudinal movement.

FIG. 38 shows a smoking article 380 having a further embodiment of indexing mechanism related to the first family described above. In particular, the indexing mechanism is related to the embodiment shown in FIG. 2, and the features are the same unless described as different. The smoking article 380 comprises a tobacco rod, first filter 382 and second filter, arranged as described above. A sleeve 383 is shown formed as a cylindrical sleeve, as described above. The indexing mechanism comprises a first and second indexing section, and a limiting mechanism to limit rotation between the first and second parts of the smoking article 380.

The first indexing section 388 is the same as the first indexing section 18 described above. In particular, the first indexing section 388 is formed on an exterior surface of the first filter 382, and preferably on a corrugated layer of sheet material surrounding filtration material.

The second indexing mechanism comprises a pawl 389 engageable with the first indexing section 388 to form the indexing mechanism. The upstanding pawl 389 is formed on a pawl unit 387. The pawl unit 387 comprises the pawl 389 and a part of the limiting mechanism, as will be described below. The pawl unit 387 may be formed from a single strip of sheet material. The sheet material may be folded to define pawl 389, in the form of a ridge having a substantially triangular cross-section protruding radially inwardly.

The pawl unit 387 is affixed to the sleeve 383 or a tubular pawl support unit, for example by adhesive. The pawl unit 387 is affixed at each side of the ridge to maintain the triangular cross-section of the pawl 389. The pawl unit 387 extends circumferentially over only a part of the circumference of the sleeve 383.

The pawl unit 387 comprises a first stop 381*a* and a second stop 381*b*. The first stop 381*a* and second stop 381*a* are formed at, or adjacent, circumferential ends of the pawl unit 387. The first stop 381*a* and second stop 381*b* extend radially inwardly from the sleeve 383, for example by a distance less than the pawl 389.

The smoking article 380 further comprises a first contact surface 386*a* and a second contact surface 386*b*. The first contact surface 386*a* and second contact surface 386*b* are configured to engage with the first stop 381*a* and second stop 381*b* respectively to limit the rotational range of the pawl unit 387 relative to the first indexing section 388. The first contact surface 386*a* and second contact surface 386*b* extend radially outwardly from the first indexing section 388. The limiting mechanism comprises the first and second stops 381*a*, 381*b* and first and second contact surfaces 386*a*, 386*b*. The first and second contact surfaces 386*a*, 386*b* may be formed on a limiting unit 385, for example in the form of a cylindrical tube arranged between the first indexing section 388 and the sleeve 383. The limiting unit 385 is affixed to an exterior surface of the first indexing section.

The limiting unit 385 defines a window 385*a*, in the form of an aperture extending circumferentially. The first and second contact surfaces 386*a*, 386*b* are the circumferential ends of the window 385*a*. The pawl unit 387 is located within the window 385*a*. The pawl unit 387 and limiting unit 385 are both located adjacent an interior surface of the sleeve 383, and are configured to abut each other to limit rotation. In particular, the first stop 381*a* is configured to abut against the first contact surface 386*a* to limit rotation in an anti-clockwise direction, and the second stop 381*b* is configured to abut against the second contact surface 386*b* to limit rotation in a clockwise direction. The first indexing section may optionally extend around the whole circumference of the first filter. The window 385 allows only a part of the circumference to be accessed by the pawl unit 387, limiting the range of rotation.

Alternatively, the first and second contact surfaces 386*a*, 386*b* may not be formed by a window of a cylindrical tube. The first and second contact surfaces 386*a*, 386*b* may be formed by strips of sheet material extending longitudinal and affixed to the first indexing section, or may be integrally formed with the first indexing section.

FIG. 39 shows the pawl unit 387 described in FIG. 38 in more detail. The pawl unit 387 comprises an upstanding pawl 389, which extends radially inwardly. The pawl 389 extends from a base 393, which is curved to locate within a cylindrical sleeve.

The pawl unit 387 further comprises the first and second stops 381*a*, 381*b*. The first and second stops 381*a*, 381*b* are each formed at circumferential ends of the pawl unit 387. The first and second stops 381*a*, 381*b* may be formed by folds in the sheet material of the pawl unit 387. The first and second stops 381*a*, 381*b*, pawl 389 and base 393 are all integrally formed from a single strip of sheet material. The sheet material may be paper, a polymer film (e.g. regenerated cellulose, cellulose acetate), or a laminate (e.g. of paper and regenerated polymer cellulose acetate). The pawl of any embodiment can comprise any material described in any embodiment.

The first and second stops 381*a*, 381*b* have a triangular cross-section, and are located centrally on the circumferential edge of the pawl unit 387. The first and second stops 381*a*, 381*b* are each formed by a circumferentially extending fold 391*a*,391*b* in the base 393. The folds 391*a*,391*b* extend in a plane perpendicular to the folds forming the pawl 389. The folds 391*a*, 391*b* have a similar arrangement to the folds forming the pawl 389, each defining a fold at the apex, and two folds either side bringing the sheet material from the base 393 to the apex. The folds 391*a*,391*b* provide radially inwardly extending stops 381*a*, 381*b*, which have a largest radial extent at a circumferential edge of the pawl unit 387. The folds 391*a*,391*b* extend over only a part of the base 393, and taper down to the base 393 to be spaced from the pawl 389. The circumferential edges of the first and second stops 381*a*, 381*b* is configured to abut against first and second contact surfaces to limit the range of rotation of the first and second parts of the smoking article.

The first and second stops 381*a*, 381*b* may be formed by folding the sheet material of the pawl unit 387. Alternatively, the pawl unit 387 may be permanently deformed to form the first and second stops 381*a*, 381*b*, or the pawl unit 387 initially formed having the first and second stops 381*a*, 381*b*.

FIG. 40 shows an enlarged view of a part of the pawl unit 387, showing the pawl 389, and prior to the base 393 being curved to locate within a cylindrical sleeve. As previously described, the pawl 389 comprises an upstanding ridge having a substantially triangular cross-section, and formed of a single piece of sheet material. The sheet material is folded at folds 395*a*,395*b* to define two sides 396*a*,396*b* extending from the base 393. The sides 396*a*,396*b* meet at a fold 395*c* defining an apex of the triangular cross-section of the pawl 389. The pawl 389 is formed with an angle θ between the legs 396*a*,396*b*, which is selectable to determine the indexing properties of the pawl 389. In particular, the angle θ may, in part, determine the resistance force required to move between indexing positions, and a volume of audible sound generated by the move between indexing positions. The angle θ subtended by the pawl in the smoking article may be between 10 and 30 degrees, and more particularly between 15 and 25 degrees, and more particularly is exactly or approximately 20 degrees.

FIGS. 41*a* and 41*b* show two examples of a profile of a first indexing section 418,418' as described in any embodiment. The first indexing sections 418,418' define a plurality of grooves 417,417' separated by ridges 416,416'. The first indexing section 418,418' are shown prior to being formed onto a cylindrical surface. The ridges 416,416' have substantially straight sides, and define a substantially triangular cross-section. The ridges 416' may define a substantially single point of maximum radial extent, for example as shown in FIG. 41*b*. In some examples, the ridges of the first indexing surface have a define a radius of curvature over at least part of the surface of between 0.2 mm and 0.8 mm, or between 0.4 mm and 0.6 mm. Alternatively, the ridges 416 may define a land having a circumferential extent at a maximum radial extent, as shown in FIG. 41*a*. The single point of maximum radial extent can extend over a short circumferential extent. In some examples, the land or maximum radial extent has a circumferential extent of less than one of: 1 mm, 0.9 mm, 0.8 mm, 0.7 mm, 0.6 mm, 0.5 mm, 0.4 mm, 0.3 mm, 0.2 mm or 0.1 mm.

The grooves 417,417' are configured to provide for indexing positions in which a pawl of any embodiment is releasably located. The grooves 417,417' and ridges 416,416' are also preferably configured to allow generation of an audible sound when a pawl is moved between adjacent grooves 417,417'. The sound may be provided by grooves 417,417' having dimensions sufficient to allow for vibration of the pawl.

The grooves 417,417' and ridges 416,416' have an interval d,d' defined as the circumferential distance between the centres of adjacent grooves or ridges. The interval d,d' may be between 0.9 mm and 1.7 mm, and more particularly between 1 mm and 1.5 mm and more particularly between 1.1 mm and 1.4 mm. In some aspects, the interval d is approximately 1.4 mm and the interval d' is approximately 1.15 mm.

The ridges 416,416' subtend an angle Φ, Φ' between adjacent ridges 416,416', which also defines the angle subtended by the grooves 417,417'. The angle Φ, Φ' may be between 20 and 80 degrees, 30 and 70 degrees, 40 and 60 degrees, and more particularly between 45 and 50 degrees. In some aspects, the angle Φ is approximately 47.5 degrees and the angle Φ' is approximately 49 degrees. For embodiments in which the sloped sides are not planar, the above angles can apply to angles between radial mid-points of the ridges, a planar approximation of the ridges, or the peak or centre of the ridges.

The ridges 416,416' have a radial extent l,l' defined as the radial distance from the centre of a groove 417,417' to the centre of an adjacent ridge 416,416'. The radial extent l,l' may be between 0.2 mm and 1.8 mm, 0.4 mm and 1.4 mm, and more particularly between 0.6 mm and 1.2 mm and more particularly between 0.9 mm and 1.1 mm. In some examples, the radial extent l is approximately 0.94 mm and the radial extent l' is approximately 1 mm.

In some examples, the radial extent of the material defining the first indexing surface (i.e. around the filtration material) of any embodiment (or second indexing surface) can be from 0.1 mm to 0.8, or from 0.2 mm to 0.7 mm, or from 0.1 mm to 0.4 mm, or from 0.2 mm to 0.3 mm, or any range including any mentioned value. In some examples, the corrugated structure of the sheet material forming the first indexing surface can have an overall thickness of from 0.3 mm to 1.5 mm, or from 0.4 to 1.2 mm or from 0.4 mm to 0.8 mm, or from 0.4 mm to 0.7 mm. or any range including any mentioned value. In some aspects, the pawl is configured to extend short of the bottom of the groove of the first indexing surface, such that the pawl can vibrate when indexed into the groove. A sharper profile of the grooves, e.g. a steeper angle of the ridge sides, provides more space within the groove.

The profile may provide between 4 and to indexing positions over a 90 or 120 degree rotational range. In some examples, the profile provides between 4 and 7 indexing positions over a 90 or 120 degree rotational range.

In some examples, a groove and ridge together subtend an angle from the centre of the smoking article, around the circumference of the first indexing surface, of from 12 degrees to 30 degrees, or from 15 degrees to 25 degrees, or from 20 degrees to 25 degrees.

FIG. 42 shows a perspective view of a smoking article 420 according to the present invention. The smoking article 420 comprises a tobacco rod 421, first filter and second filter 424, arranged as described above. A sleeve blank 423 is shown before forming into a cylindrical sleeve, as described above. An indexing mechanism may be as described in any embodiment.

The sleeve 423 is provided with one or more first ventilation apertures 426*a*,426*b*. In some embodiments, the sleeve 423 comprises a plurality of spaced first ventilation apertures 426*a*,426*b* extending circumferentially over a part only of the circumference, and for example at a single longitudinal position. In some aspects, the smoking article comprises two first ventilation apertures 426*a*,426*b*. In some examples, the first ventilation aperture 426*a*,426*b* is in the form of a narrow circumferential slot. The first ventilation apertures 426*a*,426*b* are cut-outs, which are formed prior to the sleeve 423 being formed into a cylinder or wrapped around the first or second filters.

The tobacco unit 421 comprises one or more second ventilation apertures 427. In some aspects, the tobacco unit 421 comprises a single second ventilation aperture 427 extending circumferentially over a part only of the circumference, and for example at a single longitudinal position. In some examples, the second ventilation aperture 427 is in the form of one or more narrow circumferential slits, and may be a plurality of slits spaced circumferentially. The second ventilation aperture 427 allows ingress of air into tobacco unit, for example into the first filter. The second ventilation aperture 427 is an aperture or air permeable area allowing air into the filtration material of the first filter, through the layers of sheet material surrounding the filtration material. The second ventilation aperture 427 may be formed in an impermeable sheet material 425, for example tipping paper. The second ventilation aperture 427 may optionally be formed by a laser. The laser formed second ventilation aperture(s) 427 are each smaller in longitudinal extent, and optionally also in circumferential extent, than the cut-out first ventilation apertures 426. The alignable smoking article apertures comprise apertures of different longitudinal and/or circumferential dimensions, and may be formed by different methods.

Alternatively, the dimensions and method of forming of the second ventilation aperture 427 is the same as the dimensions and method of forming of the first ventilation aperture(s) 426 described above. In addition or alternatively, the dimensions and method of forming of the first ventilation aperture(s) 426 is the same as the dimensions and method of forming of the second ventilation aperture(s) 427 described above. The first and second ventilation apertures may have the same or different forms, in any combination.

FIG. 43 shows an exploded view of a smoking article 430 having components substantially as described in any embodiment. The smoking article 430 comprises a tobacco rod 431, first filter 432 and second filter 434, arranged co-axially as described above. The first and second filters 432,434 are separate and abutting sections of filter, each comprising filtration material surrounding by a porous sheet material. The first filter 432 comprises an adsorbent additive, for example, carbon e.g. charcoal. The adsorbent additive may be distributed within the filtration material of the first filter 432. The adsorbent additive may be substantially uniformly distributed in the filtration material, for example cellulose acetate tow. The adsorbent additive may be granules of carbon, or any suitable adsorbent additive. The second filter 434 does not contain any adsorbent additive.

The first filter 432 is surrounded by a limiting unit 435, as described in FIG. 38. The limiting unit 435 may be in the form of a tube (e.g. a cylindrical tube) arranged around the first indexing section 438. The limiting unit 485 is affixed to an exterior surface of the first indexing section. The limiting unit 435 defines a window 435*a*, in the form of an aperture extending circumferentially. First and second contact surfaces are defined at the circumferential ends of the window 435*a*.

The first filter 432 is attached to the tobacco rod 431 with a connecting unit 445, comprising a cylindrical wrap of sheet material. The sheet material may be paper, e.g. tipping paper. The wrap extends only a relatively short distance over the first filter 432, and does not extend over the first indexing section. The wrap 445 may be located within or outside of the limiting unit 435, and outside the limiting unit 435 as shown.

A pawl unit 437 having a radially inwardly extending pawl 439 is located within the window 435*a*, and engaging with the first indexing means. The pawl unit 437 and pawl 439 are as described in any embodiment, in particular, as described in FIG. 39.

A pawl support unit 443 surrounds the pawl unit 437 and limiting unit 435. The pawl support unit 437 supports the pawl unit 437 in position, and allows rotation of the pawl unit. The pawl support unit may be in the form of a tube (e.g. a cylindrical tube), formed from a sheet of sheet material, e.g. paper. The pawl unit 437 is affixed to an interior surface of the pawl support unit 443, for example by adhesive on each side of the pawl 439. The pawl support unit 443 has substantially the same length as the first filter 432. The pawl support unit 443 is not affixed to the limiting unit 435, and is rotatable around the limiting unit 435. The pawl support unit 443 is configured to support the pawl unit 437 within the window 435*a*, and allow rotation of the pawl unit 437 around a longitudinal axis.

A sleeve 433 is shown in the form of a cylindrical sleeve, as described above. The sleeve 433 surrounds and is affixed to the pawl support unit 443 and second filter 434. The sleeve 433 extends around a part of the tobacco rod, and fully around all the other components.

The smoking article has a restraining means comprises a first and second engaging surfaces, as described in FIG. 11, preventing rearward movement of the sleeve 433 relative to the tobacco unit 431,432. The first engaging surface 447*a* may be formed by a forward edge of the connecting unit 445, connecting the source of smokable material 431 to the first filter 432. The second engaging surface 447*b* is provided within an interior surface of the cylindrical tube forming the sleeve, for example by a section folded inwardly and rearwardly.

The tobacco rod 431, first filter 432, connecting unit 445 and limiting unit 435 form a single unit which is rotatable together, and is termed the first part of the smoking article. The pawl unit 437, pawl support unit 443, second filter 434 and sleeve 433 form a single unit which is rotatable together, and is termed the second part of the smoking article. The first and second parts are rotatable relative to each other over a limited range through a plurality of indexed positions. The relative rotational position is configured to select a ventilation of the smoking article, by alignment of ventilation apertures as described in any embodiment.

Alternatively, the smoking article 430 may not comprise the pawl support unit 443. The pawl unit 437 may be directly affixed to the sleeve 433.

FIG. 44 shows schematically a method 500 of manufacturing smoking articles according to the present invention, and in particular, according to the embodiment shown in FIG. 43. The method 500 is configured for manufacturing smoking articles in-line.

The smoking articles are assembled in assembly process 550, using components formed in indexing first filter process 510, indexing section process 520 or 530, and second filter process 540. These processes are now described in turn. The processes may be configured to provide components which are suitable for manufacturing one, two or four smoking article simultaneously, and which are later cut to form individual smoking articles.

The indexing first filter process 510 comprises forming a limiting unit, as described for limiting unit 435 in FIG. 43. A source of sheet material, for example paper, is provided (step 511). Windows are cut-out of the sheet material (step 512) and the material from the windows is removed as waste (step 513). An adhesive is applied to the limiting unit (step 514) for affixing to the first filter with first indexing section, produced in process 520 or 530 described below. The windows are registered with the first indexing sections (step 515), and the limiting unit bonded to the first filter as a cylindrical wrap around the first filter (step 516). A continuous rod comprising a plurality of connected first filters and limiting units may be cut to a rod containing a pre-determined number of first filters (step 517), e.g. four first filters.

The indexing section process 520,530 comprises forming a filter having a first indexing section, first filter 432 in FIG. 43. Indexing section process 520 comprises providing cellulose acetate film (step 521), and embossing an indexing profile (step 522) having grooves and ridges, for example using opposed rollers. The process 520 further comprises providing a standard tow of filtration material (step 523), for example cellulose acetate tow. The tow is formed into a cylinder (step 524), and an adsorbent additive added (step 525), for example carbon particles. The film with an indexing profile is wrapped around the tow to form the first filter (step 526).

Indexing section process 530 is an alternative to process 520. The indexing section process 530 comprises providing cellulose acetate tow (step 531), which is shaped through an aperture (step 532), for example using at least one of heat, pressure and steam. The cellulose acetate material is compressed (step 533), for example between rollers, to form a cellulose acetate film. The film is embossed with an indexing profile (step 534) having grooves and ridges, for example using opposed rollers. The process 530 further comprises providing a standard tow of filtration material (step 535), for example cellulose acetate tow. The tow is formed (536) into a cylinder, and an adsorbent additive added (step 537), for example carbon particles. The film with an indexing profile is wrapped around the tow to form the first filter (step 538). The film with the indexing profile of the first indexing surface surrounds and retains the filtration material.

Second filter process 540 comprises providing conventional filtration material (step 541), for example in the form of cellulose acetate tow. The tow is formed into a cylinder (step 542). The filtration material is wrapped with a sheet material, for example paper, e.g. plugwrap. A continuous rod of wrapped filtration material is cut into pieces for forming a plurality of second filters, e.g. four filters.

The assembly process 550 receives the first filter having a first indexing section (step 551) from process 510. The assembly process 550 further comprises providing a tobacco rod (step 552) and a connecting unit, comprising a blank of sheet material for a cylindrical wrap (step 553). A double-length first filter is connected to two tobacco rods with connecting units (step 554). Thus, the part comprising the first indexing surface is attached to source of smokable material prior to engagement of the second indexing surface. The ratchet sheet material, i.e. the sleeve around the grooved filter, is cut, for example with a laser (step 555). The ratchet sheet material may be any material, e.g. paper, cellulose acetate film or paper-cellulose acetate film laminate.

One or more variable ventilation apertures are formed in the first filter, for example with a laser (step 556). The first filter is cut laterally into two sections, and the two parts separated (step 557).

The assembly process 550 comprises providing standard second filters from process 540 (step 558). Two of the second filters (for example a double length second filter) is inserted between the separated first filters (step 559).

The assembly process 550 further comprises providing a pawl unit. The pawl unit is formed by providing a cellulose acetate film (step 560), from which is cut a blank (step 561). The blanks are separated (step 562), and folded, for example by rollers to form a pawl profile, and optionally first and second stops (step 563). A pressure adhesive is applied to a base of the blank (step 564).

A sleeve is formed by providing sheet material (step 565), for example tipping paper. An edge of the sheet material is folded over to provide an engaging surface (step 566). One or more ventilation apertures are cut in the blank (step 567), and the material of the apertures is removed as waste (step 568). The blank may be formed to provide sleeves for two smoking articles.

The pawl unit is affixed to the sleeve blank (step 569). In some aspects, two pawl units are affixed to each double length sleeve blank. The sleeve blank is located around the first and second filters, with the pawl registered with the window of the limiting unit (step 570). The sleeve blank is secured as a cylinder around the first and second filters and tobacco rods to form a double length smoking article (step 571). Ventilation apertures are formed in the sleeve to provide a base level of ventilation, for example by a laser (step 572). The double length second filter is cut laterally to form two individual smoking articles (step 573). The sleeve is rotated relative to the tobacco rod to preset an initial ventilation of each smoking article (step 574).

FIG. 45 shows schematically a method 600 of manufacturing smoking articles according to the present invention, and in particular, according to the embodiment shown in FIG. 43. The method 600 is configured for manufacturing smoking articles in which the indexing mechanism is assembled as a unit prior to the assembly process.

The smoking articles are assembled in assembly process 650, using components formed in indexing mechanism process 610, and second filter process 540. These processes are now described in turn. The processes may be configured to provide components which are suitable for manufacturing one, two or four smoking article simultaneously, and which are later cut to form individual smoking articles.

The indexing mechanism process 610 comprises forming a first and second indexing section, as described in FIG. 43. The indexing mechanism process 610 comprises forming a pawl unit. The pawl unit is formed by providing a cellulose acetate film (step 601), from which is cut a blank (step 602). The blanks are separated (603), and folded, for example by rollers to form a pawl profile, and optionally first and second stops (step 604). A pressure adhesive is applied to a base of the blank (step 605).

The indexing mechanism process 610 further comprises forming a pawl support unit. A sheet of material is provided (step 606), for example paper e.g. a porous paper such as plugwrap. An adhesive is applied to the sheet material (step 607) to adhere to the pawl. An adhesive is applied by gravure (step 608) to secure the blank as a cylinder. The adhesives used in each step may be the same type of adhesive (glue) for each function, or may comprise different types of adhesive for different functions.

The pawl unit and pawl support unit are affixed together with the applied adhesive (step 609). Adhesive is applied with a non-even spacing (step 611).

First indexing sections are formed in process 520 or 530, as described with respect to FIG. 44.

The indexing mechanism process 610 comprises forming a limiting unit, as described for limiting unit 435 in FIG. 43. A source of sheet material, for example paper, is provided (step 621). Windows are cut-out of the sheet material (step 622) and the material from the windows is removed as waste (step 623).

The windows are registered with the first indexing sections (step 624) from processes 520 or 530, and the limiting unit bonded to the first filter as a cylindrical wrap around the first filter (step 625). The pawl support units with pawl units are wrapped around the first indexing sections (step 626), and bonded in place. Thus, the parts comprising the first and second indexing surfaces are engaged prior to attachment of a source of smokable material. A continuous rod comprising a plurality of connected first filters and indexing mechanisms may be cut to a rod containing a pre-determined number of first filters (step 627), e.g. four first filters.

Second filters are formed in process 540, as described with respect to FIG. 44.

The assembly process 650 receives the first filter having the indexing mechanism (step 651) from process 510. The assembly process 650 further comprises providing a tobacco rod (step 652) and a connecting unit, comprising a blank of sheet material for a cylindrical wrap (step 653). A double-length first filter is connected to two tobacco rods with connecting units (step 654). The ratchet sheet material, i.e. the sleeve around the grooved filter, is cut, for example with a laser (step 655). One or more variable ventilation apertures are formed in the first filter, for example with a laser (step 656). The first filter is cut laterally into two sections, and the two parts separated (step 657).

The assembly process 650 comprises providing standard second filters from process 540 (step 658). Two of the second filters (for example a double length second filter) is inserted between the separated first filters (step 659).

A sleeve is formed by providing sheet material (step 665), for example tipping paper. An edge of the sheet material is folded over to provide an engaging surface (step 666). One or more ventilation apertures are cut in the blank (step 667), and the material of the apertures is removed as waste (step 668). The blank is preferably formed to provide sleeves for two smoking articles.

The sleeve blank is secured as a cylinder around the first and second filters and tobacco rods to form a double length smoking article (step 671). Ventilation apertures are formed in the sleeve to provide a base level of ventilation, for example by a laser (step 672). The double length second filter is cut laterally to form two individual smoking articles (step 673). The sleeve is rotated relative to the tobacco rod to preset an initial ventilation of each smoking article (step 674).

One or more of the embodiments above describe ventilation apertures formed in a sleeve and/or in the tobacco unit. The ventilation apertures are formed such that air can flow into the sleeve or tobacco unit. In particular, the tobacco unit may comprise one or more layers of paper wrap surrounding a filter or chamber. The one or more layers of paper wrap may comprise a plugwrap and/or other material surrounding a filter comprising filtration material, and/or tipping paper joining a filter to a tobacco rod. The ventilation aperture extends through the one or more layers of paper wrap and any other material, such that the air can flow to the air permeable filtration material or chamber. The material in which the ventilation apertures are formed is substantially impermeable to air flow, or has a predetermined permeability to provide a base level of ventilation.

The ventilation aperture(s) of any embodiment may be in the form of a cut aperture, air permeable material or an aperture covered with an air permeable material. References to a ventilation aperture are intended to mean an area which is air permeable. An air permeable area, however formed, is termed a ventilation area.

The movement of the first part relative to the second part of the smoking article is described as varying the ventilation of the smoking article. Alternatively, or in addition, the movement of the first part relative to the second part of the smoking article may vary one or more of: the release or inclusion of a flavourant, the amount of adsorbent additive through which smoke passes, and/or amount of filtration by controlling the effective length of filtration material.

The embodiments of smoking articles are described as not having a chamber, or free internal space, between the first part and second part. Alternatively, any of the embodiments may have a chamber of fixed longitudinal length between the first part and second, and in particular between filters of the first and second parts. The ventilation may varied by rotation between the first and second parts, and restraining means prevents relative longitudinal movement which changes the length of the chamber. Alternatively, the smoking article may be configured for longitudinal movement of an outer sleeve around the tobacco unit, for example, the vary ventilation. In this case, any chamber is within the tobacco unit, and the length is not affected by movement of the outer sleeve. The indexing mechanism is described as producing an audible sound. Alternatively, the smoking article may be configured such that rotation and/or longitudinal movement generates a sound separately from, or without, an indexing mechanism.

The ventilation apertures in the sleeve and/or tobacco unit may be formed by a laser. In particular, the laser may simultaneously generate aligned ventilation apertures in the sleeve and tobacco unit. Alternatively, the ventilation apertures may be formed as a slit by a mechanical cutting tool. Alternatively, the ventilation apertures may be formed as a cut-out area. Alternatively, the ventilation apertures may be formed by an air permeable material, which is either manufactured as a permeable material or made permeable by the addition of apertures or by processing.

Any feature of the control mechanism as described with respect to FIGS. 1 to 5 may be applicable to any other embodiment. The depressions forming part of the control mechanism have been described as grooves. Alternatively, the depression may have any shape to engage with a feature in the other of the first or second part. In particular, the depressions may be square or circular.

The ridge between adjacent depressions defines a single circumferential point of maximum resistance to movement of the engaging feature between the adjacent depressions. Alternatively, the ridge may be a land having a substantially constant radius over the circumferential distance between adjacent depressions. The depressions in the first or second part may be configured to engage with any shape of protrusion in the other of the first or second part.

Any of the features of any embodiment may be combined with any of the features of any other embodiment. In particular, any of the embodiments of smoking article may or may not have a filter section adjoining the cylinder of tobacco, and/or may not have a filter section at the mouthpiece end of the sleeve. In particular, the sleeve may not have a filter attached to it, and may define a recess at the mouthpiece end or may have an edge at the mouthpiece end which is aligned with a rear end of the first filter. The restraining means or limiting means of any embodiment may be used with any other embodiment, to prevent or control longitudinal and/or rotational movement of the first part relative to the second part, or any part moveable over another part. The ventilation in a particular longitudinal or rotational position may be as described, or may be applicable to a different position, for example, by varying the location of one or more ventilation apertures.

A reference to a filter may alternatively refer to two adjacent and co-axial filters. One or more of the filters may be formed of a single segment of filter material or a plurality of segments. A filter formed of a plurality of segments may comprise segments made of different materials or having different filtration properties. In particular, a filter may comprise a standard segment of cellulose acetate tow and a further segment of filtration material including charcoal. Alternatively, the filter may be a single segment incorporating carbon, for example in the form of charcoal.

The indexing mechanism may be configured to allow relative rotation equally in both directions or senses. Thus, a clockwise rotation generates the same sound and resistance as an anti-clockwise rotation of the second part relative to the first part. Any such rotation is subject to the limiting mechanism. The term "pawl" is not intended to indicate a part of a ratchet mechanism, allowing rotation in only one direction. Alternatively, the indexing mechanism may be configured as a ratchet mechanism, in which one direction of rotation is prevented. Alternatively, the first and/or second indexing means may be asymmetric such that rotation in one direction of rotation requires more force than in the opposite direction.

The smoking article has been described as having an indexing mechanism configured to index between different positions. Alternatively, the smoking article may comprise a limiting mechanism, and may not have an indexing mechanism.

Embodiments of the invention are configured to comply with applicable laws and/or regulations, such as, by way of non-limiting example, regulations relating to emissions, constituents, testing, and/or the like. For example, the invention may be configured such that a smoking article implementing the invention is compliant with applicable regulations before and after adjustment by a user. Such implementations may be configured to be compliant with applicable regulations in all user-selectable positions. In some embodiments, the configuration is such that a smoking article implementing the invention meets or exceeds required regulatory test(s) in all user-selectable positions, such as, by way of non-limiting example, the testing threshold(s)/ceiling(s) for cigarette emissions and/or smoke constituents.

The invention claimed is:

1. A smoking article, comprising:

a first part, a second part movable relative to the first part, further comprising an indexing mechanism comprising a first indexing surface on one of the first part and second part; and a second indexing surface on the other of the first and second parts, wherein the second indexing surface is configured to engage with the first indexing surface to control relative movement between the first part and second part, wherein the second indexing surface comprises at least one pawl, wherein the pawl comprises at least one upstanding substantially planar section of sheet material affixed to or integrally formed with a substrate, wherein a plane of the at least one upstanding substantially planar section of sheet material extends away from the substrate, such that a tip or peak of the pawl is distal from the substrate, and wherein the tip or peak of the pawl deflects radially as the pawl is moved over the first indexing surface.

2. The smoking article as claimed in claim 1, wherein at least one of the first part and the second part comprises at least one ventilation area, wherein the relative position of the first part to the second part is configured to selectively control ventilation through the at least one ventilation area, and at least one of the following:

at least one first ventilation area is a circumferentially extending slit;

at least one first ventilation area is a circumferentially extending slot;

at least one second ventilation area is a circumferentially extending slit;

at least one second ventilation area is a circumferentially extending slot;

the first and second ventilation areas have different dimensions;

the first and second ventilation areas are formed by different methods;

the first part comprises at least one laser-cut ventilation aperture; and the second part comprises pre-cut ventilation apertured sheet material.

3. The smoking article as claimed in claim 1, wherein the indexing mechanism is configured to generate a sound when moved between indexing positions, and at least one of the following:

the second indexing surface comprises at least one pawl extending radially and configured to resiliently deform when moved between indexing positions of the first indexing surface;

the second indexing surface is configured to resiliently deform in an indexing direction;

the second indexing surface comprises at least one upstanding substantially laminar section;

the second indexing surface comprises at least one upstanding substantially planar section;

the second indexing surface comprises an elongate engaging edge;

the second indexing surface comprises first and second upstanding laminar sections, wherein an elongate engaging edge is defined at a connection between the first and second upstanding laminar sections;

the at least one pawl extends radially, wherein a said pawl defines a substantially triangular cross-section;

the at least one pawl subtends an angle from 10 to 55 degrees;

the at least one pawl subtends an angle from 15 to 40 degrees;

the at least one pawl subtends an angle from 15 to 30 degrees;

the at least one pawl subtends an angle of approximately 20 degrees; and the pawl comprises sheet material having a fold to define an engaging edge.

4. The smoking article as claimed in claim 1, wherein at least one of the first indexing surface and the second indexing surface comprises at least one section having an exterior surface extending at an angle to a radial direction, and at least one of the following:

at least one of the first indexing surface and the second indexing surface comprises at least one section which extends at an angle to a radial direction which contact during movement between indexing positions;

at least one of said indexing surfaces extends with a substantially uniform cross-section along a direction perpendicular to indexing movement;

at least one of said indexing surfaces extends substantially in a plane;

at least one of the first indexing surface and the second indexing surface comprises a plastics material;

at least one of the first indexing surface and the second indexing surface comprises a sheet of polymer material;

at least one of the first indexing surface and the second indexing surface comprises regenerated cellulose;

at least one of the first indexing surface and the second indexing surface comprises at least one of: a plastics material, a polymer, a polysaccharide, cellulose sheet, regenerated cellulose, cellulose acetate, polyethylene, paper, paper treated with a rigidity increasing additive, a cellulose acetate film, a cast cellulose acetate film, a cellulose acetate film formed from cellulose acetate tow, a cellulose film, and one of a plastics material and polymer excluding at least one of: cellulose acetate, cellulose, polypropylene, and paper;

at least one of the first indexing surface and the second indexing surface comprises a laminate comprising at least two layers of sheet material affixed together, the sheet material comprising at least one of: paper, paper treated with a rigidity increasing additive, a plastics material, a polymer, a polysaccharide, cellulose, regenerated cellulose, cellulose acetate, cellulose acetate film, a cast cellulose acetate film, a cellulose acetate film formed from cellulose acetate tow, a cellulose film, a cellulose layer, polyethylene, and one of a plastics material and polymer excluding at least one of: cellulose acetate, cellulose, polypropylene, and paper; and at least one of the first and the second indexing surfaces comprises an upstanding join between ends of a sheet material arranged as a cylinder.

5. The smoking article as claimed in claim 1, wherein at least one of the following:

the substrate comprises a cylindrical tube having an overlap section arranged to overlap itself, wherein the pawl is defined by an upstanding part of the overlap section; and the substrate is cut to define at least one tab, wherein the tabs are configured to be upstanding and define at least one pawl.

6. The smoking article as claimed in claim 1, comprising a limiting mechanism configured to limit a range of rotation of the second part relative to the first part, and wherein the limiting mechanism comprises at least one of the following:

a first and second contact surface formed on the first part adjacent the first indexing surface, and a first and second stop formed on a unit defining the second indexing surface, wherein the first contact surface is engageable with the first stop, and the second contact surface is engageable with the second stop, to limit rotation between the first and second parts of the smoking article;

a cylindrical tube defining a circumferentially extending slot on the first part of the smoking article, wherein the first and second contact surfaces are ends of the slot;

the unit defining the second indexing surface is a pawl unit defining a pawl and the first and second stops;

the pawl unit comprises a sheet material;

first and second stops are radially extending protrusions adjacent circumferential ends of a pawl unit defining an upstanding pawl, wherein the first and second stops are circumferentially spaced from the upstanding pawl;

first and second stops are formed by at least one fold in the sheet material forming the pawl unit;

the second part comprises a pawl support unit configured to support the pawl and allow rotation of the pawl relative to the first indexing surface;

the pawl support unit is a cylindrical tube rotatable around the first indexing surface, wherein the pawl unit is affixed to an interior of the pawl support unit;

the second part comprises a sleeve arranged around the first part, wherein the sleeve surrounds and is affixed to the pawl support unit; and the sleeve, pawl support unit and pawl unit are rotatable together around the first indexing surface.

7. The smoking article as claimed in claim 1, wherein at least one of the first indexing surface and the second indexing surface comprises a surface defining a plurality of raised areas and depressions spaced in a direction of indexing movement, and at least one of the following:

at least one of the first indexing surface and the second indexing surface comprises depressions in the form of elongate grooves which extend substantially longitudinally, and wherein adjacent grooves are separated by a ridge;

at least one of the first indexing surface and the second indexing surface comprises a ridge between adjacent depressions which defines a substantially single point of maximum resistance to movement of the other of the first indexing surface or second indexing surface between the adjacent depressions; and at least one of the first indexing surface and the second indexing surface comprises a ridge between adjacent depressions, wherein the ridge has a shorter circumferential extent than an adjacent depression.

8. The smoking article as claimed in claim 1, wherein the first part is rotatable relative to the second part, and the indexing mechanism is configured to control relative rotation between the first part and second part to select one of a plurality of indexing positions.

9. The smoking article as claimed in claim 1, wherein the first indexing surface is located on or adjacent to an exterior surface of a filter, and at least one of the following:

wherein the filter comprises filtration material wrapped with one or more sheets of material, wherein the one or more sheets is shaped to define or support the first indexing surface; and wherein the first indexing surface is formed on a sheet material, wherein the sheet material defines the profile of the first indexing surface and surrounds the filtration material.

10. The smoking article as claimed in claim 1, wherein the first part comprises a first substrate and the second part comprises a second substrate, wherein the first and second substrates are joined by a connection allowing relative rotation of the first and second substrates, wherein the first and second substrates are first and second sections of filter, and the connection is formed by a central core of filter which is integrally formed with the first and second sections of filter.

11. The smoking article as claimed in claim 1, further comprising at least one filter comprising filtration material, wherein a said filter comprises an adsorbent additive, and at least one of the following:

the filter comprises carbon; and the filter comprises activated charcoal.

12. The smoking article as claimed in claim 11, wherein the adsorbent additive is one of:

located within a pod surrounded by filtration material; dispersed within the filtration material;

arranged on a periphery of the filtration material and arranged within a chamber in the smoking article, and wherein at least one of the following:

the smoking article comprises a first filter comprising adsorbent additive, wherein the first indexing surface is located on a periphery of the first filter;

the smoking article comprises a second filter, wherein the second filter is located rearwardly of the first filter and does not comprise adsorbent additive;

the carbon is located within the first section of filter connected by a central core; the carbon is located within the second section of filter connected by a central core; and wherein the first part comprises a first section of filter, and the second part comprises a second section of filter connected to the first section of filter by a central core, wherein the second part further comprises a third section of filter.

13. The smoking article as claimed claim 1, wherein the smoking article comprises a restraining means configured to limit relative longitudinal movement between the first and second parts.

14. The smoking article as claimed in claim 1, wherein the first indexing surface comprises an upstanding feature formed by at least one of: an embossed feature, a punched feature, at least one corrugation, an adhesive pip, an adhesive dot, an ink pip, an ink dot, and an affixed section of sheet material, and wherein at least one of the following:

further comprising a first indexing part defining the first indexing surface and a second indexing part defining the second indexing surface, wherein at least some of the first indexing part is located radially within the second indexing part such that the first and second indexing surfaces are engaged, and wherein at least some of the first indexing part has a same external diameter as the second indexing part;

the second indexing surface defines an open space within an exterior surface; the first indexing surface and second indexing surface are located longitudinally between a first filter of the first part and a second filter of the second part; and a chamber is located within the first indexing surface.

15. A Method of manufacturing the smoking article of claim 1, comprising:

providing a first part, providing a second part, and attaching the second part to the first part such that the second part is movable relative to the first part, forming in the first and second parts an indexing mechanism comprising a first indexing surface on one of the first part and the second part; and a second indexing surface on the other of the first and second parts, wherein the second indexing surface is formed to engage with the first indexing surface to control relative rotation between the first part and second part, wherein the second indexing surface is formed with at least one pawl comprising at least one upstanding section of sheet material affixed to or integrally formed with a substrate, and wherein the pawl extends away from the substrate, such that a tip or peak of the pawl is distal from the substrate.

16. The method as claimed in claim 15, further comprising forming at least one of the first part and the second part to comprise at least one ventilation area, wherein the first and second parts are formed such that the relative position of the first part to the second part is configured to selectively control ventilation through the at least one ventilation area, and further comprising at least one of the following:

forming the second indexing surface with at least one pawl extending radially, and forming the pawl by deforming a blank of sheet material;

forming the pawl by deforming a blank with a forming tool to define an edge; forming the pawl with integral first and second upstanding sections of sheet material, and folding the sheet material to form an edge connecting the first and second upstanding sections;

affixing the pawl to the substrate on at least one side of the upstanding pawl; engaging the parts comprising the first and second indexing surfaces prior to attachment of a source of smokable material; and attaching the part comprising the first indexing surface to a source of smokable material prior to engagement of the second indexing surface.

17. The method as claimed in claim 15, further comprising forming the second part as a cylindrical collar with a pawl, and affixing a sleeve to an exterior of the collar, and at least one of the following:

forming the collar prior to attachment to the first indexing surface, and sliding the collar around the first indexing surface using a collet to compress the first indexing surface and/or a mandrel to support the collar;

forming the collar by attachment of two sections of sheet material around the first indexing surface;

forming the collar by wrapping a sheet material around the first indexing surface; wrapping the sheet material from an edge of the sheet material;

wrapping the sheet material from between the edges of the sheet material; and forming the second part from a sheet material, wherein the sheet material is pre-cut with ventilation apertures prior to forming into a cylinder.

18. A filter for a smoking article, comprising:

a first indexing surface configured to engage with a second indexing surface to form an indexing mechanism;

wherein the first indexing surface is configured to engage with the second indexing surface to control relative movement between the first indexing surface and second indexing surface, wherein the second indexing surface comprises at least one pawl, wherein the pawl comprises one or more upstanding substantially planar sections of sheet material affixed to or integrally formed with a substrate, wherein a plane of the at least one upstanding substantially planer section of sheet material extends away from the substrate, such that a tip or peak of the pawl is distal from the substrate; and wherein the tip or peak of the pawl deflects radially as the pawl is moved over the indexing surface.

19. The filter as claimed in claim 18, wherein at least one of the following:

the filter comprises at least one ventilation area;

the relative position of a movable part attached to the filter is configured to selectively control ventilation through the at least one ventilation area; and the first indexing surface is configured to generate a sound in association with the second indexing surface when moved between indexing positions.

20. The filter as claimed in claim 18, wherein the filter comprises a first part defining the first indexing surface, and a second part defining the second indexing surface, wherein the second indexing surface comprises at least one pawl extending radially, and configured to resiliently deform when moved between indexing positions of the first indexing surface.

21. The smoking article as claimed in claim 1, wherein the second indexing surface is formed by said at least one pawl and wherein the tip or peak of the pawl forms the second indexing surface as an elongate engaging edge distal from the substrate.

22. The filter as claimed in claim 18, wherein the second indexing surface is formed by said at least one pawl and wherein the tip or peak of the pawl forms the second indexing surface as an elongate engaging edge distal from the substrate.

* * * * *